US010435895B2

(12) United States Patent
Grumberg et al.

(10) Patent No.: US 10,435,895 B2
(45) Date of Patent: Oct. 8, 2019

(54) ADJUSTABLE PLATFORM EXTENSION BRACKET FOR WORK PLATFORM SYSTEMS AND RELATED METHODS

(71) Applicant: Safway Services, LLC, Waukesha, WI (US)

(72) Inventors: Mathieu Grumberg, Delmar, NY (US); Roy Scrafford, Scotia, NY (US); Frederick W. Meade, North Creek, NY (US)

(73) Assignee: BRANDSAFWAY SERVICES LLC, Kennesaw, GA (US)

( * ) Notice: Subject to any disclaimer, the term of this patent is extended or adjusted under 35 U.S.C. 154(b) by 204 days.

(21) Appl. No.: 15/062,822

(22) Filed: Mar. 7, 2016

(65) Prior Publication Data

US 2017/0254099 A1 Sep. 7, 2017

(51) Int. Cl.

| | |
|---|---|
| ***E04G 5/00*** | (2006.01) |
| ***E04G 3/22*** | (2006.01) |
| ***E04G 5/06*** | (2006.01) |
| ***E04G 5/14*** | (2006.01) |
| ***E04G 1/15*** | (2006.01) |
| ***E04G 3/24*** | (2006.01) |
| ***E04G 7/20*** | (2006.01) |
| ***E04G 7/28*** | (2006.01) |
| *E04G 1/34* | (2006.01) |

(52) U.S. Cl.

CPC ..... *E04G 5/006* (2013.01); *E04G 1/152* (2013.01); *E04G 3/22* (2013.01); *E04G 3/24* (2013.01); *E04G 5/007* (2013.01); *E04G 5/061* (2013.01); *E04G 5/14* (2013.01); *E04G 7/20* (2013.01); *E04G 7/28* (2013.01); *E04G 1/34* (2013.01); *E04G 2001/157* (2013.01); *E04G 2007/285* (2013.01)

(58) Field of Classification Search

CPC ..... E04G 5/061; E04G 5/006; E04G 1/152; E04G 3/22; E04G 3/24; E04G 7/20; E04G 7/28

See application file for complete search history.

(56) References Cited

U.S. PATENT DOCUMENTS

| | | | |
|---|---|---|---|
| 2,261,907 | A | 11/1941 | Uecker et al. |
| 3,223,370 | A | 12/1965 | Pignon |
| 3,595,510 | A | 7/1971 | Hutchinson |

(Continued)

FOREIGN PATENT DOCUMENTS

| | | | |
|---|---|---|---|
| DE | 4319664 | A1 | 2/1995 |
| DE | 19653363 | A1 | 6/1998 |
| EP | 2267242 | A2 | 12/2010 |

*Primary Examiner* — Alvin C Chin-Shue

(74) *Attorney, Agent, or Firm* — Husch Blackwell LLP

(57) ABSTRACT

An adjustable platform extension bracket for work platform systems comprises a post member having two posts joined by a plurality of positional structures. A first connection portion forms a first channel such that the first connection portion is symmetrical along an axis parallel with and passing through the channel. The post member is slidingly engaged in the first channel such that at least one of the positional structures is positionable in the channel. The bracket does not require any diagonal support. The dimensions of work platforms, particularly suspended work platform systems, may be extended using the adjustable platform extension bracket.

28 Claims, 55 Drawing Sheets

(56) References Cited

U.S. PATENT DOCUMENTS

| | | | | |
|---|---|---|---|---|
| 3,613,832 | A | 10/1971 | Dunster | |
| 4,372,425 | A | 2/1983 | Murphy | |
| 4,821,844 | A | 4/1989 | Huffman et al. | |
| 6,422,341 | B1 * | 7/2002 | Engdahl | E06C 7/16 182/103 |
| 6,729,440 | B1 * | 5/2004 | Bailey | E06C 7/08 182/200 |
| 7,228,938 | B1 | 6/2007 | Mitchell | |
| 7,735,606 | B1 | 6/2010 | Norton | |
| 2005/0115767 | A1 * | 6/2005 | Moss | E04G 1/152 182/119 |
| 2010/0230210 | A1 * | 9/2010 | Hanks | B60P 3/08 182/113 |

* cited by examiner

ADJUSTABLE PLATFORM EXTENSION BRACKET FOR WORK PLATFORM SYSTEMS AND RELATED METHODS

FIELD OF THE INVENTION

The present invention relates, generally, to the field of work platform systems. More particularly, the present invention relates to structures capable extending, and preferably adjustably extending, the size of a work platform system in the field.

BACKGROUND OF THE INVENTION

When erecting work platform systems, such as suspended work platform systems, the platforms are erected as close to a wall or other surface as possible. However, at some point, standard work platform system components will not fit to extend the platform as close to the wall or other surface as necessary to create a flush or nearly flush interface between the platform and wall/other surface, leaving an undesirable gap between the platform and the wall and/or surface. In particular, when walls/other surface are, for example, contoured, the most outwardly-projecting portion of the wall/surface may dictate how close to the wall/surface the work platform system may go when using standard components.

Existing brackets (e.g., side brackets) work with traditional supported scaffolding to provide either a fixed extension width or limited extension range (e.g., 1-2 planks). These brackets, however, are not suitable for use with a suspended work platform system.

For at least these reasons, therefore, it would be advantageous if a new or improved structure, system and/or method for extending the platform of a work platform system, and particularly a suspended work platform system, could be developed that addressed one or more of the above-described concerns, and/or other concerns.

SUMMARY OF THE INVENTION

In accordance with one embodiment, disclosed herein is an adjustable platform extension bracket for work platform systems, and particularly suspended work platform systems.

In accordance with a further embodiment, disclosed herein is a bracket comprising a post member having a width and comprising a first post and a second post, the first and second posts being parallel and connected by a plurality of positional structures, each positional structure including an aperture, and a first connection portion comprising a base and two channel structures secured to the base at a distance from one another thereby forming a first approximately U-shaped channel, wherein the two channel structures each include at least one aperture, wherein the apertures are coaxial, and wherein the base includes two apertures, each aperture positioned outside of the channel adjacent a respective channel structure such that the first connection portion is symmetrical along an axis parallel with and passing through the center of the channel, wherein the width of the post member is less than the distance between the channel plates of the first connection portion, wherein the post member is slidingly engaged in the first channel such that at least one of the plurality of positional structures is positionable between the channel structures of the first connection portion with the aperture of the at least one positional structure coaxial with the apertures of the channel structures of the first connection portion, and wherein the bracket is free from any diagonal support member when in standard operating position.

In accordance with a further embodiment, disclosed herein is an extended work platform comprising a work platform comprising at least two hubs; and at least two platform extension brackets, each comprising a base post member having a width and comprising a first post and a second post, the first and second posts being parallel and connected by a plurality of positional structures, each positional structure including an aperture, and a hub connection portion comprising a base portion and two channel plates connected to the base plate and separated at a distance to form a first U-shaped channel, wherein the base portion includes at least two apertures, each aperture positioned outside of the channel adjacent a respective channel structure such that the first connection portion is symmetrical along an axis parallel with and passing through the center of the channel, wherein the base post member is slidingly engaged in the first channel, wherein each hub connection portion is secured to a respective one of the at least two hubs, and at least one flooring plank is secured to the base post members so as to extend between them.

In accordance with a further embodiment, disclosed herein is a method of extending a work platform comprising providing a suspended work platform system comprising a plurality of hubs and a plurality of elongated members; providing at least two hub connection portions, each hub connection portion comprising a first channel formed from a base portion and two channel plates secured to the base portion, wherein the hub connection portion is symmetrical along an axis parallel with and running through the center of the first channel; connecting each hub connection portion to an upper surface of a respective one of the plurality of hubs; providing at least two base post portions; sliding the base post portions into respective first channels; securing the base post portions in a position; and installing at least one flooring section or plank on the base post portion so as to extend between the base post portions.

In accordance with a further embodiment, disclosed herein is a suspended work platform system comprising a plurality of hubs; a plurality of elongated members interconnected with the plurality of hubs to form a suspended work platform system; at least two platform extension brackets, each comprising a base post member having a first end, a second end comprising a guard rail post connector and a width and comprising a plurality of positional structures, each positional structure including an aperture, and a hub connection portion comprising a base plate containing at least two apertures and two channel plates connected to the base plate and separated at a distance to form a first U-shaped channel, wherein each of the apertures is located outside of the channel and adjacent a respective channel plate such that the hub connection portion is symmetrical along an axis parallel with and passing through the center of the first channel, wherein the base post member is slidingly engaged in the first channel, wherein each hub connection portion is secured to a respective one of the plurality of hubs, and at least one flooring section or planks installed on and extending between the second ends of the at least two base post members.

DETAILED DESCRIPTION

In accordance with one embodiment, such as shown in FIGS. 1A through 1D, disclosed herein is a first embodiment of an adjustable platform extension bracket for work platform systems. The adjustable platform extension bracket ("bracket") 100 extends outwardly away from at least a portion of an existing suspended work platform system 500 (not shown) to provide an extension of the work platform system 500 (not shown).

Figure 4A:
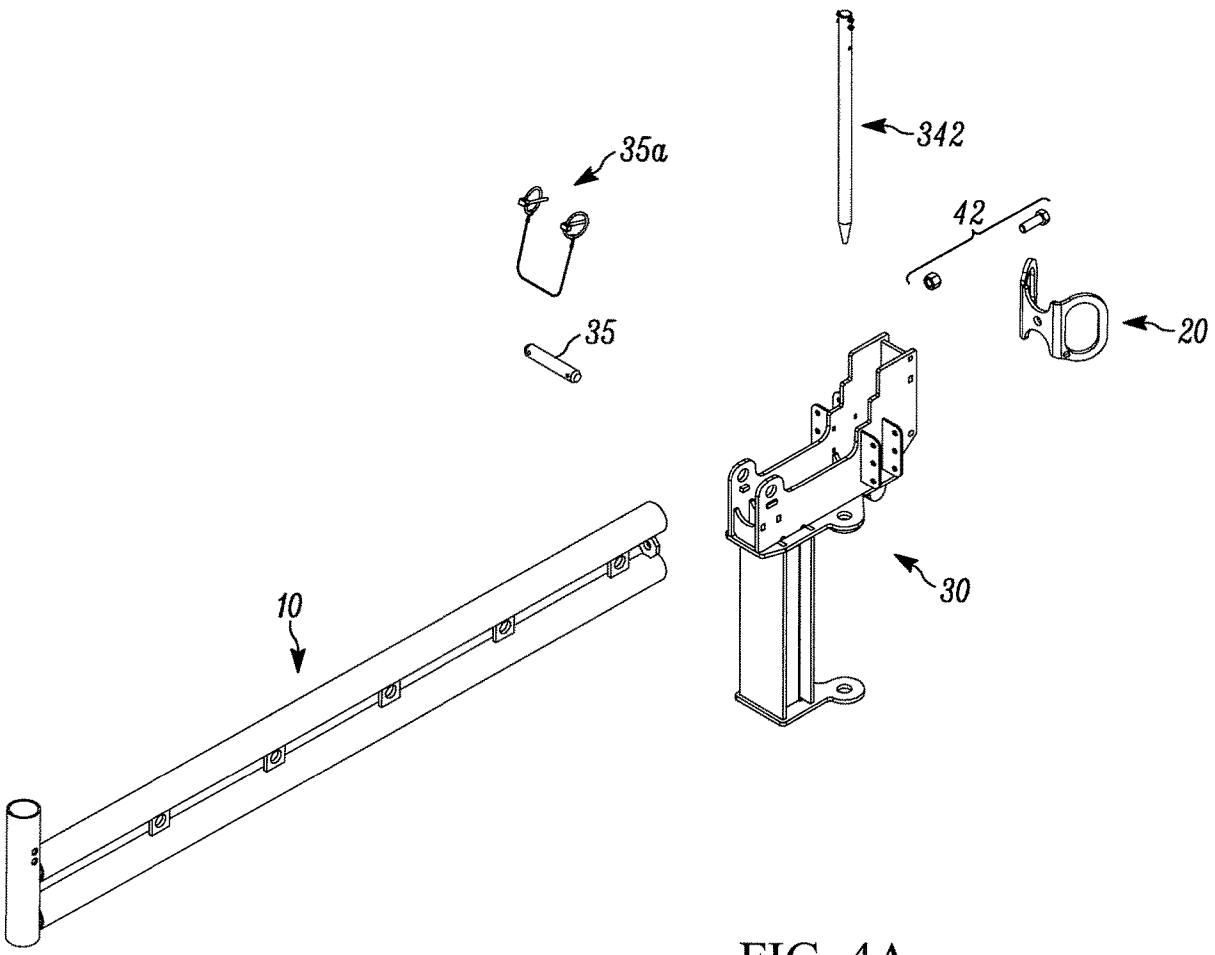
FIG. 4A is an exploded view of a first embodiment of an adjustable platform extension bracket.
Figure 4B:
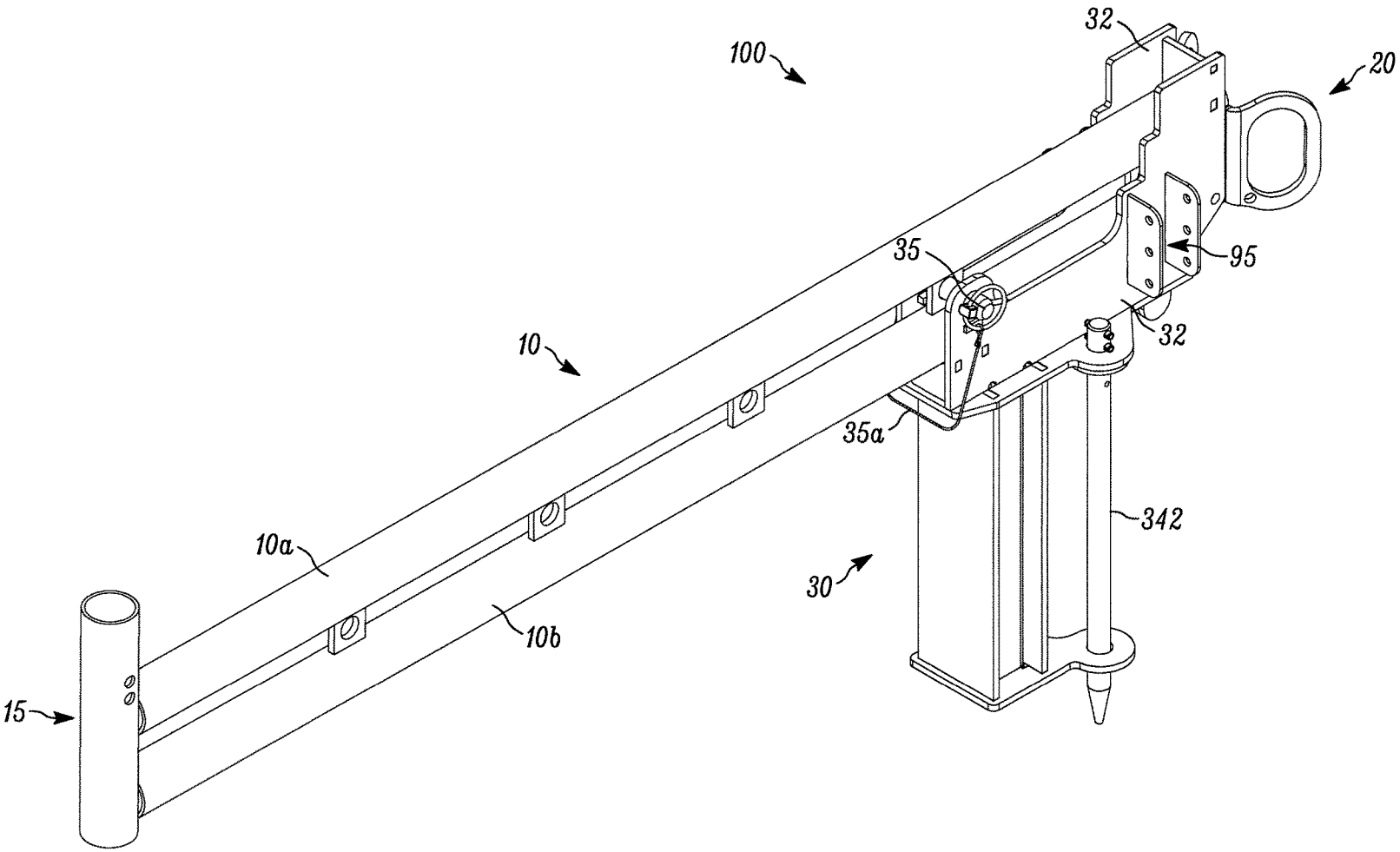
FIG. 4B is a first embodiment of an adjustable platform extension bracket which is assembled.

In an embodiment, and as shown with reference to FIGS. 4A and 4B, the bracket 100 is composed of base post member 10 slidingly engaged with a hub connection portion 30.

In the embodiment shown, and particularly with reference to FIGS. 2A-2D, the base post member 10 includes two posts 10*a*, 10*b* which are parallel to one another and joined at intervals along their length at connections 12, at least some of which include an aperture 13. As described in further detail, the connections 12 containing apertures 13 are referred to as "positional structures" because the location of the connections 12 with apertures 13 determines the position of the post member 10 in the hub connection portion 30 and, therefore, the size of the extended platform (see FIGS. 1A-1D, 30-32).

In the embodiment shown, the base post member 10 includes at least 3, preferably at least 4, more preferably at least 5 positional structures (12/13). As described in further detail below, as a result, the brackets 100 described herein are capable of securing at least 3, preferably at least 4, and more preferably at least 5 flooring planks or sections.

In an embodiment, the posts 10*a*, 10*b* have an outer diameter approximately equal to that of a standard scaffold tube member and are configured to accept standard commercial scaffold components (e.g., hooks, planks, scaffold clamps, etc.). In particular, at least one of the posts 10*a*, 10*b* is configured to receive at least a portion of a flooring section or plank for a work platform. As used herein, the term "flooring section or plank," as used herein and in the context of a work platform and/or work platform system, refers to any structure or combination of structures used as a flooring surface in a work platform system.

In a further embodiment, the posts 10*a*, 10*b* are made using standard scaffold tube members.

In an embodiment, the first end portion 11*a* of the base post member 10 includes plate structure 20, which serve at least in part to prevent the first end portion 11*a* from disengaging the hub connection portion 30 by sliding too far through the hub connection portion 30. The plate structure 20 may also serve as a grasping portion and/or handle, such as in the exemplary embodiment shown, to facilitate transport and assembly of the bracket 100. As shown in FIG. 4A, the plate structure 20 is secured to the post member 10 with a nut/bolt connection 92 which engages opening 93 on the base post member 10.

In an embodiment, the second end portion 11*b* of the base post member 10 includes a guard rail post connector 15 which is configured to secure a guard rail post (not shown).

With reference to FIGS. 3A-3D, the hub connection portion 30 is configured to secure to a hub 310 of a suspended work platform system 500 (see FIGS. 5A and 5B) while engaging the base post member 10 (not shown) in a sliding engagement.

In the embodiment shown, the hub connection portion 30 includes a base structure 31 and a channeled structure 32 which forms a channel 38 in which the base post member 10 (not shown) is slidingly engaged.

As further shown in FIGS. 3A-3D, the base structure 31 has a top element 31*a* and a bottom element 31*b* connected by a mid-section 37. The top and bottom elements 31*a*, 31*b* may be substantially planar in configuration, as well as being parallel to each other. The mid-section 37 may be a rectangular, tubular, or plate-like section wherein a longitudinal axis of the mix-section 37 is normal to the planes of the top and bottom elements 31*a*, 31*b*.

The top and bottom elements 31*a*, 31*b* include at least one, and preferably two openings 33*a*, 33*b* (respectively) extending through both the top and bottom elements 31*a*, 31*b*. The openings 33*a*, 33*b* are interspersed on the elements 31*a*, 31*b* so as to offer various locations for connecting to a hub 310 (not shown). The openings 33*a*, 33*b* are interspersed on the top and bottom elements 31*a*, 31*b* so that the respective opening are coaxial.

In an embodiment shown, the channeled structure 32 is composed of two channel plates 32 which together with the top surface of the top element 31*a* form a three-sided channel 38 in which the base post member 10 (not shown) is slidingly engaged. In the embodiment shown, the channel 38 is approximately U-shaped. The channel plates 32 are positioned on the base structure 31 to form the channel 38 having a width just greater than the external diameter of the posts 10*a*, 10*b*.

In the embodiment shown, the channel plates 32 have, generally a first end 32*a* with a first height H1 and a second end 32*b* with a second height 112. The first height H1 corresponds to the height of a first post 10*b* (see FIG. 4B). The second height H2 corresponds to the height of both posts 10*a*, 10*b*.

In an embodiment, such as shown in FIGS. 3A-3D, the hub connection portion 30 also includes a plurality of structural plates 80 which strength the hub connection portion 30, support the base post member 10 (not shown) when engaged in the hub connection portion 30, and/or stabilize the channel plates 32.

In a further embodiment, the hub connection portion 30 also includes a nub-like structure 39 which is positioned approximated under the channel 38 near the second ends 32*b* of the channel plates 32. The nub-like structure 39 engages at least a portion of the center opening 316 of a hub 310 to help secure the hub connection portion 30 in position.

In an embodiment, the channel plates 32 include an aperture 34 creating a continuous passage through the plates 32. As shown in FIGS. 4A and 4B, when the base post member 10 is positioned in the hub connection portion 30 such that at least one aperture 13 at a connection 12 is aligned with the apertures 34 of the channel plates 32, a pin 35 inserted through the channel plates 32 (e.g., at aperture 34) and at least one respective connection 12 aligned with aperture 34 locks the base post member 10 in position. As will be discussed further with reference to FIGS. 1A-1D, the distance between connections 12 with apertures 13 corresponds to the width of scaffold plank sections.

In an embodiment, such as, for example, shown with reference to FIGS. 4A-4B, the pin 35 may further include a wire 35*a* which engages the pin 35 and prevents the pin 35 from disengaging the apertures 34/13.

In an embodiment, channel plates 32 may include two or more apertures 34 to correspond to one or more connections 12 with apertures 13. For example, apertures may be spaced at a distance corresponding to an interval between a first connection 12 with an aperture 13 and a second connection 12 with an aperture 13. Therefore, when a first connection 12 with an aperture 13 is aligned with one of the apertures 34, for example, a second (or subsequent) connection 12 with an aperture 13 is necessarily aligned with the second of the apertures. As a result, two connections 12 with apertures 13 of the base post member 10 may each be engaged by a pin 35 to further secure the base post member 10 in a position.

Figure 8A:
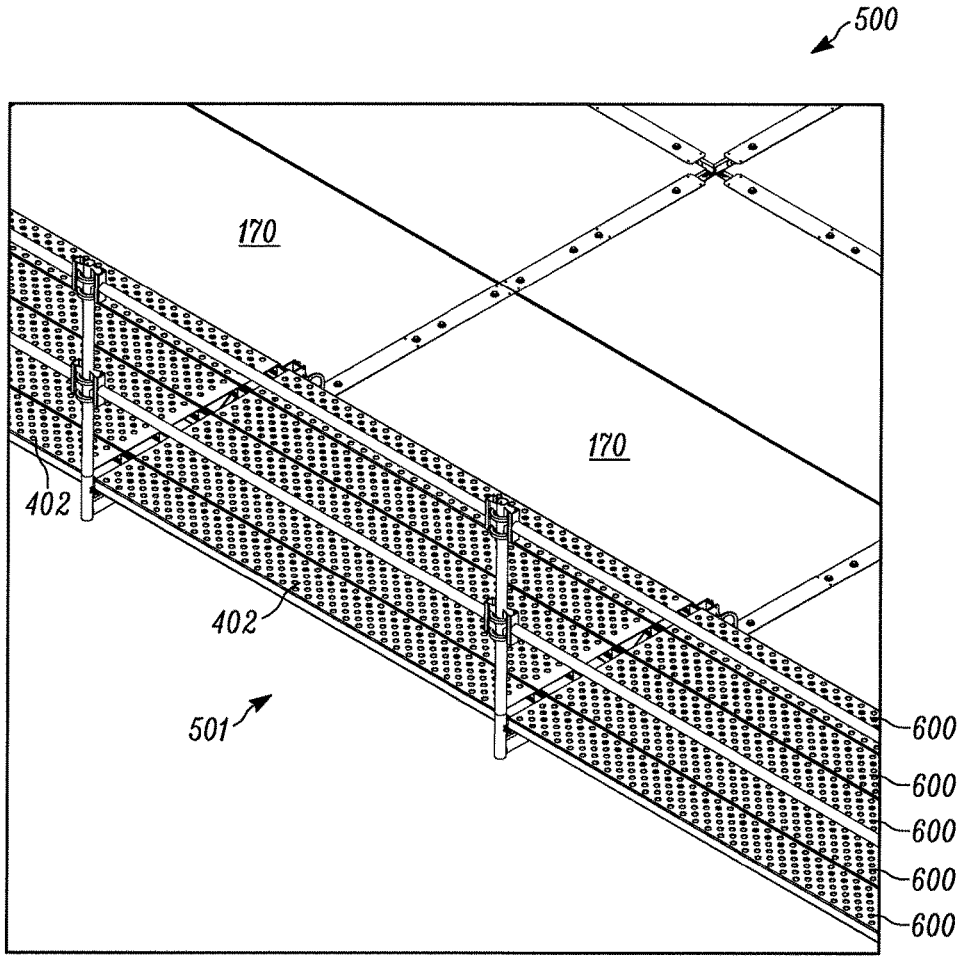
FIGS. 8A, 8B, and 8C show the first embodiment of an adjustable platform extension bracket secured to a portion of a work platform system with a work platform secured to the base post member.
Figure 8B:
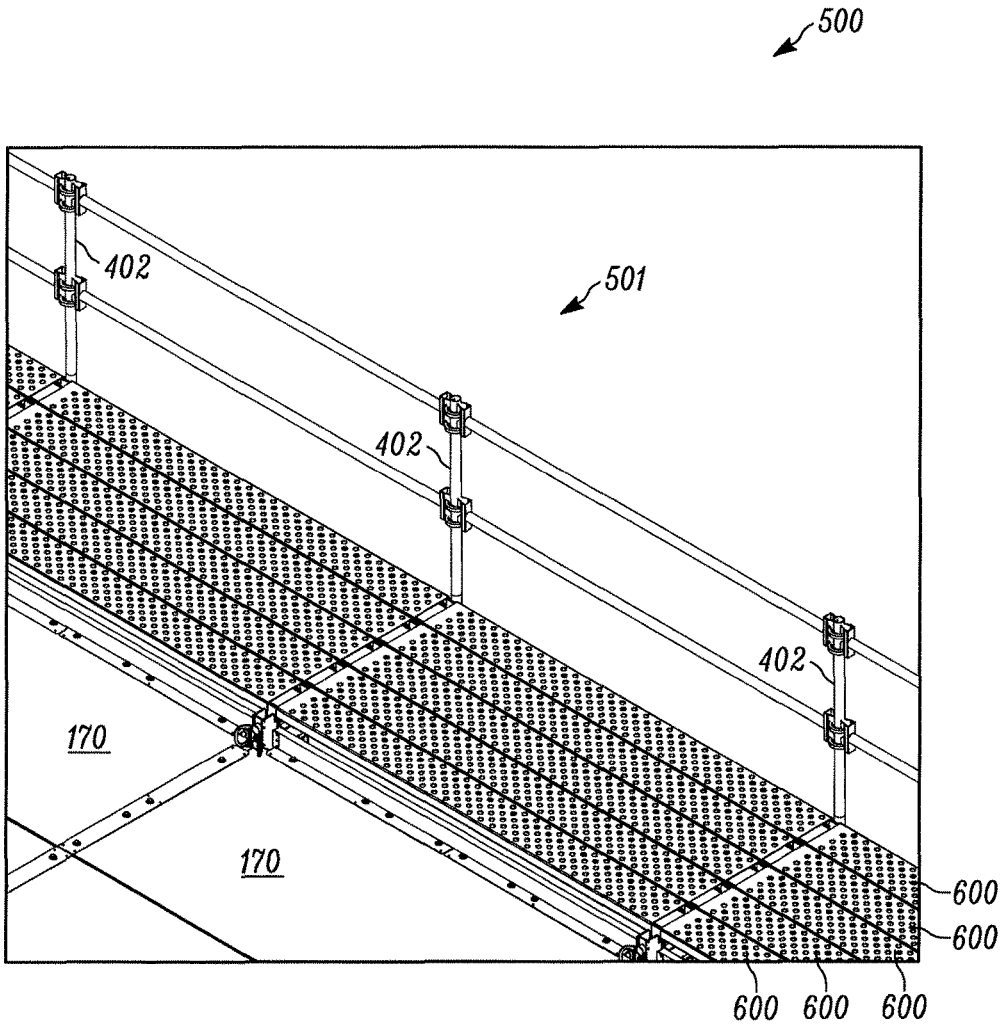

In the embodiment shown, the channel plates 32 also include toe board connections 95. As shown in FIGS. 8A-8B, the extended work platform 501 is raised compared to the work platform system 500. The toe boards 96 cover the gap which would otherwise exist between the work platform system 500 and the extended work platform 501. Toe boards 96 may therefore prevent or safeguard against workers from getting body parts, shoes and other items stuck under the extended work platform 501 and/or falling through the gap.

While in the embodiment shown, the base structure 31 (and specifically the top and bottom elements 31*a*, 31*b* and mid-portion 37), channel plates 32 and toe board connectors 95 are distinct plates secured to one another (e.g., welded), in other embodiments, two or more of these structures may be integrally formed with each other.

Figure 3A:
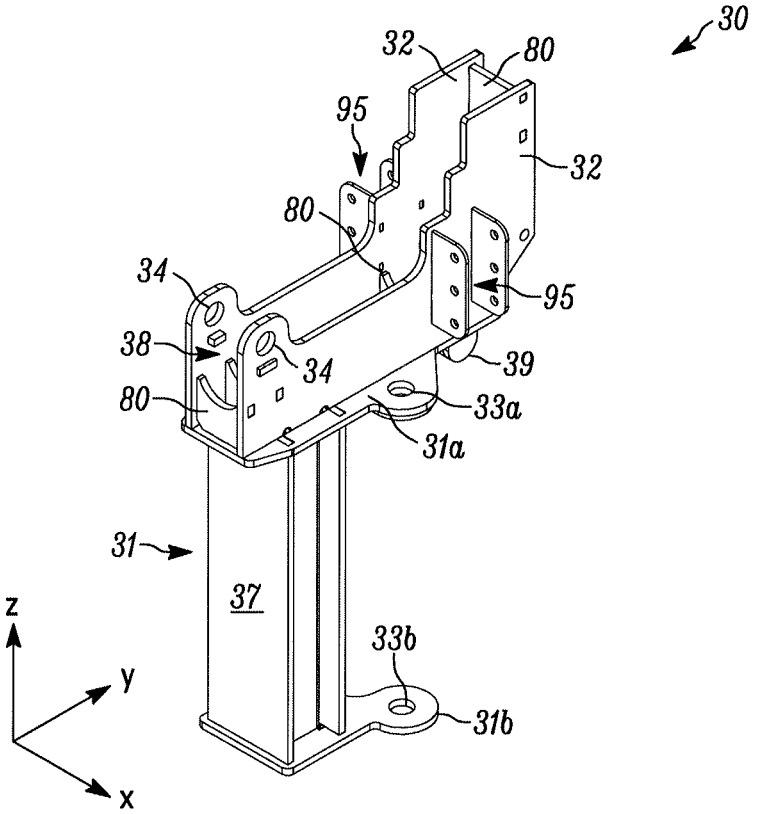
FIG. 3A shows a first embodiment of a hub connection portion for an adjustable platform extension bracket.
Figure 3B:
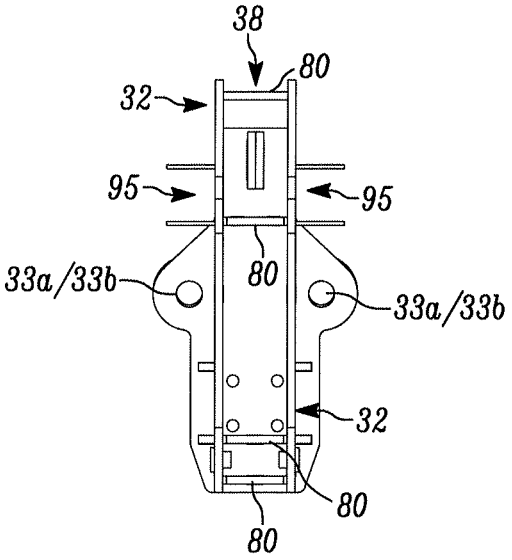
FIG. 3B is a top view of a first embodiment of a hub connection portion for an adjustable platform extension bracket.
Figure 3C:
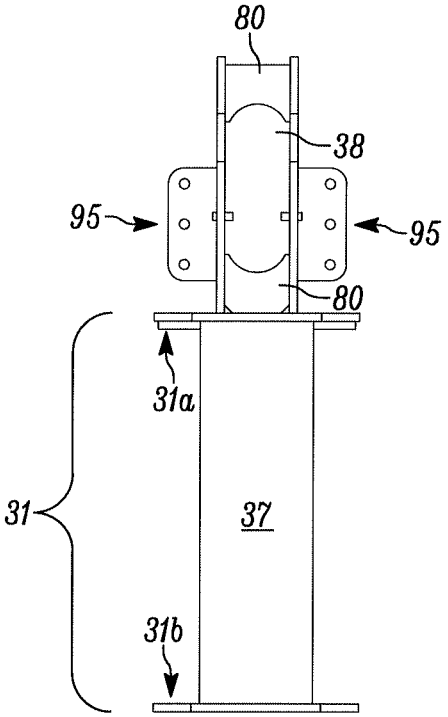
FIG. 3C is a front end view of a first embodiment of a hub connection portion for an adjustable platform extension bracket.
Figure 3D:
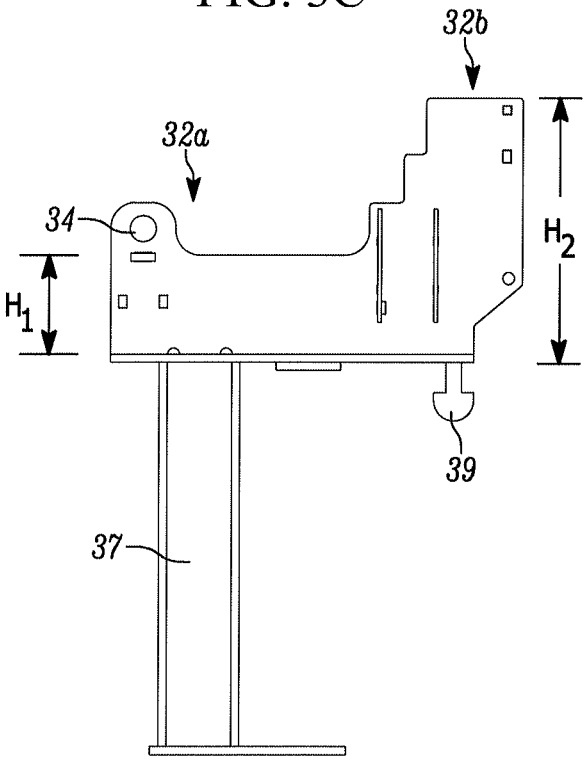
FIG. 3D is a side view of a first embodiment of a hub connection portion for an adjustable platform extension bracket.

In an embodiment, the hub connection portion 30 is symmetrical along the y axis, as oriented in the exemplary embodiment shown in FIGS. 3A and 3C.

Figure 1A:
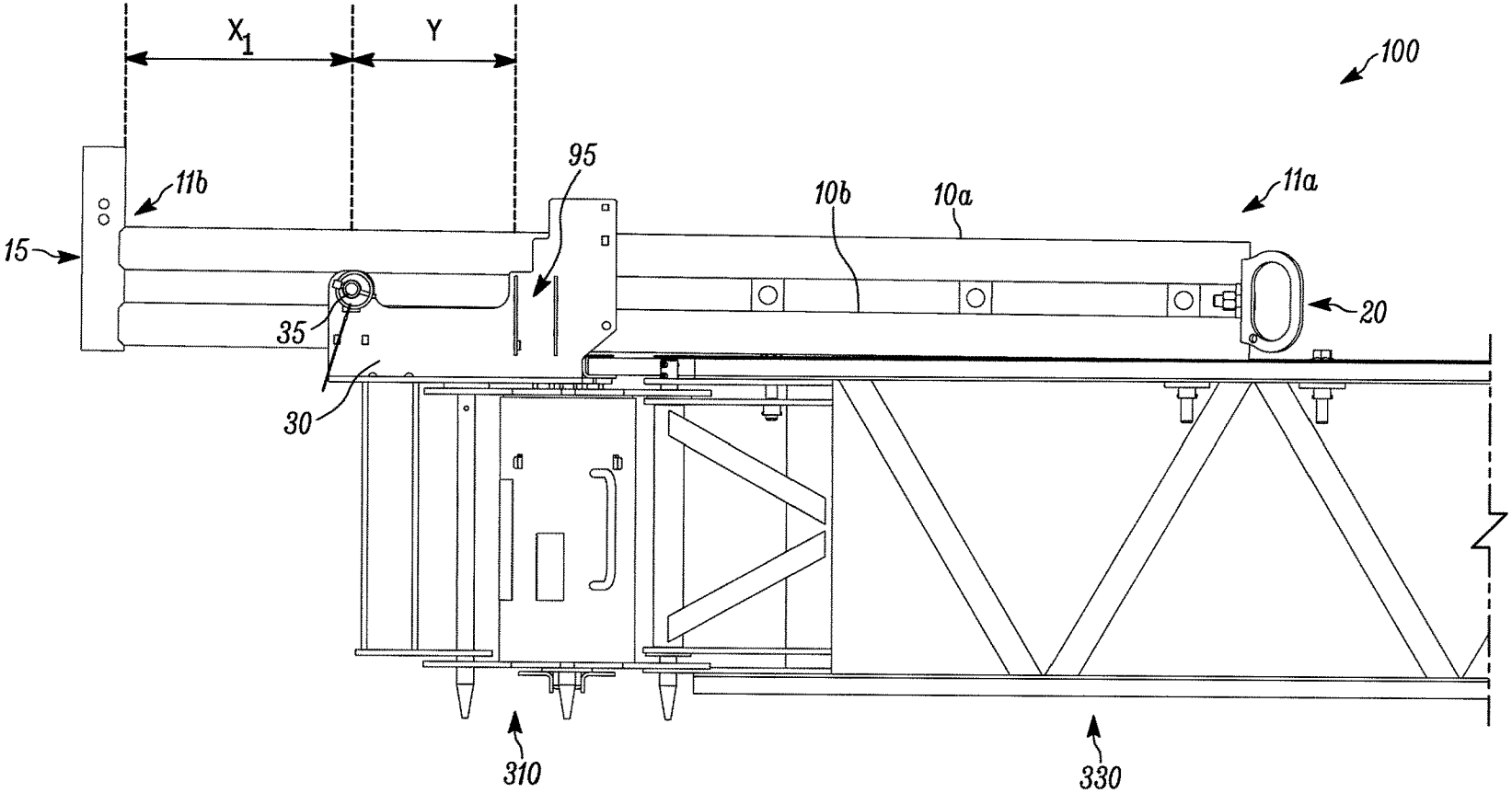
FIG. 1A is a side view of a first embodiment of an adjustable platform extension bracket in a retracted position.

FIG. 1A shows the bracket 100 in a first (retracted) position with the second end 11*b* of the base post member 10 as close to the hub connection portion 30 as permitted by the first connection 12. The pin 35 engages a first connection 12 with opening 13. In the embodiment shown, the first connection 12 with opening 13 is the first connection 12 as counted from the second end portion 11*b* of the base post member 10. As described briefly earlier, however, in embodiments in which the plates 32 include two apertures, two pins 35 may be provided to engage a pair of connections with apertures, such as, for example, the first pair of connections 12 with apertures 13 as counted from the second end 11*b* of the base post member 10. In the embodiment shown, the distance between guardrail post connector 15 and the first connection 12 with aperture 13 as counted from the second end 11*b* of the base post member 10 (identified as X1) corresponds to the width of a single flooring plank or panel. Similarly, the distance from the first connection 12 with aperture 13 to the start of the toe board connection 95 (identified as Y) corresponds to the width of a standard plank or flooring panel. As such, in the embodiment shown, when in a first (retracted) position, the bracket 100 secures two planks and/or flooring sections. In an embodiment, the flooring plank or panel is a standard plank or panel as used in the industry; however, in an embodiment, any structure used to form a unit of flooring and which may be secured to the bracket 100 may be used.

Figure 1B:
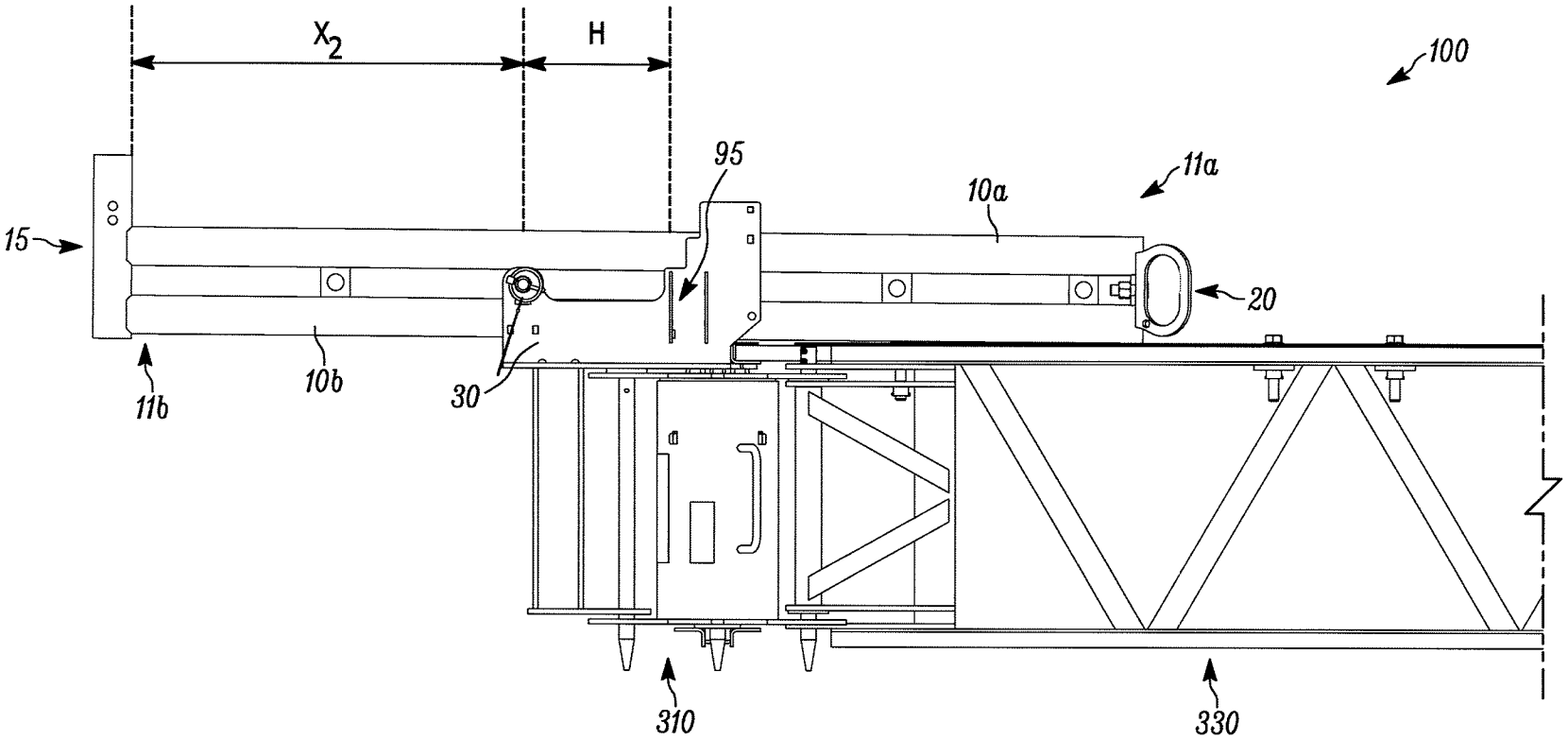
FIGS. 1B and 1C are side views of a first embodiment of an adjustable platform extension bracket in a partially extended position.
Figure 1C:
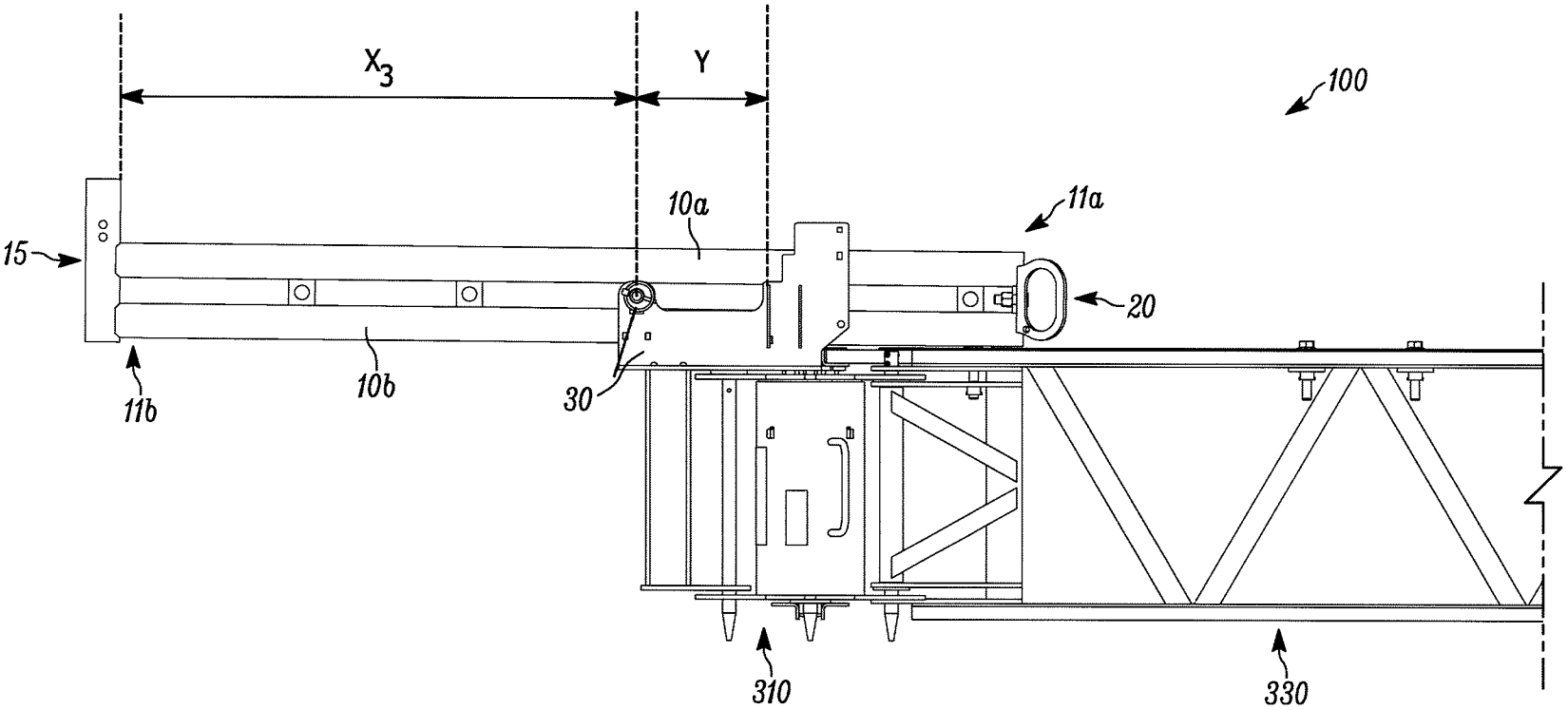

In the embodiment shown in FIGS. 1B and 1C, the bracket 100 is in second and third partially extended positions, respectively. As the base post member 10 extends, it slidingly moves through the channel 38 of the hub connection portion 30 such that the first end 11*a* of the base post portion 10 moves further toward and the second end 11*b* of the base post portion 10 moves away from (outward from) the hub connection portion 30.

In an embodiment, such as shown with respect to FIG. 1B, a second position corresponds to that of the base post member 10 when the pin 35 engages a second connection 12 with aperture 13. In the embodiment shown, the second connection 12 is the second connection 12 as counted from the second end portion 11*b* of the base post member 10. As described briefly earlier, however, in embodiments in which the plates 32 include two apertures, two pins 35 may be provided to engage a pair of connections with apertures, such as, for example, the second pair of connections 12 with apertures 13 as counted from the second end 11*b* of the base post member 10. The distance between the guardrail post connector 15 and the second connection 12 (identified as X2) corresponds to the width of two flooring planks or panels. Likewise, as shown in FIG. 1C, a third position corresponds to that of the basepost member 10 when the pin 35 engages a third connection 12 with aperture 13 (e.g., the third connection 12 as counted from the second end portion 11*b* of the base post member). As described briefly earlier, however, in embodiments in which the plates 32 include two apertures, two pins 35 may be provided to engage a pair of connections with apertures, such as, for example, the third pair of connections 12 with apertures 13 as counted from the second end 11*b* of the base post member 10. The distance between the guardrail post connector 15 and the third connection 12 (identified as X3) corresponds to the width of three flooring planks or panels.

Figure 1D:
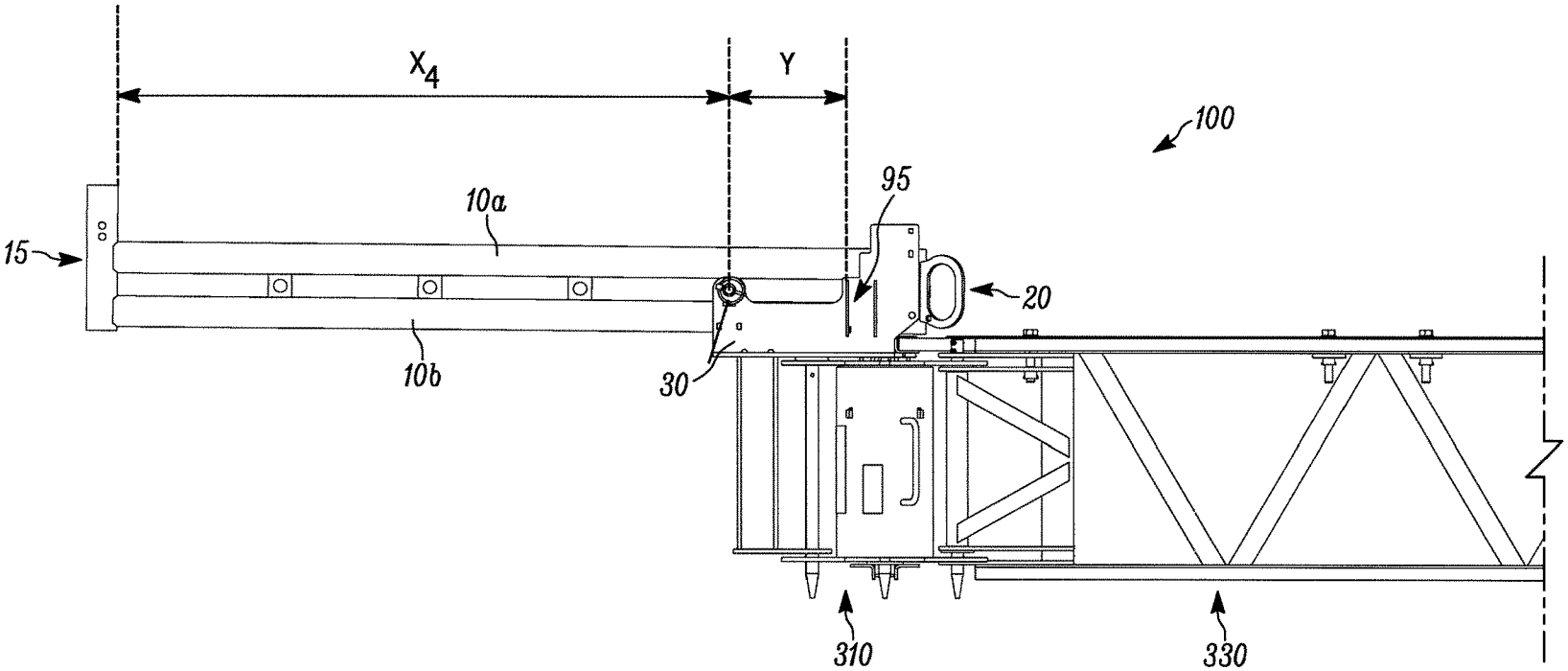
FIG. 1D is a side view of a first embodiment of an adjustable platform extension bracket in a fully extended position.
Figure 2A:
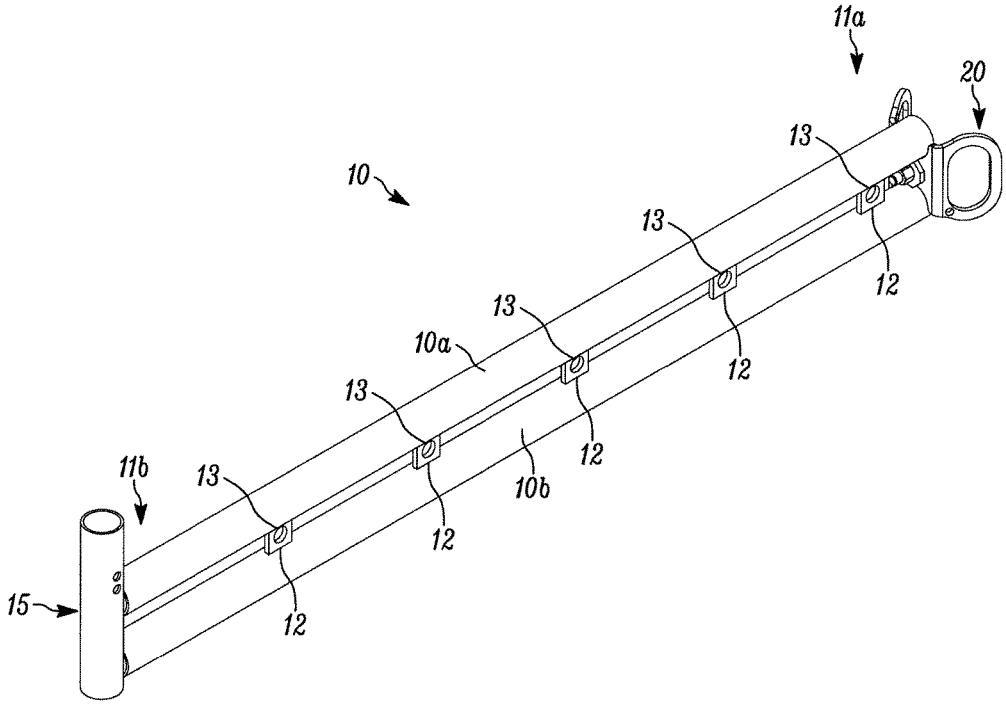
FIG. 2A shows a first embodiment of a base post member for an adjustable platform extension bracket.
Figure 2B:
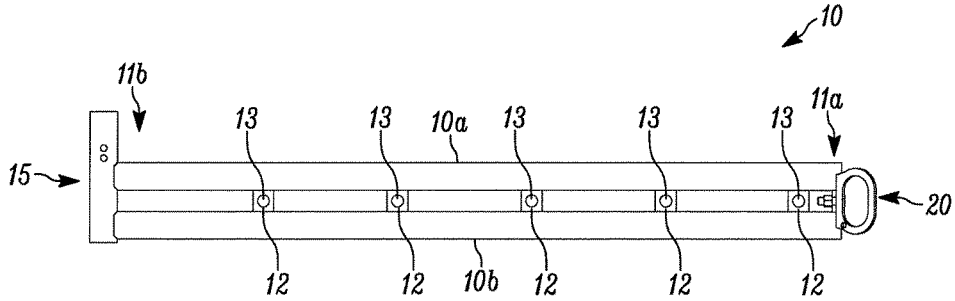
FIG. 2B is a side view of a first embodiment of a base post member for an adjustable platform extension bracket.
Figure 2C:
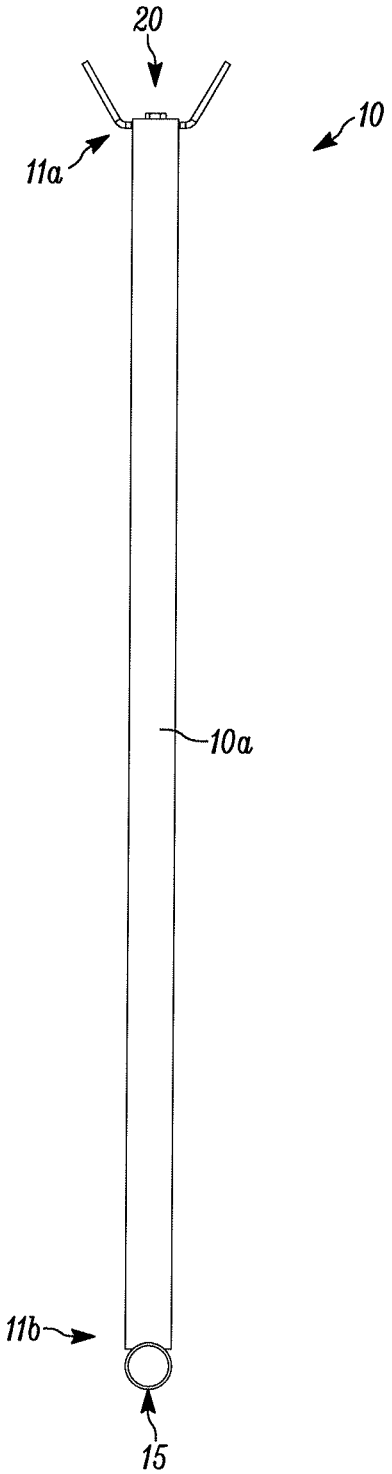
FIG. 2C is a top view of a first embodiment of a base post member for an adjustable platform extension bracket.
Figure 2D:
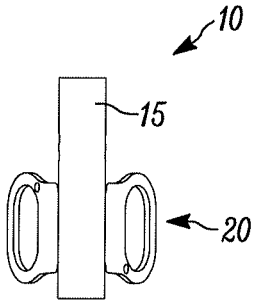
FIG. 2D is an end view of a first embodiment of a base post member for an adjustable platform extension bracket.

In the exemplary embodiment shown in FIG. 1D, the plate 20 is adjacent the node connection portion 30, such that the bracket 100 is in its fully extended position (e.g., the second end portion 11*b* of the base post member 10 is as far from the hub member connection portion 30 as possible As will be appreciated, in an embodiment such as shown with respect to FIG. 1D, a fourth or fully extended position corresponds to that of the base post member 10 when the pin 35 engages a fourth or final connection 12 with aperture 13 (e.g., the fourth connection 12 as counted from the second end portion 11*b* of the base post member 10). As described briefly earlier, however, in embodiments in which the plates 32 include two apertures, two pins 35 may be provided to engage a pair of connections with apertures, such as, for example, the fourth pair of connections 12 with apertures 13 as counted from the second end 11*b* of the base post member 10. The distance between the guardrail post connector 15 and the fourth connection 12 (identified as X4) corresponds to the width of four flooring planks or panels.

In the embodiments shown in FIGS. 1B-1D, the distance from the connection 12 engaged in the hub connection portion 30 to the start of the toe board connection 95 (identified as Y) remains the same. Therefore, in the embodiment shown in FIGS. 1B-1D, the bracket 100 is configured to secure three, four and five flooring planks and/or panels, respectively.

In other words, the connections 12 with apertures 13 determine the position of the base post member 10 relative to the end of any work platform system to which the bracket 100 may be attached and thereby act, in essence, as positional structures to guide and determine the position of the base post member 10.

As made clear by FIGS. 1A-1D, the position of the base post member 10 as shown in FIG. 1A corresponds to the position of a first connection 12 with aperture 13 in the hub connection portion 30 such that the pin 35 engages that first connection 12 with aperture 13, and it is understood that the positions of the base post member 10 shown in FIGS. 1B, 1C, and 1D therefore each also corresponds to the position of a subsequent connection 12 with aperture 13 as the pin 35 engages those connections 12 with apertures 13.

It is further understood that more or fewer connections 12 with aperture 13 may be provided on base post member 10 to allow for different numbers of flooring planks or panels to be secured to the bracket 100, to permit flooring planks or panels having identical alternate widths to be secured to the bracket 100, or to permit planks or panels of varying widths to be secured to the bracket.

In an alternative embodiment, the connections 12 with apertures 13 may be provided as a single elongated connection 12 with aperture 13 so as to provide continuous, or approximately continuous, adjustability of the base post member 10 within the bracket 100.

Figure 5A:
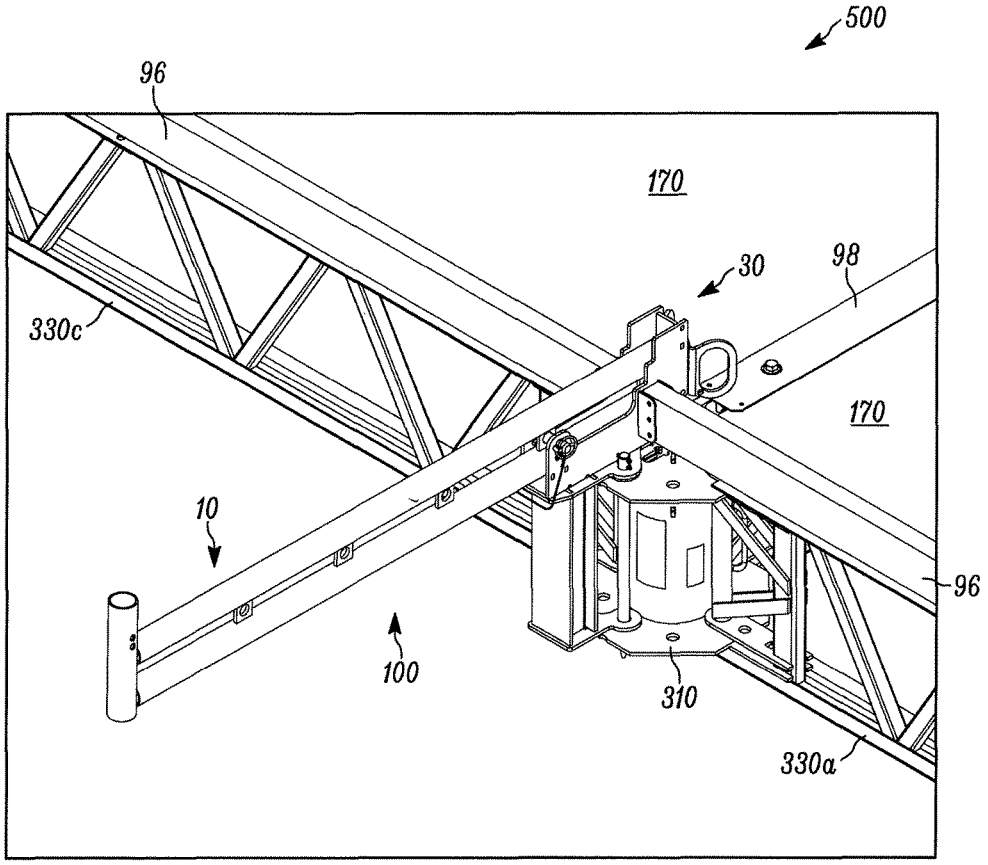
FIG. 5A shows a first embodiment of an adjustable platform extension bracket secured to a platform.
Figure 5B:
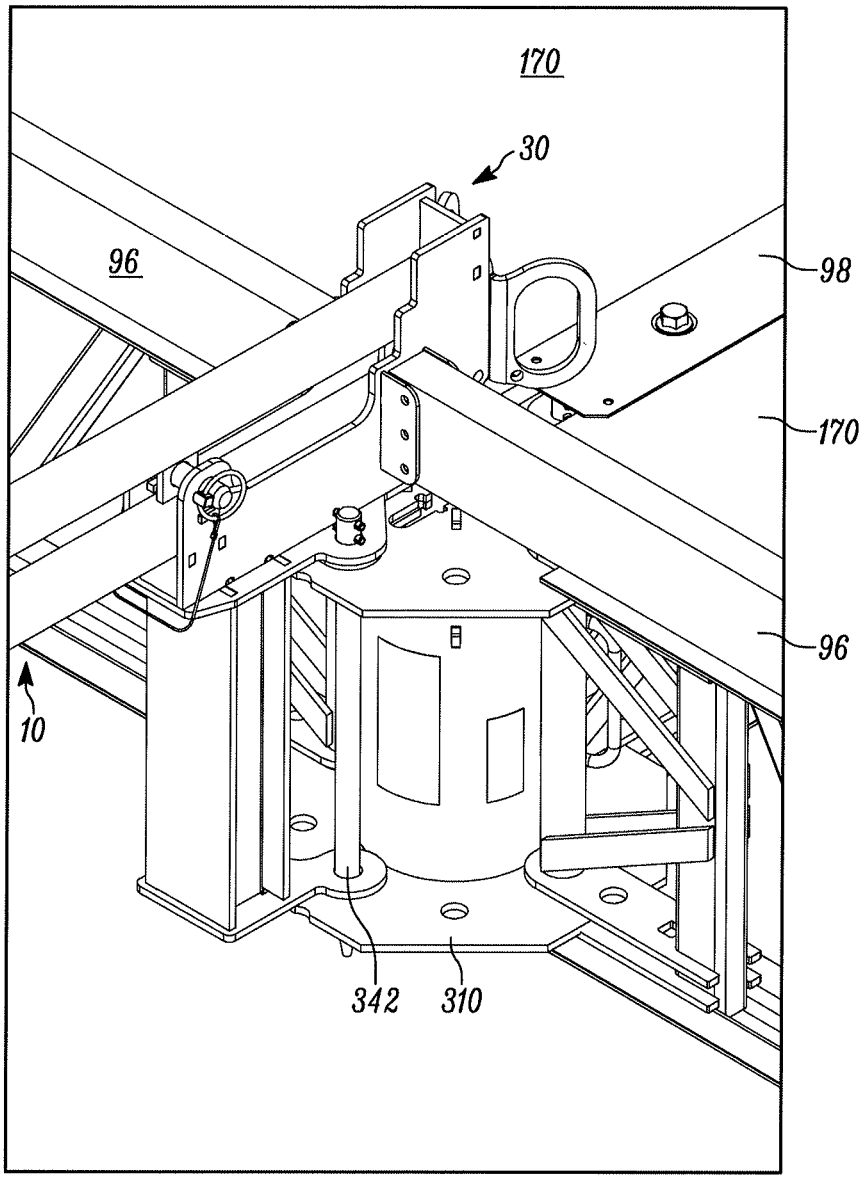
FIG. 5B shows the hub connection of a first embodiment of an adjustable platform extension bracket.
Figure 6:
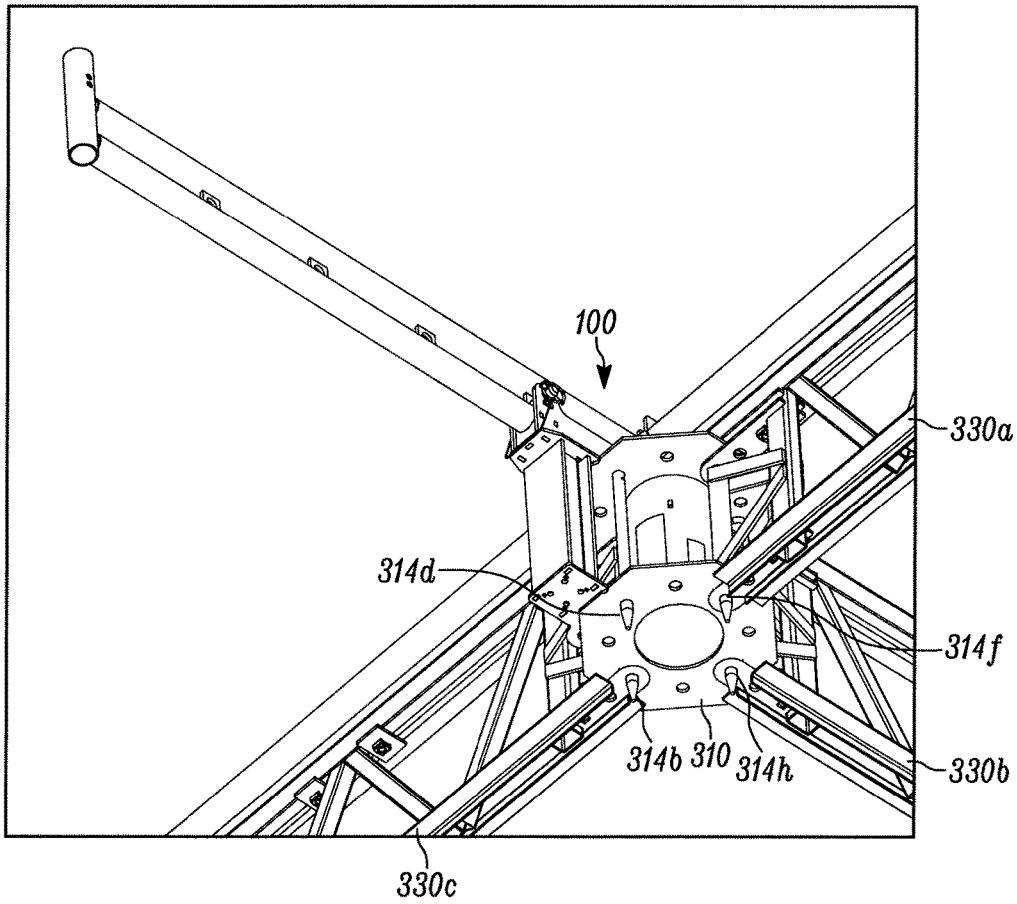
FIG. 6 is a bottom view of a first embodiment of an adjustable platform extension bracket secured to a portion of a work platform system.

FIGS. 5A through 5B shows the bracket 100 connected to a portion of a work platform system 500 including a hub 310 and an elongated member 330, with FIG. 7 showing the underside of the portion of a work platform system with the bracket 100 attached.

Specifically, FIG. 5A shows a portion of a work platform system including two flooring sections 170 secured on a frame composed of a hub 310 and three elongate structural members 330*a*, 330*b*, and 330*c*. A panel cover 98 is secured to the top of the elongate structural member 330*b* to cover the seam between the flooring sections 170. FIG. 5B shows the connection between a hub 310 and hub connection portion 30 in further detail.

The structure of the hubs 310 and elongate structural members 330 suitable for use with the brackets 100 of the present disclosure and the work platform systems 500 made using the hubs 310 and elongate structural members 330 which the brackets 100 of the present disclosure serve to extend are described with reference to FIGS. 18A-29.

Figure 18A:
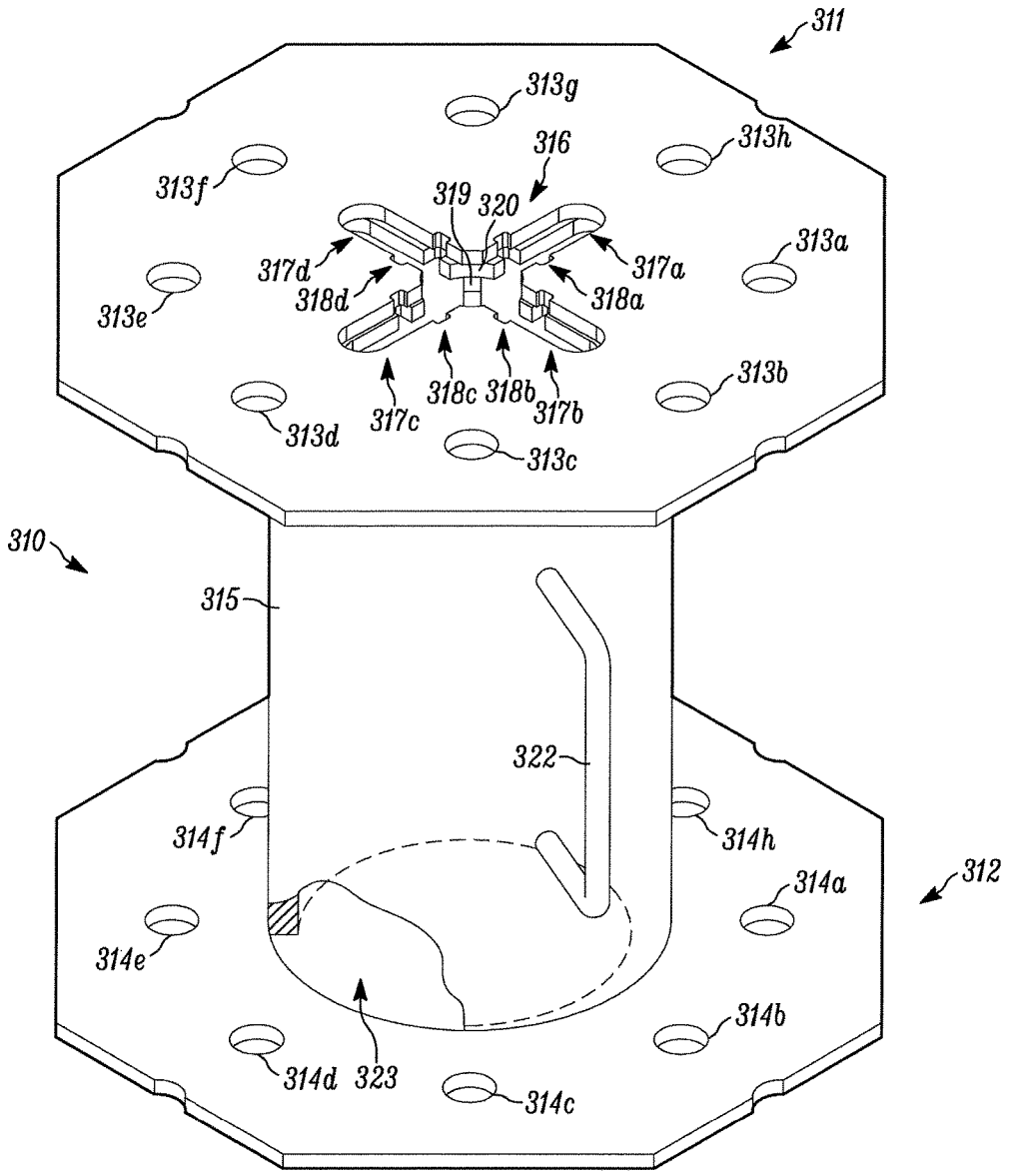
FIG. 18A is a top perspective view of an example hub employed in forming a work platform system to which an adjustable platform extension bracket is attached, as described with reference to FIGS. 1A-17C.

FIG. 18A is a top perspective view of an example hub 310 employed in forming a work platform system to which an adjustable platform extension bracket 100 is attached, as described with reference to FIGS. 1A-9B.

Referring now to the drawings, FIG. 18A illustrates a portion of the present invention, namely a hub, herein denoted by a hub 310. The hub 310 which connects with an elongate structural member 330 (see e.g., FIG. 20), makes up in integral portion of a work platform support system and work platform system 500 (not shown). An elongate structural member is any linear structure, such as a joist, adapted for bearing or supporting a load, such as a bar joist, truss, shaped-steel (i.e., I-beam, C-beam, etc.), or the like. The hub 310 is configured so that, when attached to an elongate structural member 330, allows for articulation of both the hub 310 and the elongate structural member 330. A hub 310 is an interconnection structure, such as a node, hinge, pivot, post, column, center, shaft, spindle, or the like. Articulation, as used herein, is defined as the capability to swing, and/or rotate, about a pivot point or axis. As will be discussed in more detail below, this articulation feature inter alia allows for less manpower to readily assemble and disassemble components of the system in, or near, the desired finished position.

Figure 9A:
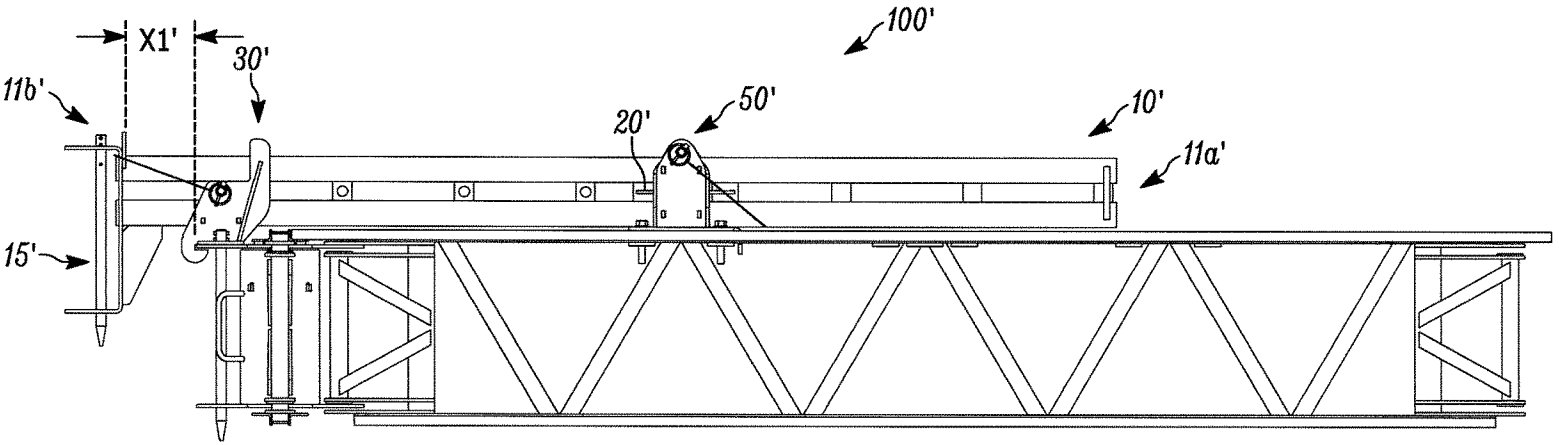
FIG. 9A is a side view of a second embodiment of an adjustable platform extension bracket in a retracted position.

The hub 310 includes a top element 311 and a bottom element 312 spaced at distal ends of a middle section 315. The top element 311 and bottom element 312 may be substantially planar in configuration, as well as, being parallel to each other. The top element 311 and bottom element 312, in the embodiment shown, are octagonal in plan. The middle section 315 may be a cylindrical section wherein a longitudinal axis of the middle section 315 is normal to the planes of the top element 311 and bottom element 312. In the embodiment shown, the middle section 315 is a right circular cylinder. In FIG. 9A, a lower portion of the middle section 315 is removed for clarity purposes to show that the middle section 315 is hollow.

There are a plurality of openings 313, 314, extending through both the top element 311 and bottom element 312, respectively. The plurality of openings 313 (e.g., 313A, 313B, 313C, 313D, 313E, 313F, 313G, 313H) are interspersed on the top element 311 so as to offer various locations for connecting to one, or more, elongate structural member 330 (see e.g., FIG. 20). The plurality of openings 314 (e.g., 314A, 314B, 314C, 314D, 314E, 314F, 314G, 314H) are similarly spaced on the bottom element 312 so that respective openings (e.g., 313A and 314A) are coaxial.

At the center of the top element 311 is a center opening 316 which is configured to receive a suspension connector. The center opening 316 may be generally cruciform in configuration due to its center opening area 319 with four slots 317 (e.g., 317A, 317B, 317C, 317D) extending therefrom. Transverse to each of the four slots 317A, 317B, 317C, 317D, and interconnected thereto, are a series of cross slots 318A, 318B, 318C, 318D, whose utility will be apparent as discussed below. For added strength a second reinforcing plate 320 is added to the underside of the top element 311 wherein openings on the reinforcing plate 320 correspond to the center opening 316 configuration and all the ancillary openings thereto (317, 318, 319). A handle 322 is optionally added to the side of the middle section 315.

Figure 18D:
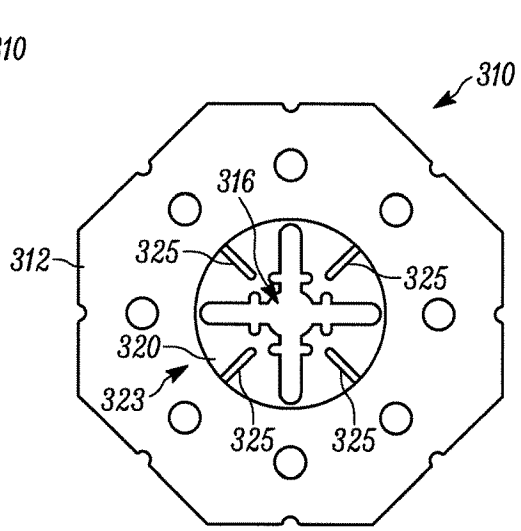
FIG. 18D is a bottom view of a hub.
Figure 18C:
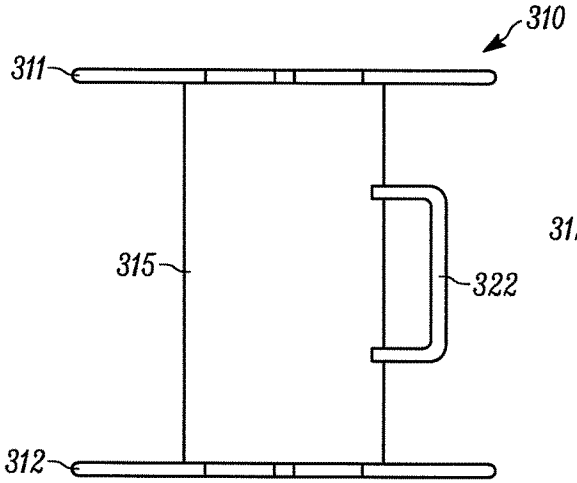
FIG. 18C is a side view of a hub.
Figure 18B:
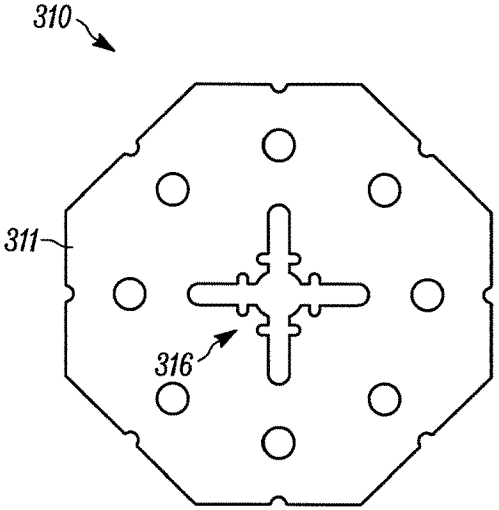
FIG. 18B is a top view of a hub.

FIGS. 18B, 18C and 18D show the top, side, and bottom view of the same embodiment of the hub 310 depicted in FIG. 18A. FIG. 18D shows inter alia a bottom opening 323 on the bottom element 312. The bottom face of the reinforcing plate 320 can be seen within the bottom opening 323. Attached to the reinforcing plate 320 and the interior face of the middle section 315 are a plurality of gussets 325 that provide added support to the hub 310.

Figure 19:
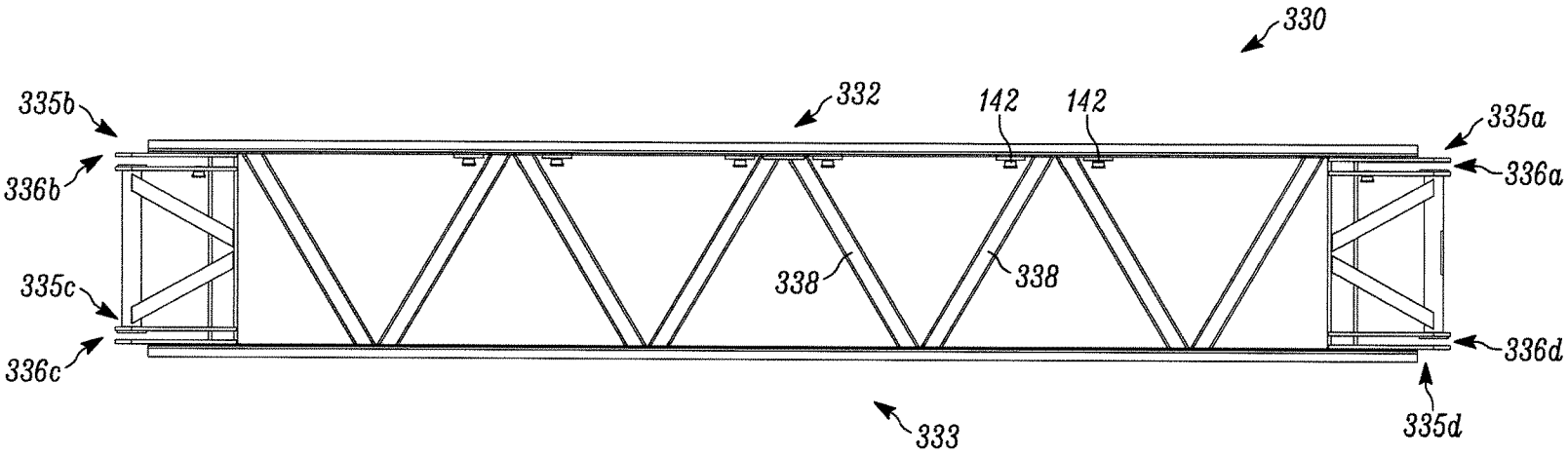
FIG. 19 is a side view of an example elongated member employed in forming a work platform system to which an adjustable platform extension bracket is attached, as described with reference to FIGS. 1A-17C.
Figure 20:
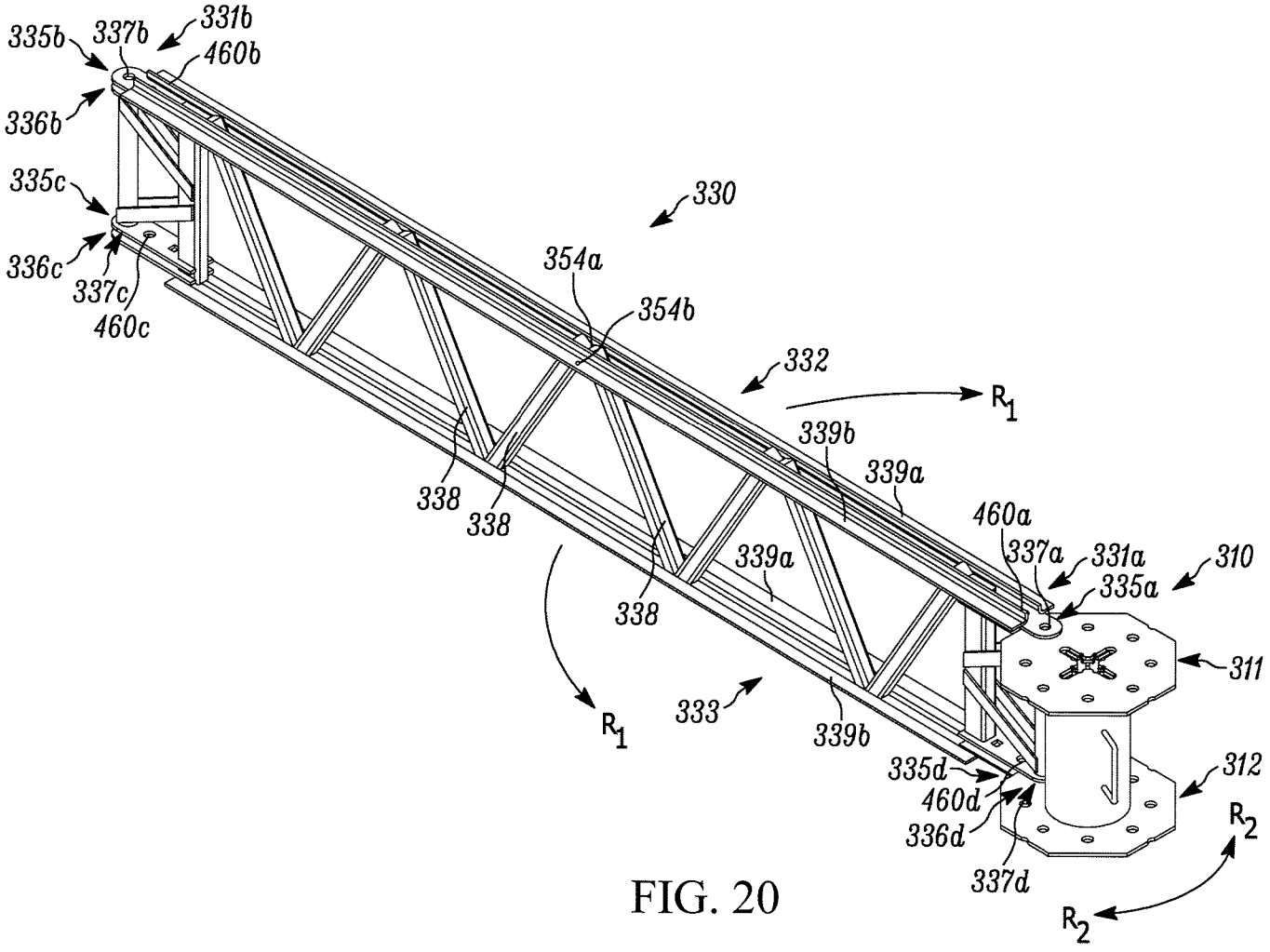
FIG. 20 is a top perspective view of a hub and elongated member in accordance with FIGS. 18A-19.

As illustrated in FIGS. 19 and 20, in accordance with an embodiment, an elongated structural member 330 employed in forming a work platform system 500 to which an adjustable platform extension bracket is attached, as described with reference to FIGS. 1A-8C, includes an upper element 332 and a bottom element 333 with a plurality of cage nuts 142 aligned along the upper element 332.

The elongate structural member 330 includes an upper element 332 and a bottom element 333. Interspersed between elements 332, 333 are a plurality of diagonal support members 338. Each element 332, 333 is made of two L-shaped pieces of angle iron 339*a*, 339*b*. Elements 332, 333 typically may be identical in construction, with the exception being upper element 332 includes connector holes 354*a*, 354*b* at its midspan. The elongate structural member 330 includes a first end 331*a* and a second end 331*b*. At either end 331*a*, 331*b* of both the upper element 332 and bottom element 333 extends an upper connecting flange 335 and a lower connecting flange 336. Through both upper and lower connection flanges 335, 336 are connecting holes 337. Thus, there are four upper connecting flanges 335*a*, 335*b*, 335*c*, 335*d*; four lower connecting flanges 336*a*, 336*b*, 336*c*, 336*d*. Thus, at a first end 331*a*, extending from the upper element 332, is an upper connection flange 335*a* and lower connection flange 336*a*, with a connecting hole 337*a* therethrough. Similarly, at the second end 331*a* of the upper element 332, extends an upper connection flange 335*b* and lower connection flange 336*b*, with a connecting hole 337*b* therethrough. Continuing, at the first end 331*a* of the lower element 333 extends an upper connection flange 335*d* and lower connection flange 336*d*. Through these connection flanges 335*d*, 336*d* are a connecting hole 337*d*. At the second end 331*b* of the elongate structural member 330 extending from the lower element 333 is an upper connection flange 335*c* and lower connection flange 336*c* with a connecting hole 337*c* therethrough.

Interior to each of the connector holes 337*a*, 337*b*, 337*c*, 337*d* are additional locking holes 460*a*, 460*b*, 460*c*, 460*d* also located on the connection flanges 335*a*, 335*b*, 335*c*, 335*d*.

Figure 21B:
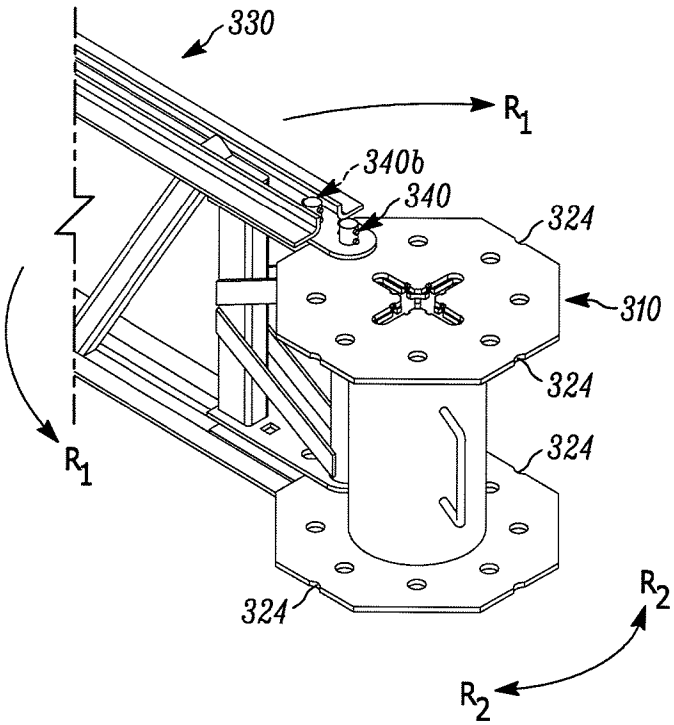
FIG. 21B is a top perspective view of the view of FIG. 21A.
Figure 21A:
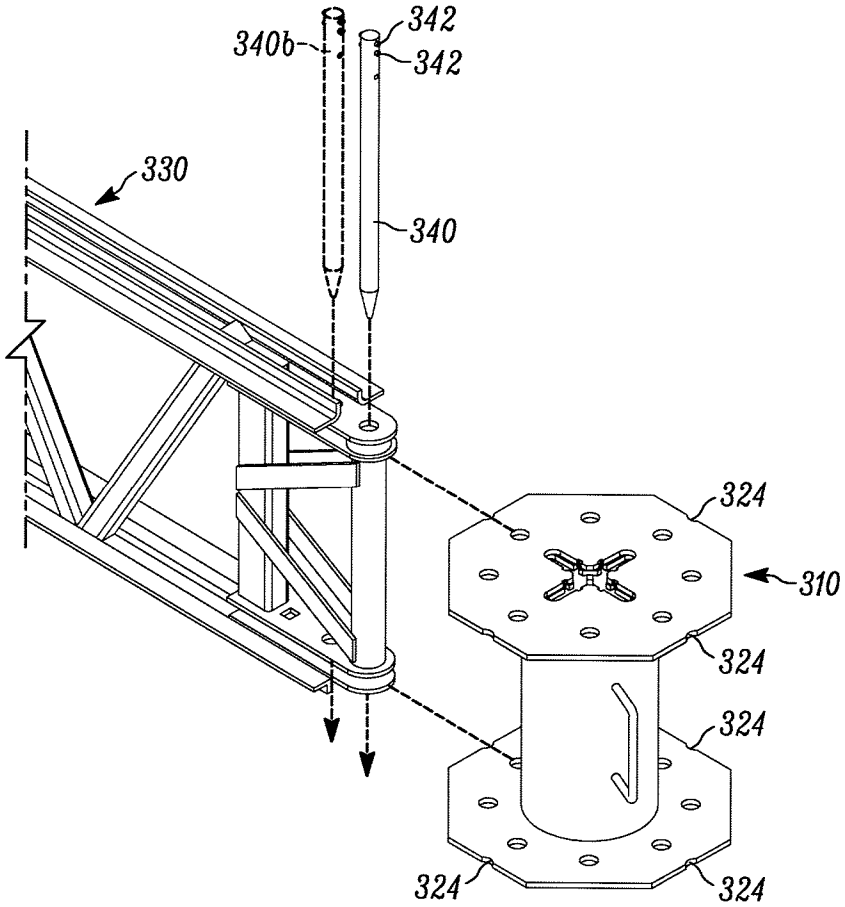
FIG. 21A is an exploded top perspective view of an interconnection between a hub and an elongated member in accordance with FIGS. 18A-19.

As FIGS. 21A and 21B depict in further clarity, a pin 340 may be placed through the connecting holes 337 any two corresponding top and bottom openings 313, 314 of the hub 310. In this manner, the elongate structural member 330 can be connected in a virtually limitless number of ways, and angles, to the hub 310. For example, a pin 340 may be placed in through an upper connection flange 335*a*; through an opening 313*a*; through a lower connection flange 336*a* (all of the first end 331*a* of the upper element 332); through an upper connection flange 335*d*; through an opening 314*a*; and, then through the lower connection flange 336*d*. In this scenario, the pin 340 further threads through connecting holes 337*a* and 337*d*. The pin 340 includes two roll pins 342 at its upper end. The lower of the two roll pins 342 acts as a stop, thereby preventing the pin 340 from slipping all the way through the elongate structural member 330 and hub 310. The upper roll pin 342 acts as a finger hold to allow easy purchase and removal of the pin 340 from the elongate structural member 330 and hub 310. The design of these various parts are such that free rotation of both the elongate structural member 330 and hub 310 is allowed, even while the elongate structural member 330 and hub 310 are connected together. Rotational arrow $R_1$ show the rotation of the elongate structural member 330, while rotational arrow $R_2$ shows the rotation of the hub 310. These rotational capabilities of the elongate structural member 330 and hub 310 provide, in part, the articulating capability of the present invention.

A second optional locking pin 340*b* may be added through the locking holes 460*a*, 460*b*, 460*c*, 460*d* at the end of elongate structural member 330 in order to lock the elongate structural member 330 to prevent articulation, if so desired. The locking pin 340*b* abuts a groove 324 on the hub 310. The grooves 324 are situated on both the upper element 311 and lower element 312. Similarly, the locking pin 340*b* can include additional two roll pins 342 as does the pin 340.

It should be apparent to one skilled in the art, that while the elongate structural member 330 depicted in the figures is made of particular shaped elements, there are other embodiments that provide the aspects of the present invention. For example, the elongate structural member 330 in the figures may commonly be called a bar joist, or open-web beam or joist, the elongate structural member 330 could also be made of structural tubing. That is the elongate structural member 330 could be made of multiple pieces of structural tubing shapes; or, the elongate structural member 330 could be one single structural tubing shape. Similarly, the elongate structural member 330 could be made of shaped steel (e.g., wide flange elements, narrow flange members, etc.), or other suitable shapes and materials.

Figure 22:
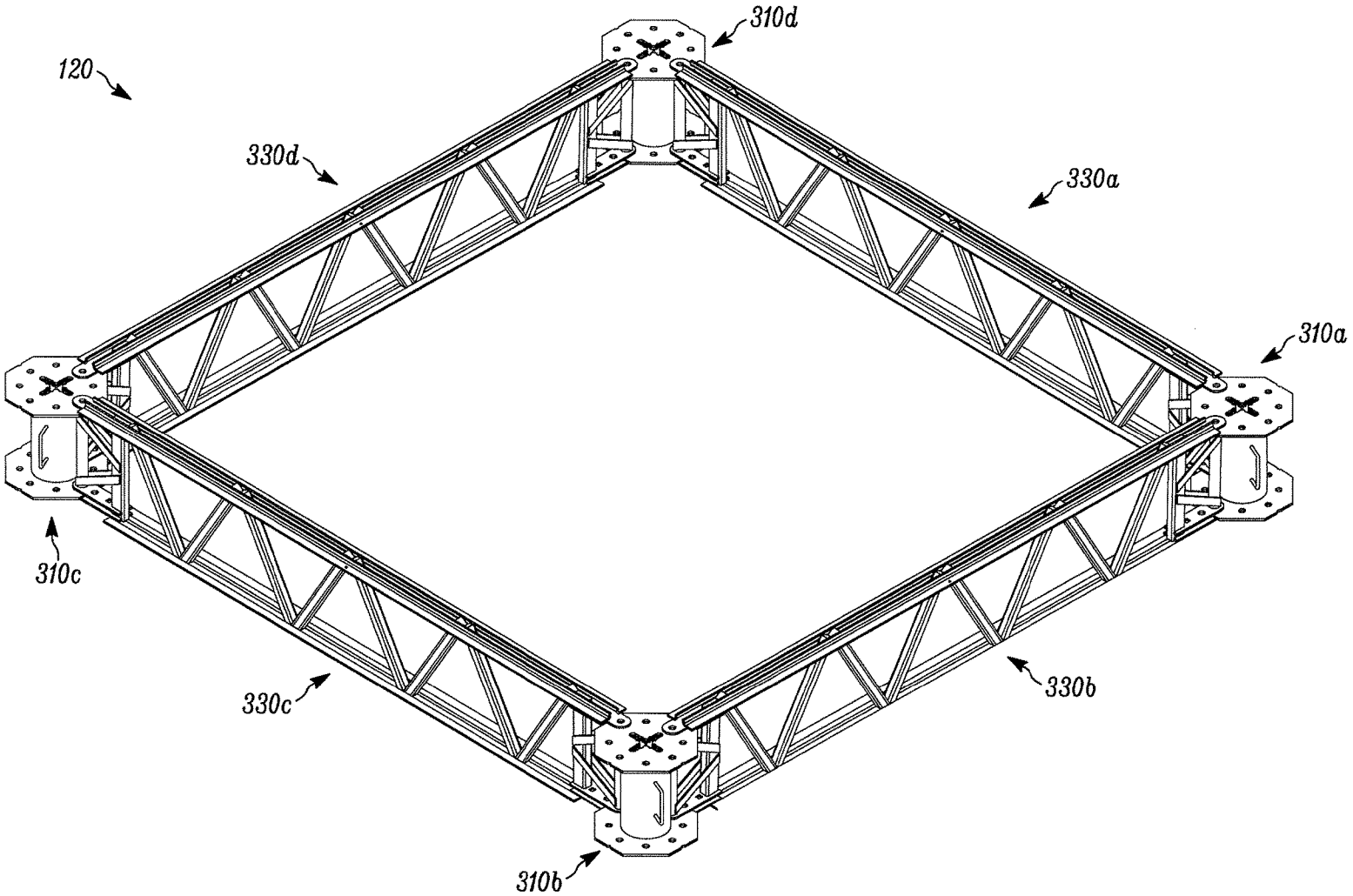
FIG. 22 is a top perspective view of a work platform support system which forms a portion of a work platform system to which an adjustable platform extension bracket is attached.

FIG. 22 depicts a section, or "module 120", of a work platform support system 500 as constructed. Note that four hubs 310*a*, 310*b*, 310*c*, 310*d* are interconnected with four joists 330*a*, 330*b*, 330*c*, 330*d*. FIG. 22 shows a work platform support system 500 that is square in plan. It should be apparent to one skilled in the art, that other shapes and configurations can be made. By varying the lengths of elongate structural member 330, for example, other shapes can be made. For example, a work platform support system 500 that is rectangular can be constructed. Also, by attaching elongate structural members 330 to various openings 313, 314 of the hub 310, various angles at which the joists 330 interconnect with the hubs 310 can be achieved. For example, a work platform support system 500 that is triangular in plan (not shown) may be constructed. Thus, by changing elongate structural member 330 lengths and/or changing the angle(s) at which the elongate structural member 330 extend from the hubs 310, virtually any shape and size work platform support system 500 may be constructed. Further, different shape, size, and configuration of work platform support system 500 can be joined and abutted with each other, so that the work platform design is virtually completely customizable. This adaptability of the work platform support system 500 provides a convenient way to gain access to virtually any shape work area required in construction.

As will be appreciated by those skilled in the art, elongate structural member 330 can be of any length and positioned at any angle which may be accommodated by hub 310. When multiple hubs 310 and elongate structural member 330 are joined, such as in the case of a single unit 120 or a base structure 500, elongate structural member 330 may be pivotal on hubs 310 to create any configuration of units 120 and therefore base structure 500. Because of this articulation, the framework of units 120 may also be assembled in a collapsed form while a base structure 500 is in place and then expanded outward from the base structure 500. Once in a desired configuration, the unit 120 is secured to prevent further articulation.

Figure 23:
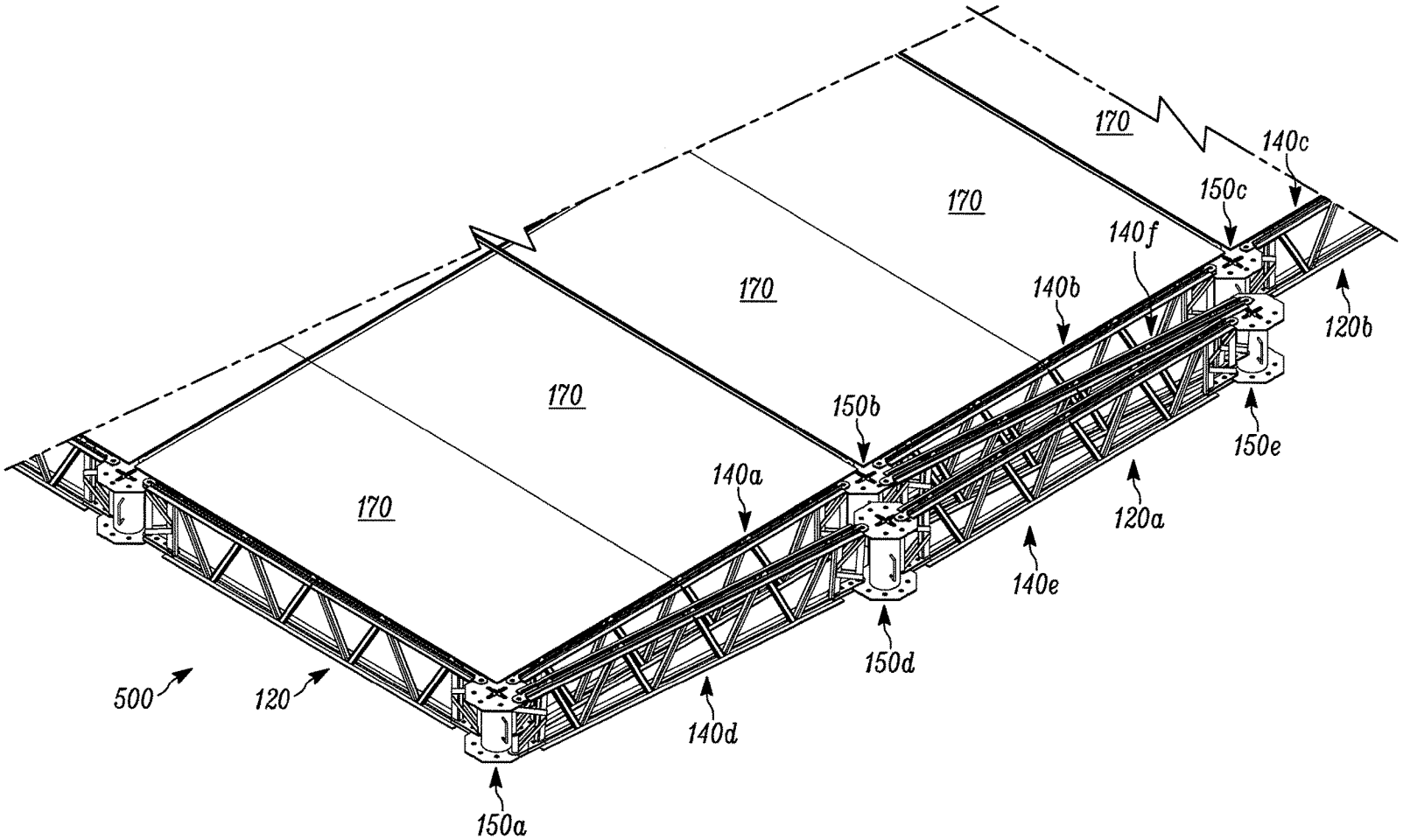
FIG. 23 is a top perspective view of a work platform support system prior to articulation.
Figure 24:
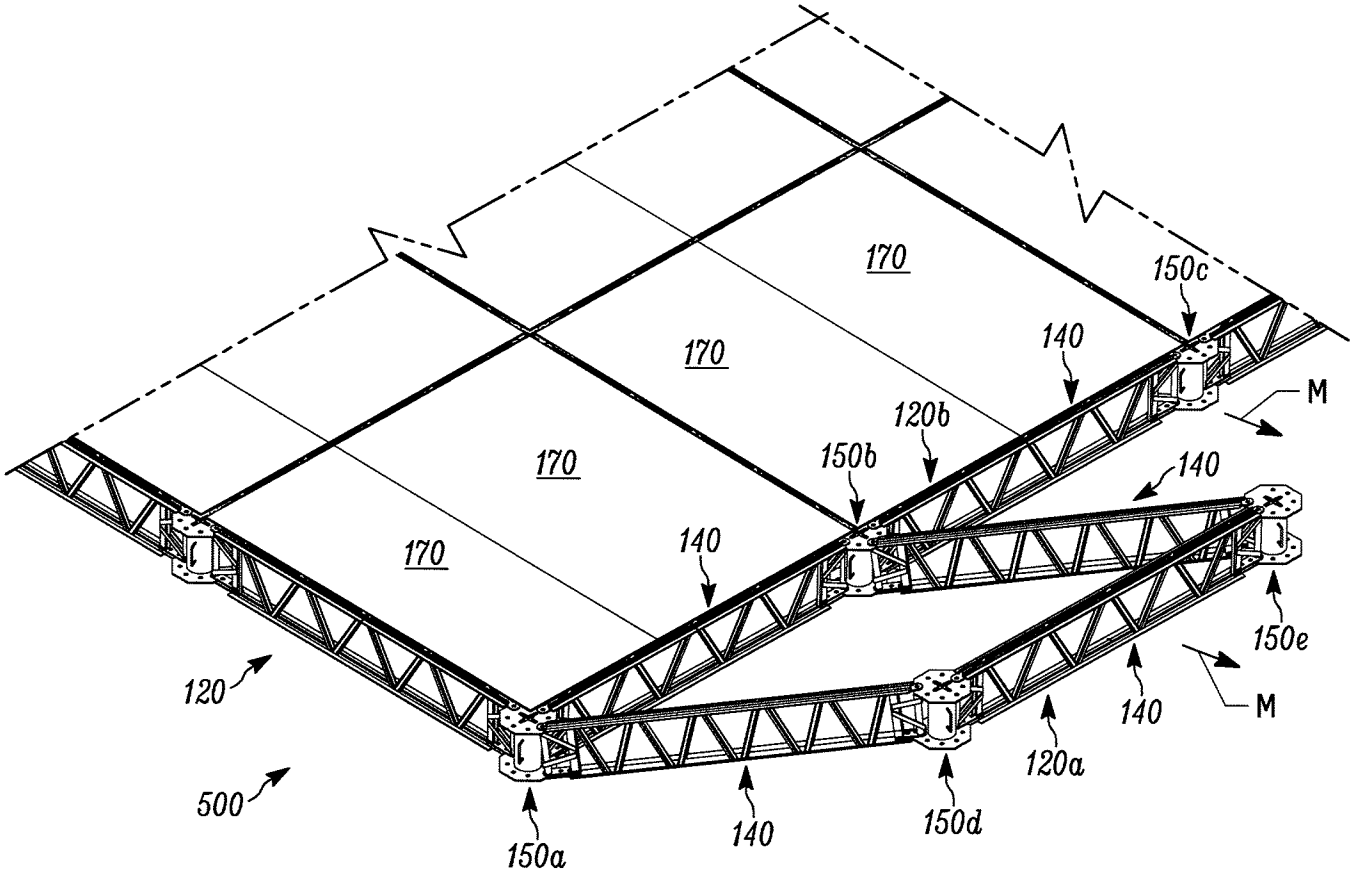
FIG. 24 is a top perspective view of the work platform support system of FIG. 23 undergoing articulation.
Figure 25:
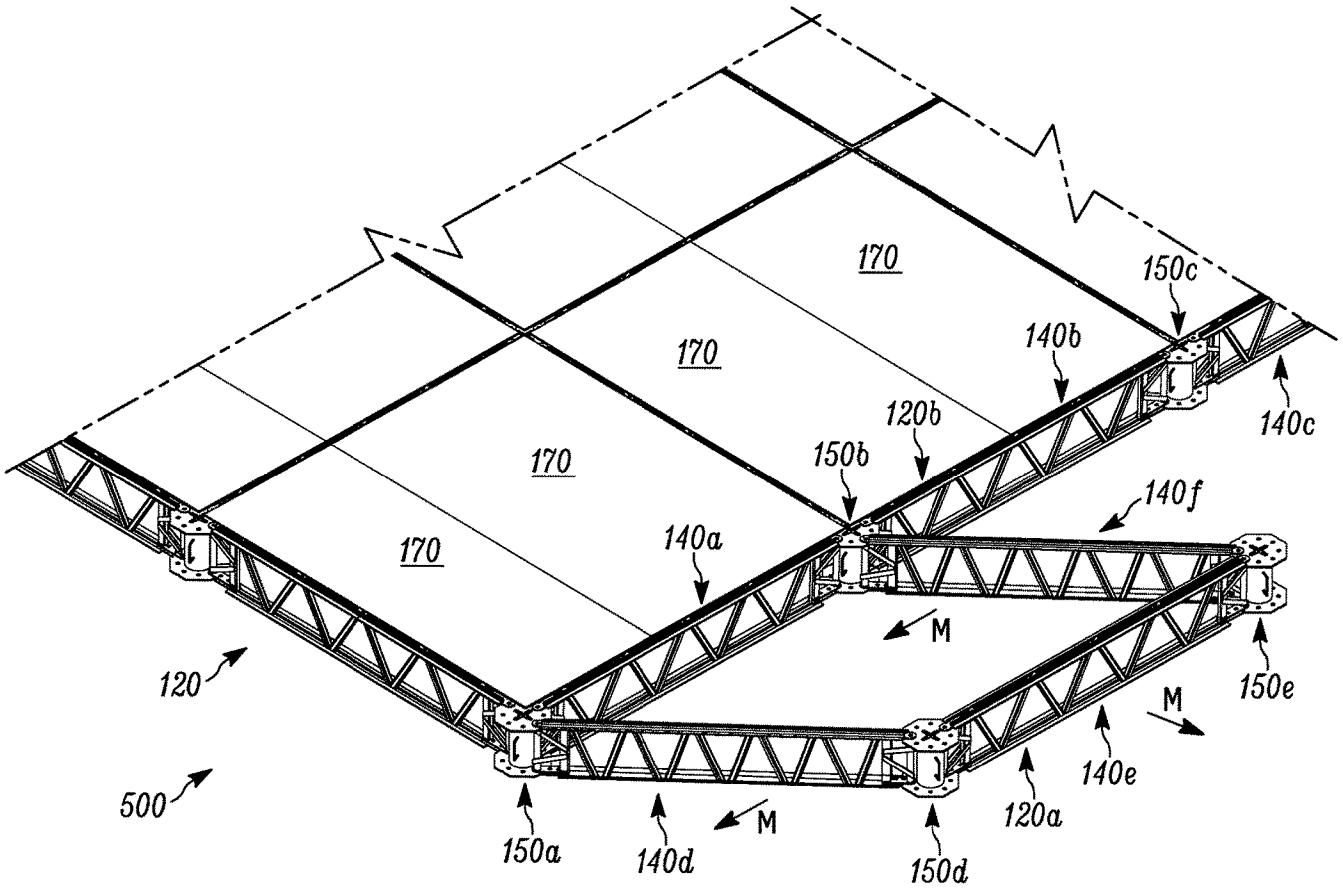
FIG. 25 is a top perspective view of the work platform support system of FIG. 24 undergoing further articulation.
Figure 26:
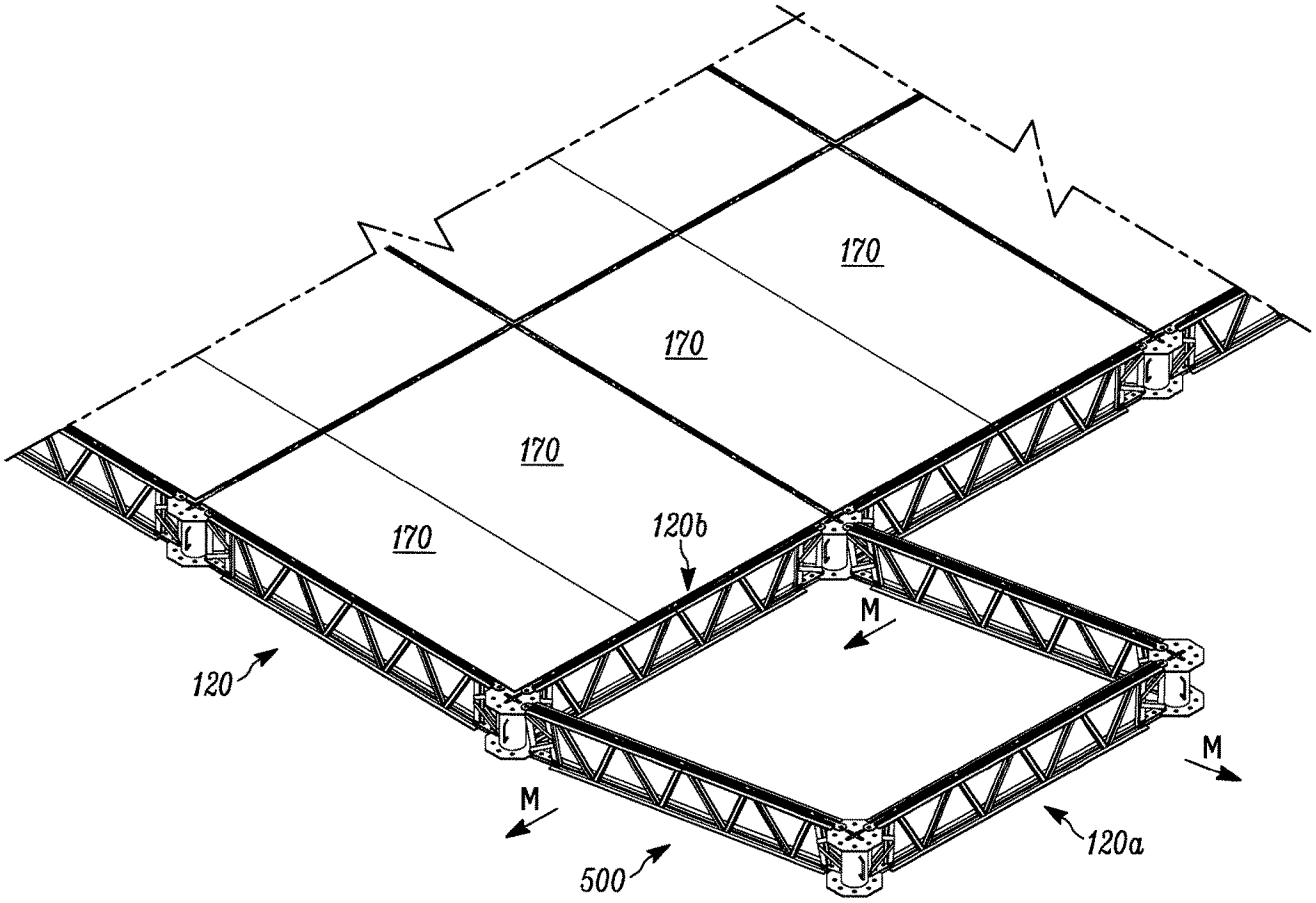
FIG. 26 is a top perspective view of the work platform support system of FIG. 25 undergoing further articulation.
Figure 27:
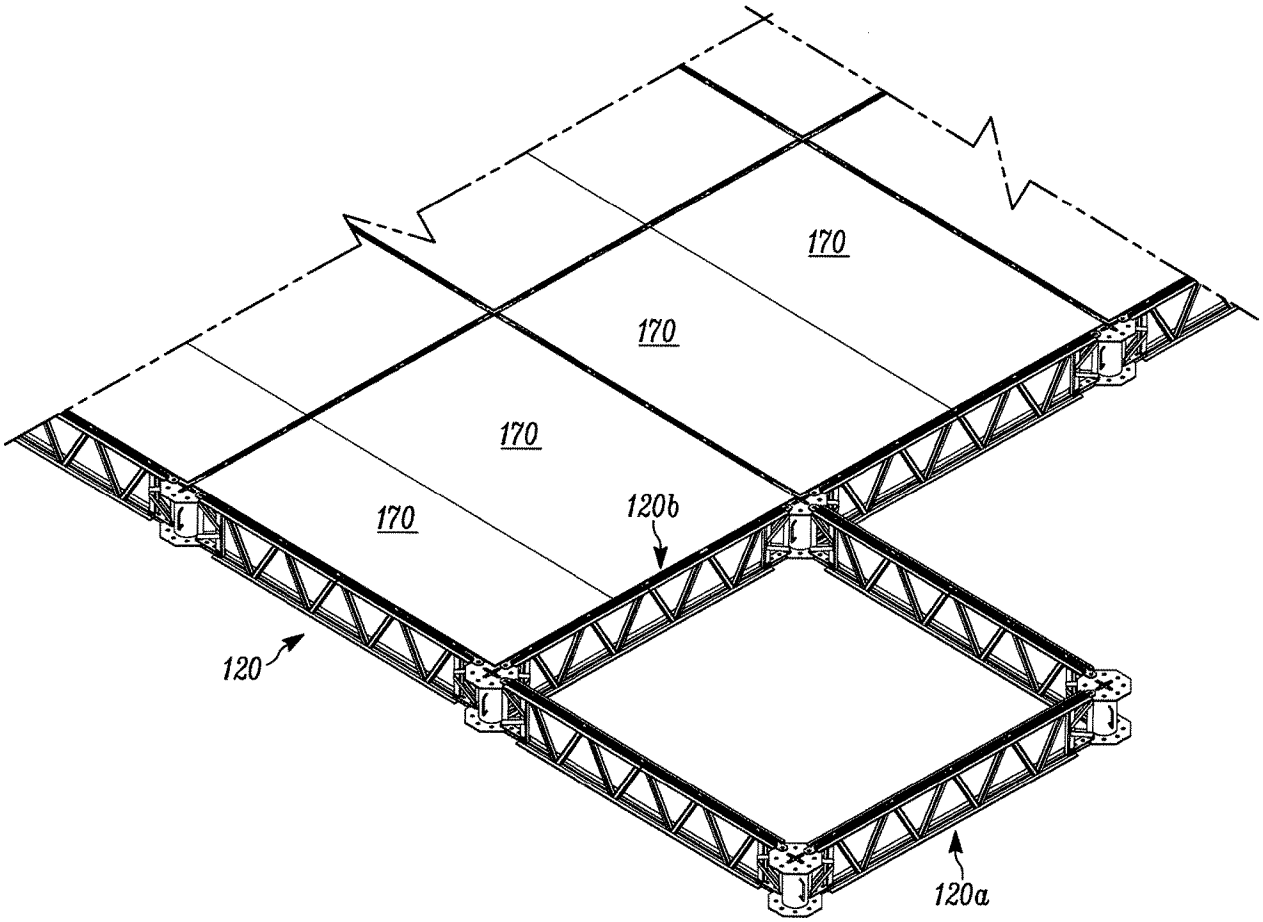
FIG. 27 is a top perspective view of the work platform support system of FIG. 23 having completed articulation.

This "in-the-air" assembly of further units 120 is illustrated in FIG. 23. FIG. 23 shows an exemplary framework for a unit 120*a* assembled and joined to an existing base structure 500 at unit 120*b*. The new unit 120*a* is in its initial position, prior to articulation. As FIGS. 24-26 clearly show through the motion arrows "M," by a combination or rotation of elongate structural member 330*d*, 330*e* and 330*f*, and hubs 310*d* and 310*e*, the framework for unit 120*a* is able to move and rotate into its final requisite position (FIG. 27). That is, the unit 120*a* articulates into place.

Once in position, unit 120*a* may be locked into its final position using locking pins as described above. In further exemplary embodiments, further articulation of unit 120*a* may be prevented by securing a platform 170 (not shown) in the framework.

In alternative embodiments, elongate structural member 330 and hub 310 may be secured to each other using other structures and methods known in the art and may not allow articulation of the elongate structural member 330 and hub 310 relative to each other. For example, in some embodiments, elongate structural member 330 and hub 310 may be securely joined and locked into place such that articulation is prevented.

Figure 28A:
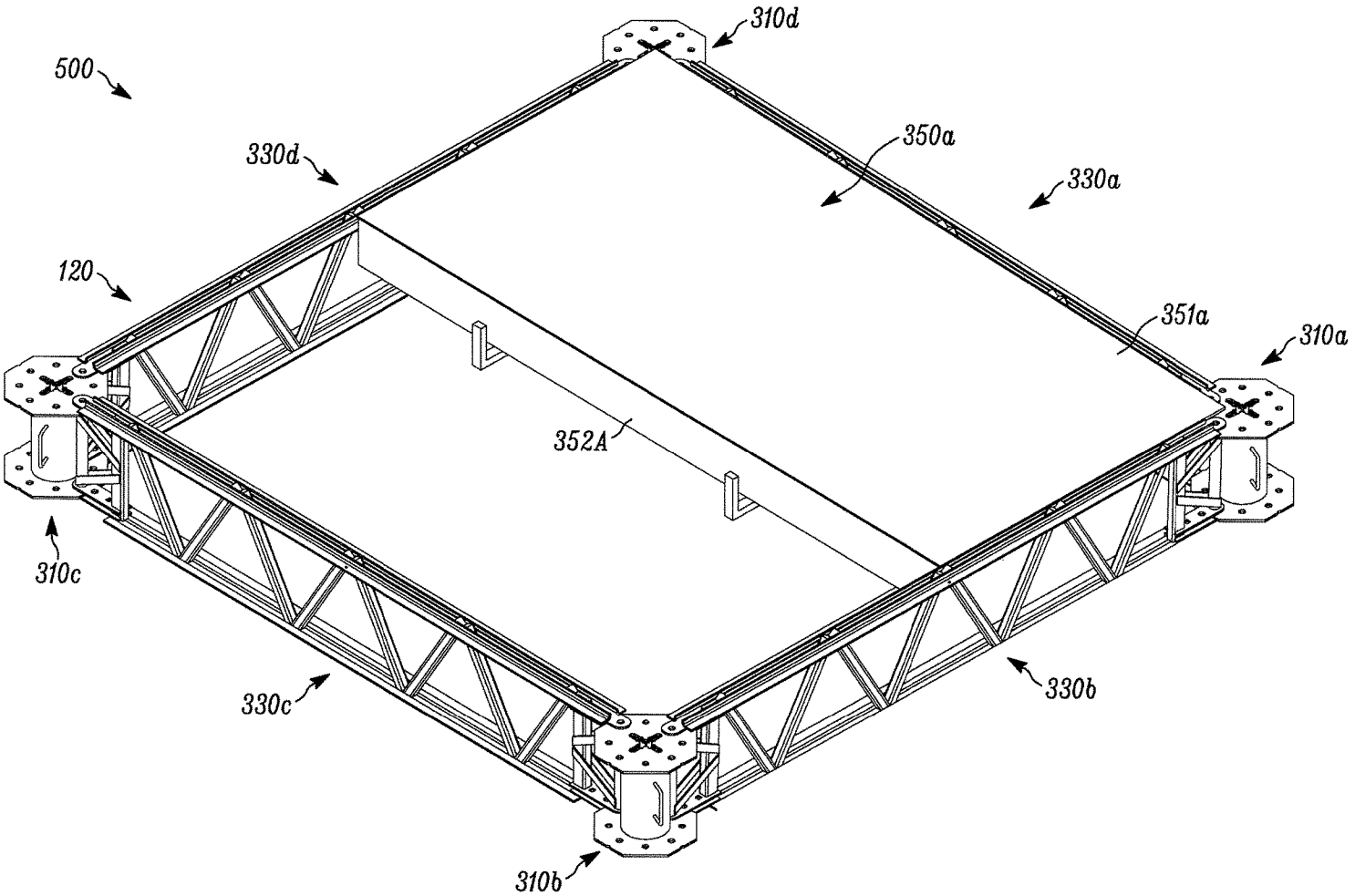
FIGS. 28A and 28B are top perspective views of a unit of a work platform system to which an adjustable platform extension bracket is attached.
Figure 28B:
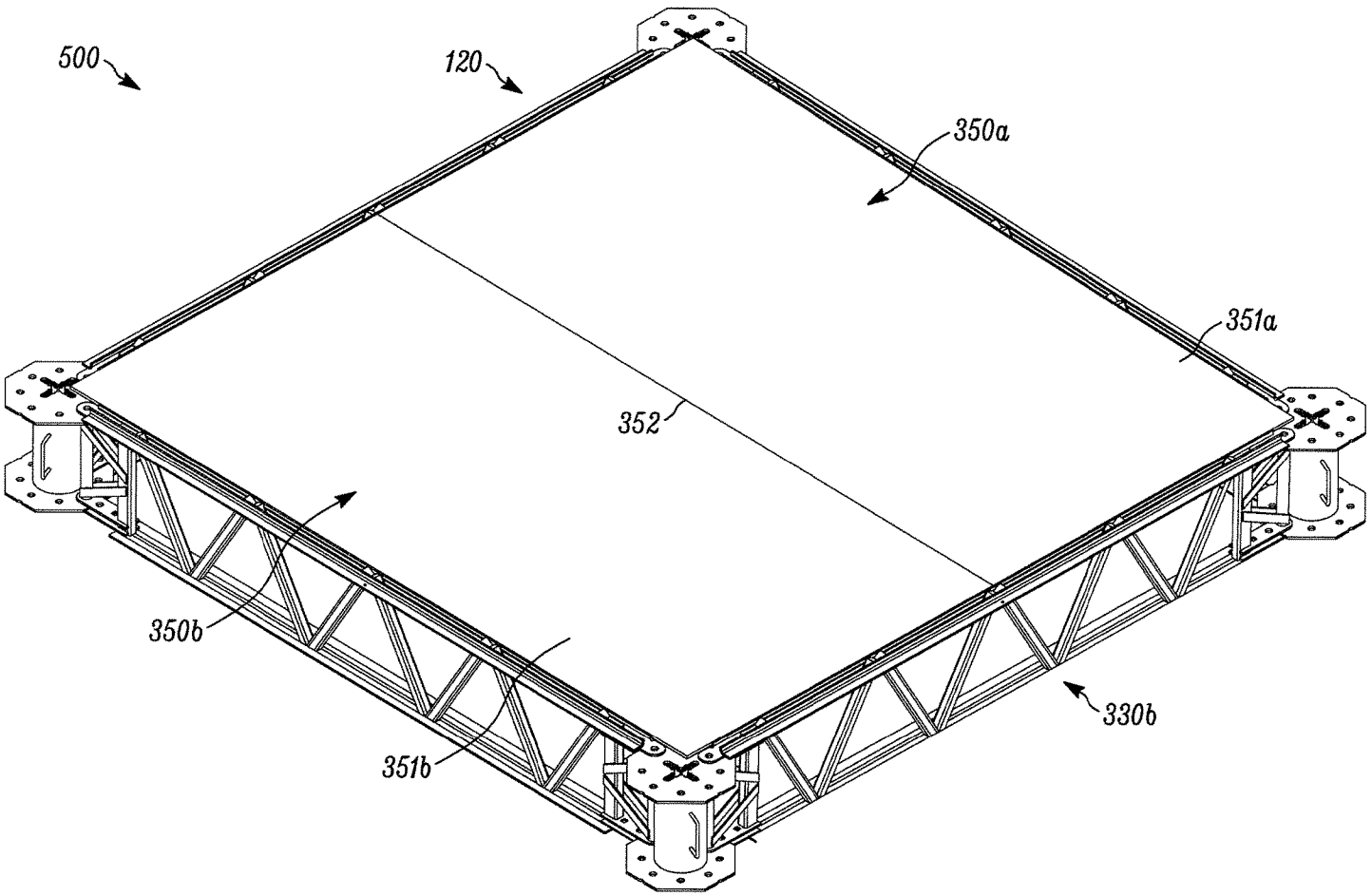

FIG. 28A shows the embodiment of a unit 120 for a support system from FIG. 22 wherein a platform 350*a* has been placed on the unit 120 thus transforming the unit 120 into a work platform system 500. The platform 350*a* rests, in this embodiment, on the middle support deck joist 352*a* and on the joists 330*a*, 330*b*, 330*d*. The edges of the platform 350*a* may rest on the top of the middle support deck joist 352 and the angle iron 339*a*, 339*b* on the top of the applicable joists 330*a*, 330*b*, 330*d*. The configuration of the top of the middle support deck joist 352 and the angle iron 339*a*, 339*b* is such that vertical and horizontal movement of the platform 350*a* is avoided. The work platform 500 typically is sized to be a 4 foot×8 foot piece of material. The work platform 350*a* may include a wood panel 351*a*, for example. Suitable work platform 350 may be made from metal (e.g., steel, aluminum, etc.), wood, plastic, composite, or other suitable materials. Similarly, the work platform 350 may be made of items that are solid, corrugated, grated, smooth, or other suitable configurations. For example, the work platform 350 may be wood sheeting, plywood, roof decking material, metal on a frame, grating, steel sheeting, and the like. Thus, after placing a first work platform 350*a* on the work platform support system 500, an installer may continue in this manner and place additional multiple work platforms 350*a*, 350*b*, such as shown in FIG. 20B, so that the entire support system 500 covered with wood platforms 351*a*, 351*b* so that a complete work platform system 500 is created.

Figure 29:
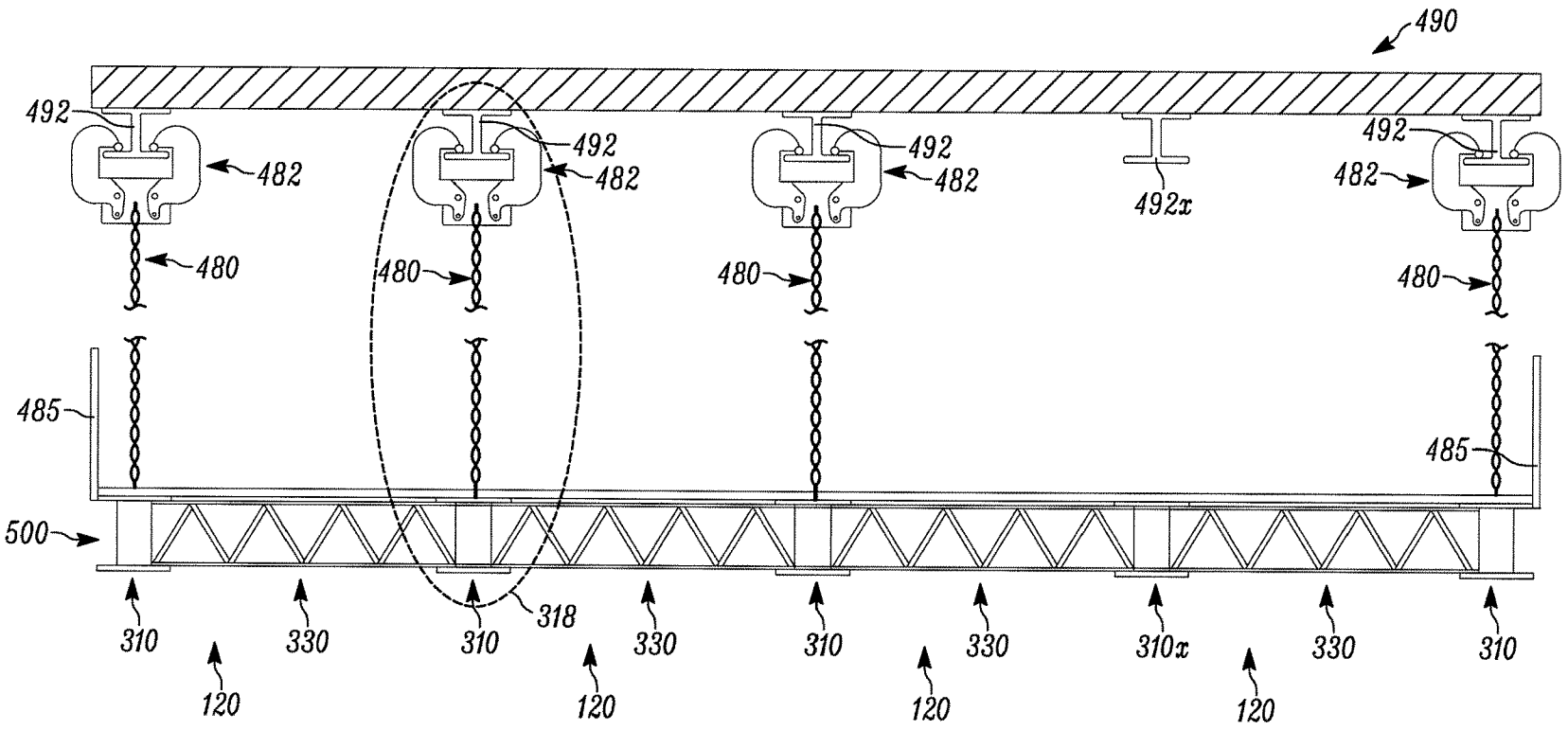
FIG. 29 is a sectional view of a work platform system formed in accordance with FIGS. 18A-19B-28B attached to a structure.

FIG. 29 shows an elevation sectional view of one embodiment wherein a support system and work platform system are attached, via a suspension connector 480, to a structure 490. The structure 490 in this embodiment is a bridge 490. On the underside of the bridge 490 are a plurality of beams 492. A series of suspension connectors 480, in this embodiment high strength chains, are attached to several of the beams 492 via structure attachment device 482, in this embodiment standard beam clamps. At the perimeter of the work platform system are a plurality of railing standards 485, thereby creating a railing system around the work platform system. The plurality of chains 480 are attached to various hubs 310 in the support system 500 thereby providing structural connection to the bridge 490. In this manner, a work platform system and support system can be fully suspended from a suitable structure 490. Note that each hub 310 does not necessarily require a suspension connector 480 to be connected to the structure 490. For example, there is no suspension connector 480 connecting hub 310*x* to beam 492*x*. This may be because hub 310*x* does not line up underneath beam 492*x*, or other suitable suspension point, and thus, using a chain 480 in that location is either not possible, or not desirable.

The suspension connector 480 may be any suitable support mechanism that can support both the work platform system 120, and all its ancillary dead loads, plus any intended live load that is placed upon the work platform system 120. In fact, the work platform system 120 may support its own weight plus at least four times the intended live load that is to be placed on the work platform system 120. Similarly, the suspension connector 480 is, also suitable to support its own weight plus at least four times the intended live load placed on it. The suspension connector 480 may be a high-strength chain, cable, or the like. For example, one suitable suspension connector 480 is ⅜", grade 100, heat-treated alloy chain.

The suspension connector 480 is attached to a beam clamp 482 which is further attached to a plurality of elements 492 on the underside of a structure 490. The structure 490 may be a bridge, viaduct, ceiling structure of a building, or the like. Similarly, the elements 492 which the suspension connector 480 are attached to may be beams, joists, or any other suitable structural element of the structure 490. Instead of beam clamps 482, other suitable structure attachment devices 482 may be used.

Referring back to FIGS. 5A-5B and 6, the hub 310 is shown with three elongated members 330*a*, 330*b*, and 330*c* attached to the hub 310 as described with reference to FIGS. 18A-21B. In the view shown and with reference to FIG. 18A, the elongated members 330 are attached to the hub 310 at openings 313*b*/314*b*, 313*f*/314*f* and 313*h*/314*h* (see FIGS. 18A-21B). The hub connection portion 30 is secured to the hub 310 at openings 313*d*/314*d*. In this arrangement, the base post member 10 is parallel with elongated member 330*b*. Because the hub connection portion's 30 apertures 33 are positioned on the outside of the channel 38 (e.g., offset from the channel 38), when either aperture 33 is aligned with openings 313*d*/314*d*, the hub connection portion 30, and therefore base post member 10, is offset from the center opening 316 of the hub 310. The offset connection of the hub connection member 30 with the hub 310 allows the center opening 316 to still be able to receive a linkage or suspension connector by which the hub 310 can be suspended from another structure, such as from a deck of the suspension bridge, when toe boards 96 are not in place.

In the embodiment shown, the hub connection portion 30 is connected to the hub 310 using pin 342 similar to, or preferably identical to, those used to secure the elongated members 330*a*, 330*b*, 330*c* to the hub 310.

With further reference to FIG. 5B, the hub connection portion 30 is secured to the hub 310 such that the top and bottom elements 39*a*, 39*b* interface with the upper surfaces of the top and bottom elements 311, 312 of the hub 310, respectively. As a result, the downward force generated by weight placed on any extended platform built on the brackets 100 is transferred to the entirety of the hub 310 and elongated member 330 which are attached to the hub 310. The present bracket 100 is therefore generally disposed horizontally when in standard operating conditions. No diagonal support is required. In fact, in an embodiment, the bracket 100 is free from diagonal structural members when in the standard operating position.

Figure 7A:
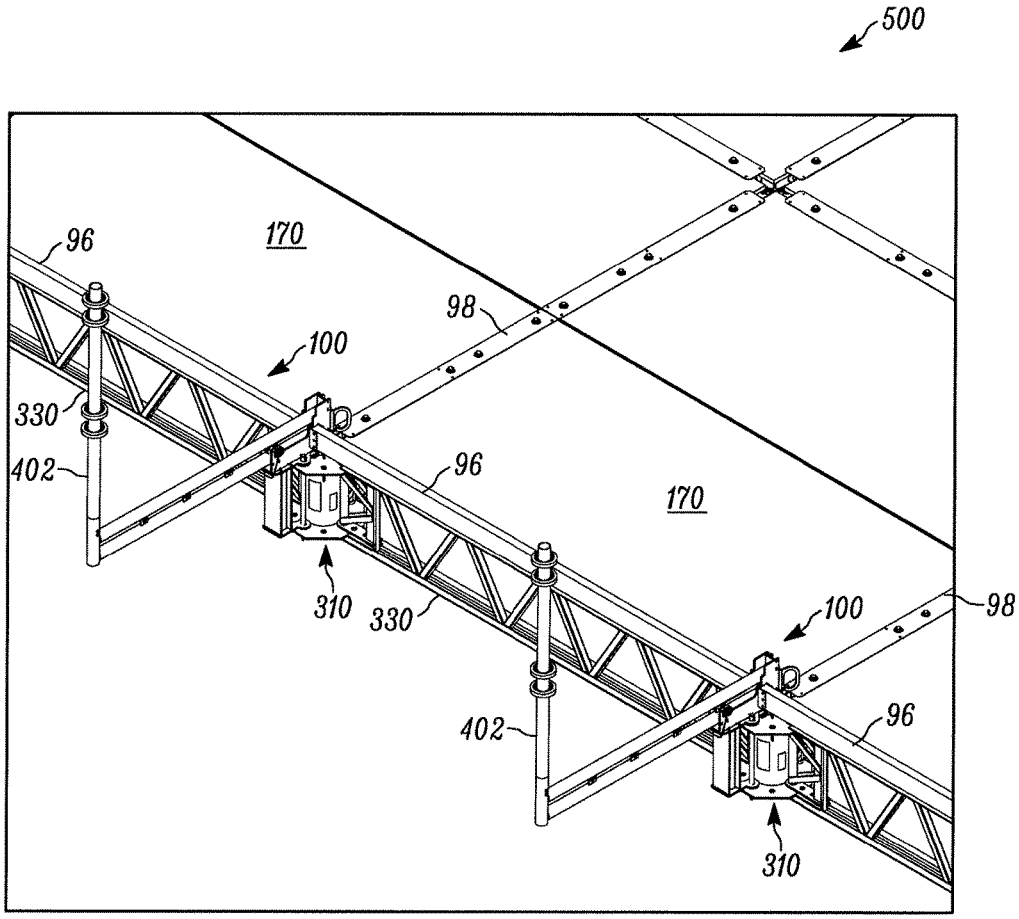
FIGS. 7A and 7B show the first embodiment of an adjustable platform extension bracket secured to a portion of a work platform system without a work platform secured to the base post member.
Figure 7B:
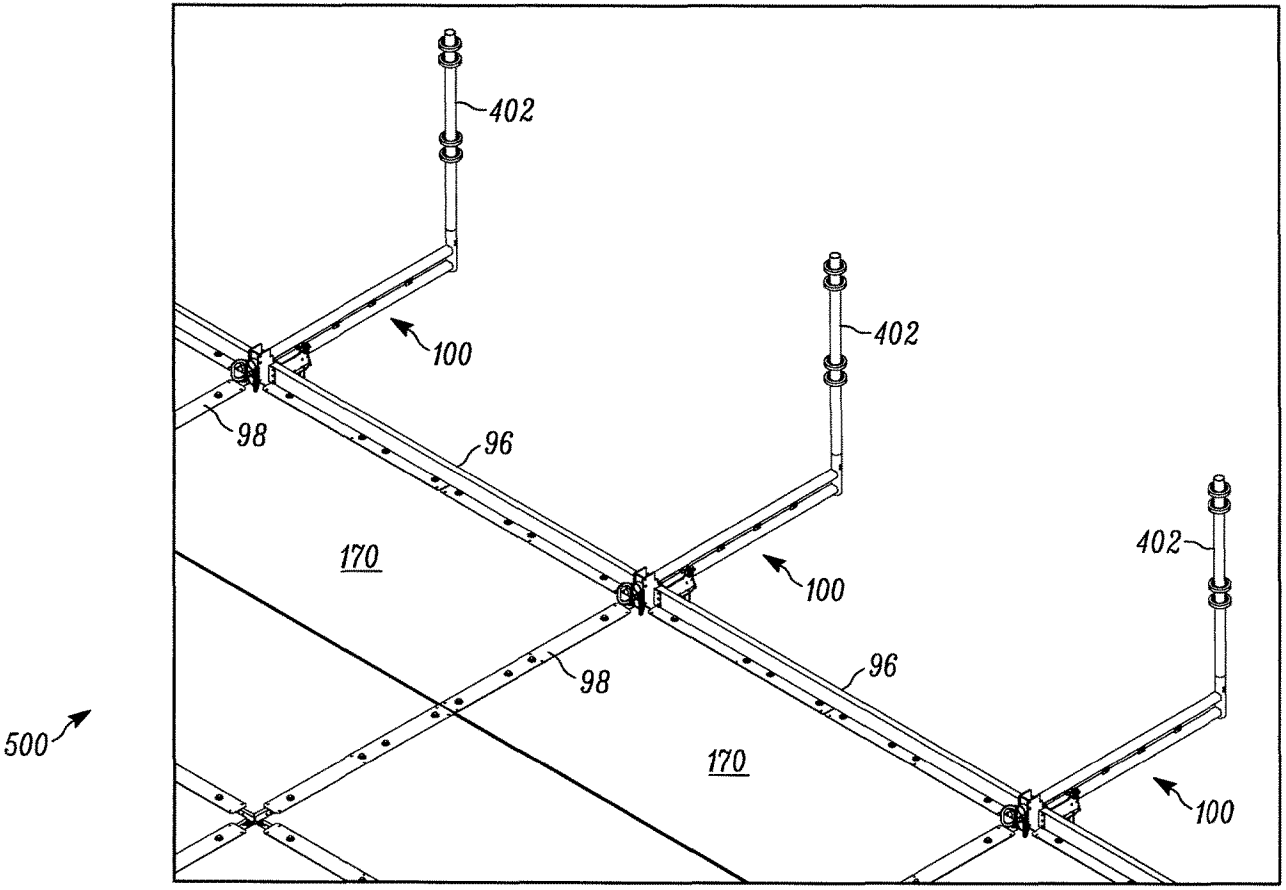

In accordance with an embodiment of the present disclosure, FIGS. 7A and 7B show a number of brackets 100 secured to a portion of a work platform 500. In the embodiment shown each bracket 100 is positioned at an available hub 310 such that each hub 310 has a corresponding bracket 100. However, it is understood that only hubs 310 along a perimeter of a work platform 500 will be available to secure a bracket 100. Further, not every hub 310 along a work platform 500 perimeter need necessarily have a corresponding bracket 100 depending on the situation, use and desired extended platform size.

As shown in FIGS. 7A and 7B, the brackets 100 are each in the fully extended position and ready to receive flooring sections (e.g., flooring boards, deck panels, planks, wood or metal hook planks, etc.).

Figure 8C:
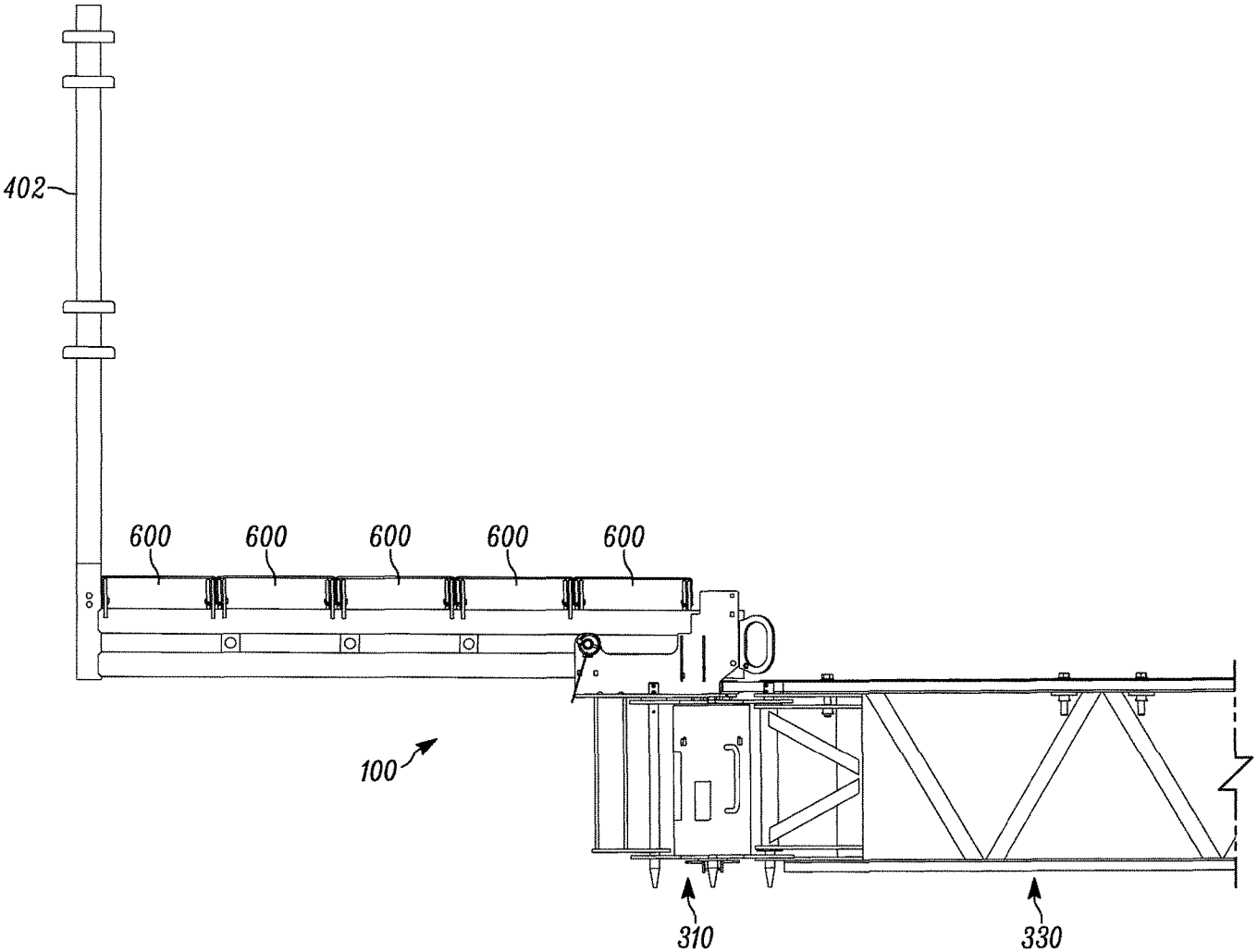

In the exemplary embodiment shown, and with further reference to FIGS. 8A-8C, when fully extended, the bracket 100 may be used to secure up to five scaffold planks and/or flooring sections 600. However, in further embodiments, the brackets 100 may be configured to secure more or fewer flooring sections depending on the size of the base post member 10 and number of connections 12 with apertures 13.

As shown in FIGS. 7A-8C, the guard rail post connectors 15 of each bracket 100 secure a guard rail post 402 and, with particular reference to FIGS. 8A-8C, a guard rail system is installed.

In the exemplary embodiment shown, the base post member 10 of each bracket 100 includes four connections 12 with apertures 13, with each of such connections 12 corresponding to a position enabling the bracket 100 to secure one or more planks and/or flooring sections 600. For example, and with reference to FIG. 1A, the space between the guard rail post connector 15 and the start of the toe board connection 95 (e.g., X1+Y) corresponds to the width of two standard platform planks (e.g., wood or metal hook plank) or other work platform flooring section. In the exemplary embodiment shown, for example, the distance from the guard rail post connector 15 to the end of the hub 310 (XI) is from approximately 4 inches, or 5 inches, or 5.25 inches to 5.5 inches, or 6 inches, or 7 inches. In the exemplary embodiment shown, the distance from the guard rail post connector 15 and end of hub 310 is 5.25 inches.

In the exemplary embodiment shown, in further example, the distance from the first connection 12 to the start of the toe board connection 95 (Y) is from approximately 4 inches, or 5 inches, or 5.25 inches to 5.5 inches, or 6 inches, or 7 inches. In the exemplary embodiment shown, the distance from the first connection 12 to restart of the toe board connection 95 (Y) is 5.25 inches.

In the exemplary embodiment shown, it therefore follows that the distance from the guardrail post connector 15 to the start of the toe board connection 95, identified by X1+Y, is from 8 inches, or 10 inches, or 10.5 inches to 11 inches, or 12 inches, or 14 inches. In the embodiment, the distance X1+Y is 10.5 inches.

As shown in FIGS. 1A-1D, as the position of the base post member 10 changes (e.g., is extended such that a further subsequent connection 12 with aperture 13 engages the hub connection portion 30), the distance between the guard rail post connector 15 and toe board connection 95 increases proportionally to allow a further platform plank and/or work platform flooring section to be secured to the bracket 100.

For example, and in the embodiments shown in FIG. 1B, the distance between the space between the guard rail post connector 15 and start of the toe board connection 95 (e.g., the second connection 12 with aperture 13 as counted from the second end 11*b* of the base post member 10 is within the hub connection portion 30) identified by X2+Y corresponds to the width of three standard platform planks (e.g., wood or metal hook plank) or other work platform flooring sections. In the exemplary embodiment shown, the distance from the second connection 12 to the start of the toe board connection 95, identified as Y, is from approximately 4 inches, or 5 inches, or 5.25 inches to 5.5 inches, or 6 inches, or 7 inches. In an embodiment, the distance Y is 5.25 inches.

In the exemplary embodiment shown, it therefore follows that the distance from the guardrail post connector 15 to the start of the toe board connection 95 when the racket 100 is in the second position (X2+Y) is approximately from 14 inches, or 17 inches, or 19.25 inches to 20.5 inches, or 22 inches, or 24 inches. In an exemplary embodiment, the distance X2+Y is 19.88 inches.

For example, and in the embodiments shown in FIG. 1C, the distance between the space between the guard rail post connector 15 and the third connection 12 as counted from the second end 11*b* of the base post member 10 (X3) corresponds to the width of three standard platform planks (e.g., wood or metal hook plank) or other work platform flooring sections. In the exemplary embodiment shown, for example, the distance from the guard rail post connector 15 to the end of the hub 310 (X3) is from approximately 20 inches, or 22 inches, or 23 inches to 24 inches, or 25 inches, or 26 inches. In the exemplary embodiment shown, the distance from the guard rail post connector 15 and end of hub 310 is 23.88 inches. In the exemplary embodiment shown, the distance from the second connection 12 to the start of the toe board connection 95, identified as Y, is from approximately 4 inches, or 5 inches, or 5.25 inches to 5.5 inches, or 6 inches, or 7 inches. In an embodiment, the distance Y is 5.25 inches.

In the exemplary embodiment shown, it therefore follows that the distance from the guardrail post 15 to the start of the toe board connection 95 when the bracket 100 is in the third position (X3+Y) is approximately from 24 inches, or 27 inches, or 28.25 inches to 29.5 inches, or 31 inches, or 33 inches. In an embodiment, the distance X3+Y is 29.13 inches.

For example, and in the embodiments shown in FIG. 1D, the distance between the space between the guard rail post connector 15 and the fourth connection 12 as counted from the second end 11*b* of the base post member 10 corresponds to the width of four standard platform planks (e.g., wood or metal hook plank) or other work platform flooring sections. In the exemplary embodiment shown, for example, the distance from the guard rail post connector 15 to the end of the hub 310 (X4) is from approximately 30 inches, or 32 inches, or 33 inches to 34 inches, or 35 inches, or 36 inches. In the exemplary embodiment shown, the distance from the guard rail post connector 15 and end of hub 310 is 33.13 inches. In the exemplary embodiment shown, the distance from the second connection 12 to the start of the toe board connection 95, identified as Y, is from approximately 4 inches, or 5 inches, or 5.25 inches to 5.5 inches, or 6.0 inches, or 7 inches. In an embodiment, the distance Y is 5.25 inches.

In the embodiment shown, it therefore follows that the distance from the guardrail post 15 to the start of the toe board connection 95 is approximately from 34 inches, or 37 inches, or 35.25 inches to 39.5 inches, or 41 inches, or 43 inches. In an embodiment, the distance X4+Y is 36.38 inches.

In an embodiment, the number of positional structures and/or pairs of positional structures may vary, and the total distance between the space between the guard rail post connector 15 and the end of a hub 310 may vary continuously, or incrementally, from 0 inches, or from 2 inches, or from 4 inches, or from 5 inches, or from 5.25 inches, or from 10 inches, or from 12 inches, or from 14 inches, or from 20 inches, or from 22 inches, or from 23 inches, or from 30 inches, or from 32 inches, or from 33 inches, or from 34 inches, or from 37 inches, or from 39 inches to 60 inches, or to 55 inches, or to 50 inches, or to 45 inches, or to 40 inches, or to 38 inches, or to 36 inches, or to 35 inches, or to 34 inches, or to 26 inches, or to 25 inches, or to 24 inches, or to 17 inches, or to 16 inches, or to 15 inches, or to 7 inches or to 6 inches, or to 5.5 inches.

In on embodiment, the base post member is incrementally positionable from approximately 0 inches to approximately 50 inches in units of approximately 0.5 inches, or 1 inch, or 1.1 inches, or 1.2 inches, or 1.25 inches, or 1.3 inches, or 1.4 inches, or 1.5 inches, or 1.6 inches, or 1.7 inches, or 1.75 inches, or 1.8 inches, or 1.9 inches, or 2 inches, or 2.1 inches, or 2.2 inches or 2.25 inches, or 2.3 inches, or 2.4 inches, or 2.5 inches, or 2.6 inches, or 2.7 inches, or 2.75 inches, or 2.8 inches, or 2.9 inches, or 3 inches.

Figure 30:
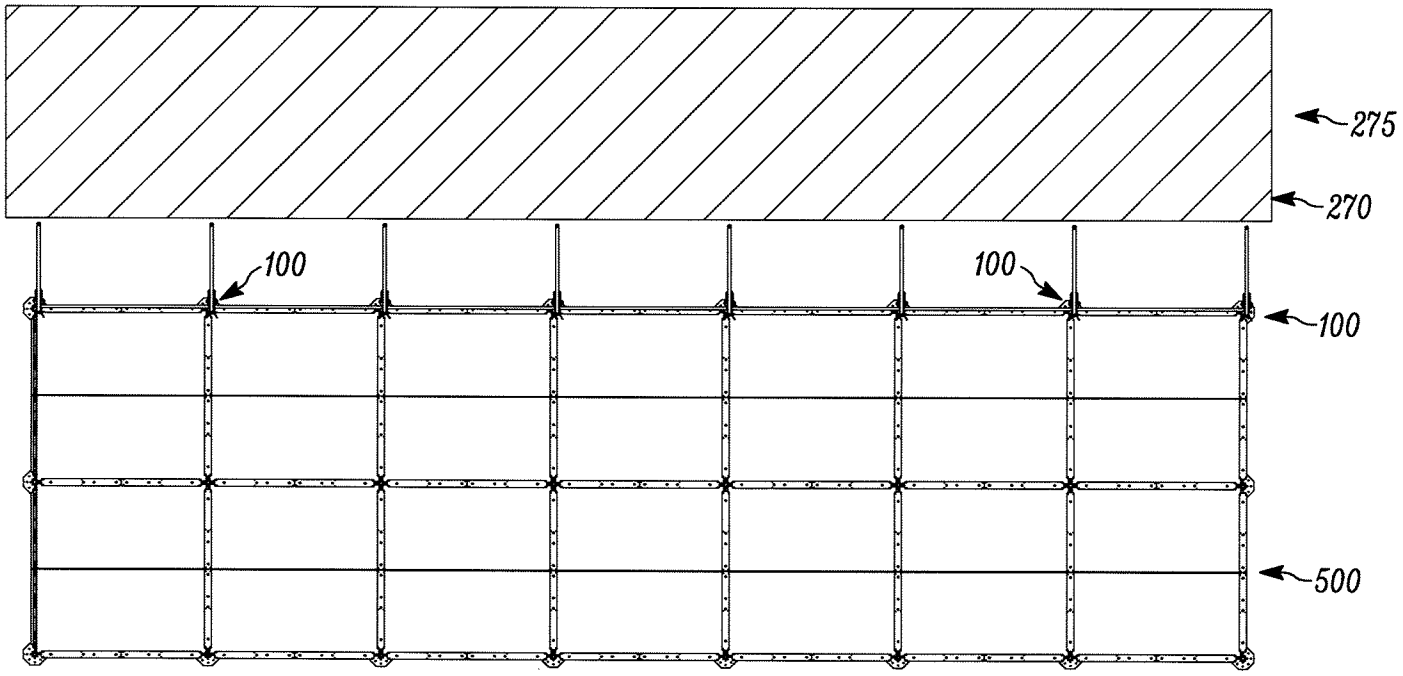
FIG. 30 is a top view of a suspended work platform system extended to a substantially flat structure using an adjustable platform extension bracket.

FIG. 30 illustrates a portion of a suspended work platform system 500 implemented with respect to a substantially flat surface 270 of a structure 275, which in the embodiment shown is a wall, with multiple brackets 100 secured to the suspended work platform system 500 to extend the platform to be flush, or substantially flush, or approximately flush, with the surface 270 (e.g., wall). As understood with reference to FIGS. 1A-1D, above, the distance between the surface 270 and the extended platform depends on the location of connections 12 with apertures 13 on the base post member 10. When the work platform system 500 is implemented with respect to a flat, or substantially flat surface, the work platform system 500 may be extended as close to the surface 270 as permitted by the connections 12 with apertures 13.

Figure 31:
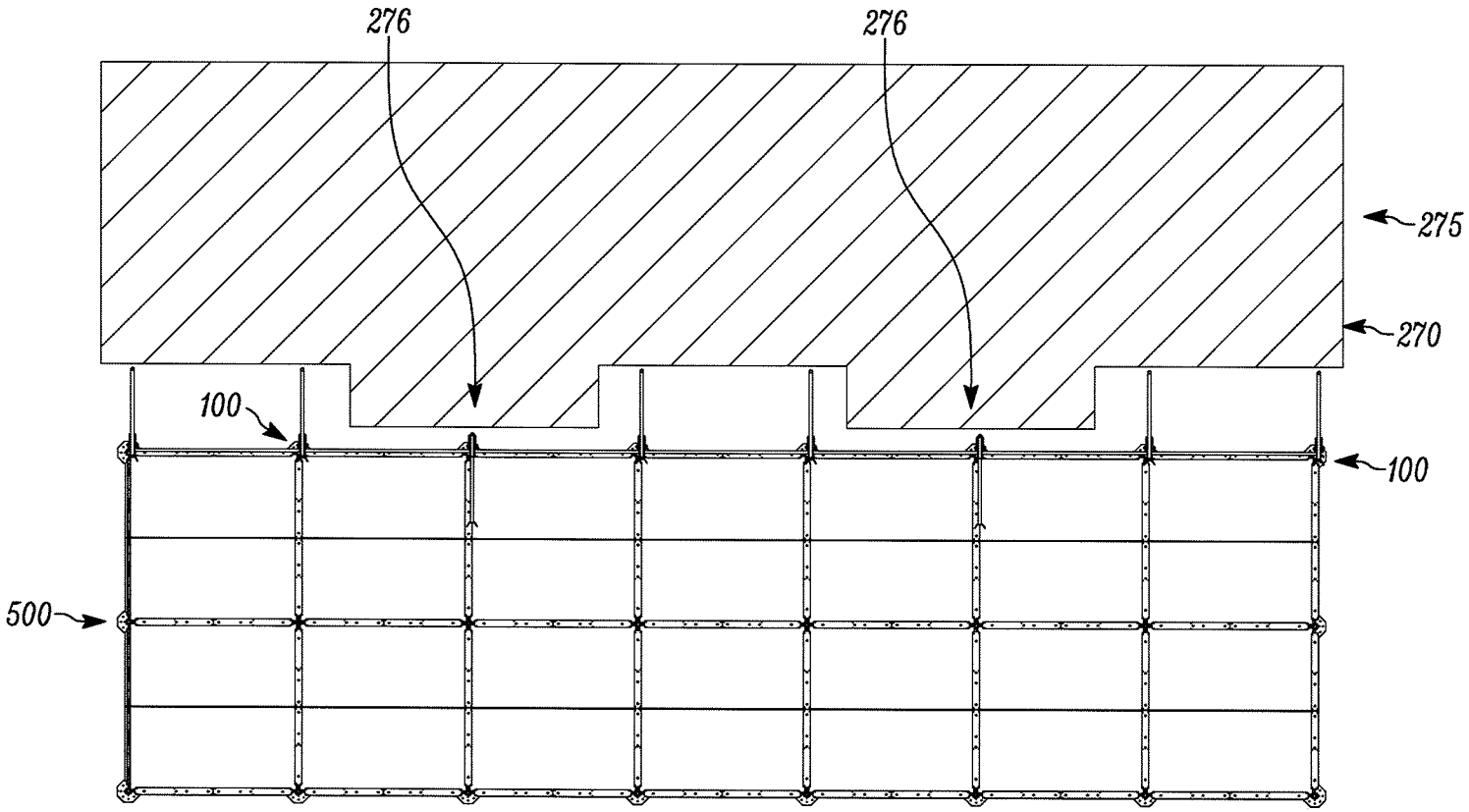
FIG. 31 is a top view of a suspended work platform system extended to a substantially flat structure having a pillar.

FIG. 31 illustrates a portion of a suspended work platform system 500 which is extended to a substantially flat surface 270 of a structure 275 having a pillar 276. As illustrated in FIG. 23, the suspended work platform system 500 is implemented as close to the pillar 276 as possible because the pillar 276 is the surface projecting the furthest from the structure 275. The suspended work platform system 500 is then extended using a plurality of brackets 100 to be flush, substantially flush, approximately flush with, or otherwise as close as possible to, the remainder of the surface 270.

As will be appreciated, because the surfaces 270 of the structures 275 described with respect to FIGS. 30 and 31 above are flat, or at least substantially flat, each bracket 100 is in an identical position to form an extended platform of consistent length.

Figure 32:
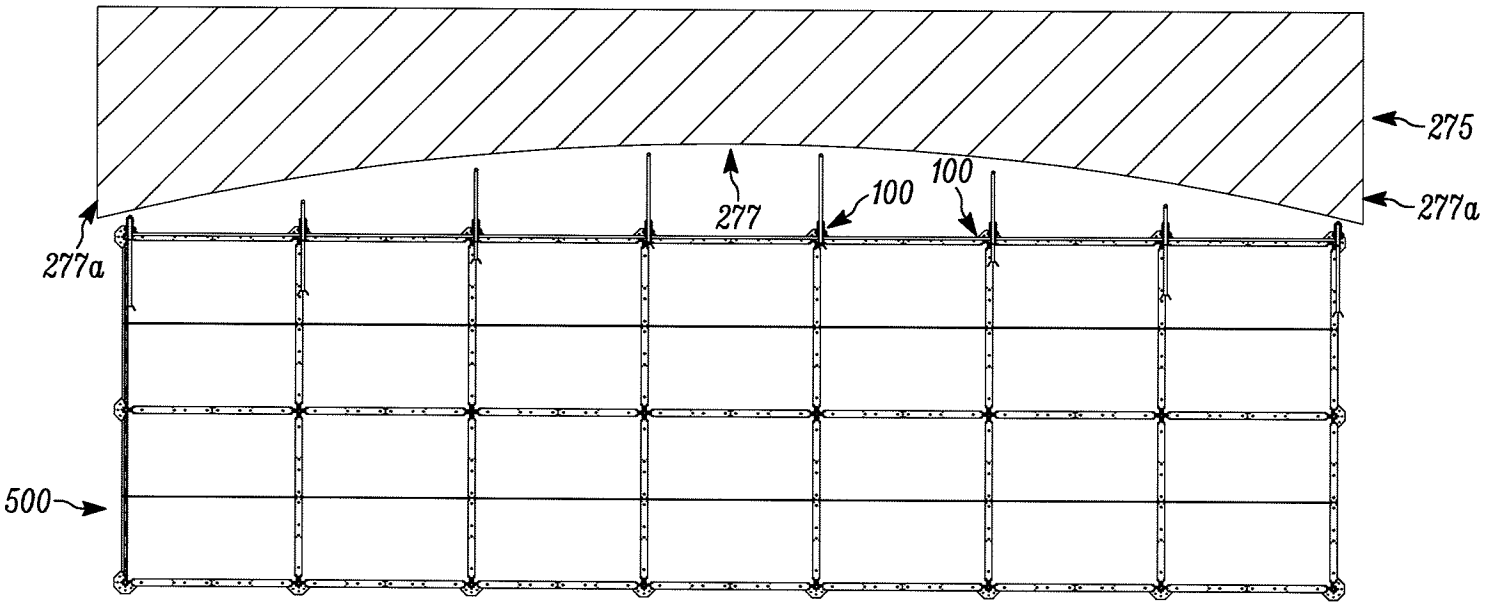
FIG. 32 is a top view of a suspended work platform system extended to a curved structure using an adjustable work platform extension bracket.

FIG. 32 illustrates a suspended work platform system 500 implemented with respect to a curved structure 277. As shown, the suspended work platform system 500 is implemented so as to be flush, substantially flush, or approximately flush with the portion of the curved surface 277 which projects the furthest outward. Because the curved surface is concave, the work platform system 500 is implement so as to be as close as possible to the outer edges 277*a* of the surface 277. The work platform system 500 is then extended incrementally using a plurality of brackets 100. As will be appreciated, the brackets 100 are not each in the same extended position. Instead, the brackets 100 are progressively extended as the platform moves further from the edges 277*a*.

In accordance with another embodiment, such as shown in FIGS. 9A through 9D, disclosed herein is a second embodiment of an adjustable platform extension bracket for work platform systems. The adjustable platform extension bracket ("bracket") 100' extends outwardly away from at least a portion of an existing suspended work platform system 500' (not shown) to provide an extension 501' of the work platform system 500' (not shown).

Figure 13A:
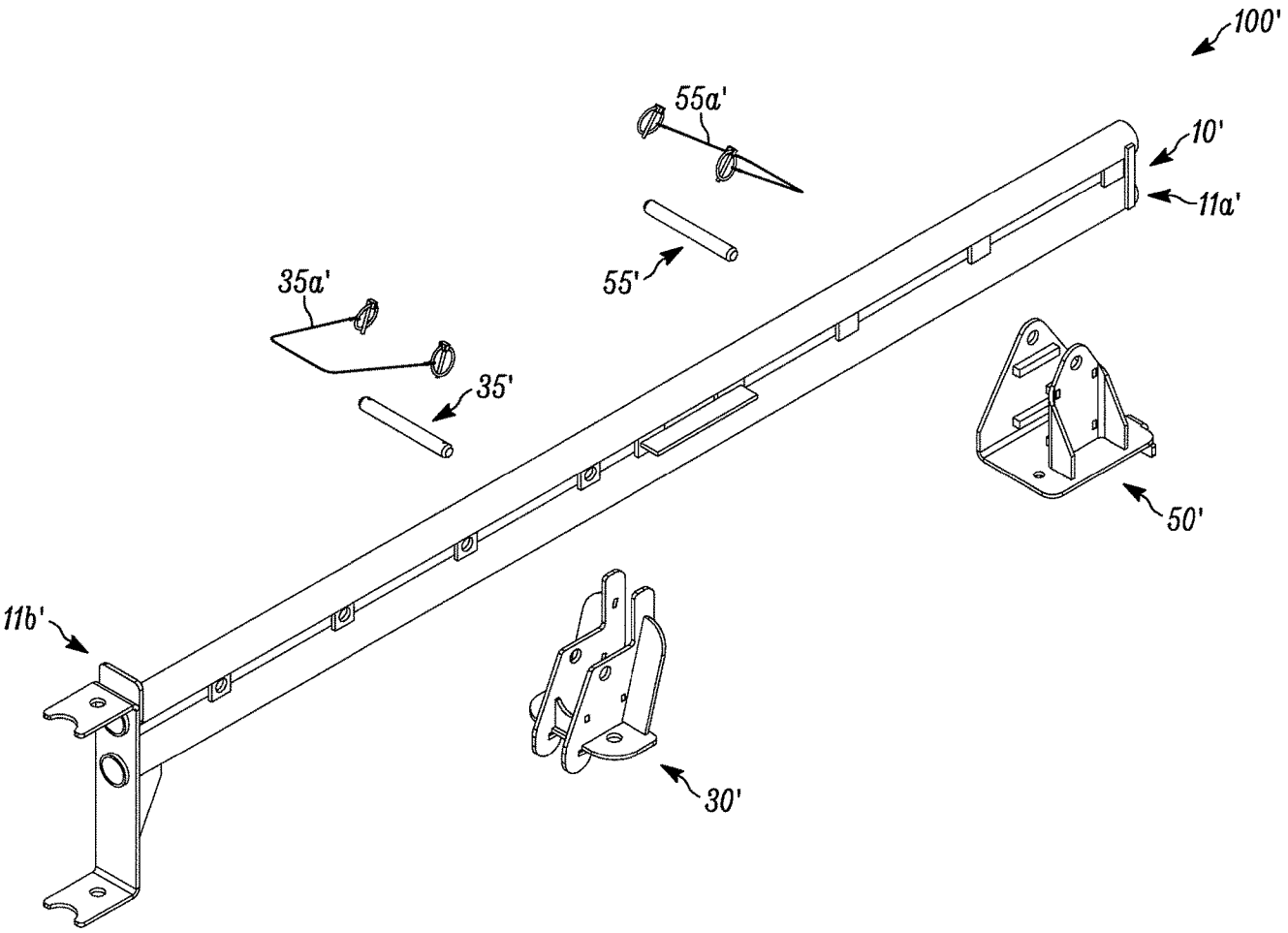
FIG. 13A is an exploded view of a second embodiment of an adjustable platform extension bracket.
Figure 13B:
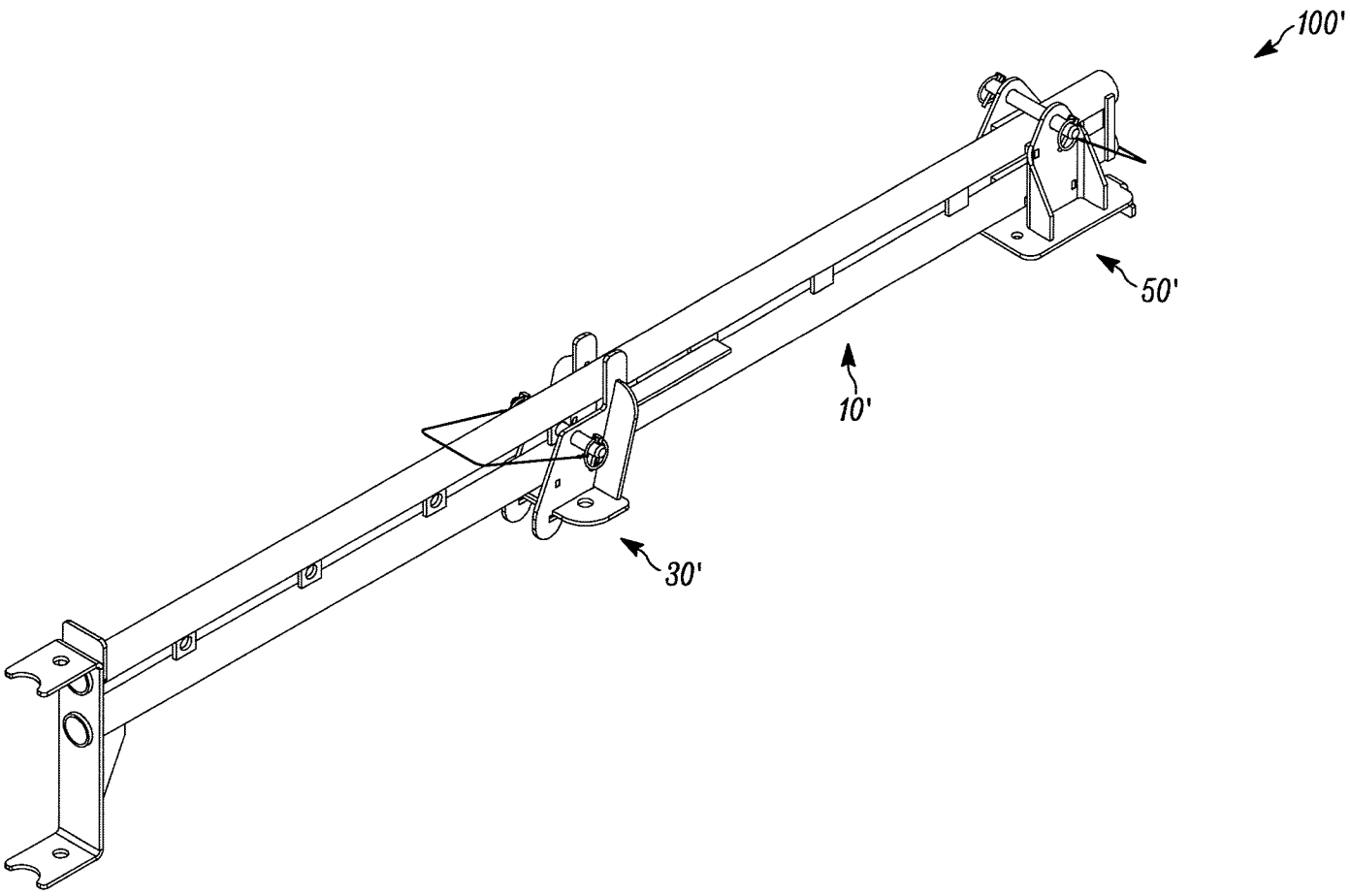
FIG. 13B is a second embodiment of an adjustable platform extension bracket which is assembled.

In an embodiment, and as shown with reference to FIGS. 13A and 13B, the bracket 100' is composed of base post member 10' slidingly engaged with a hub connection portion 30' and an elongated member connection portion 50'.

In the embodiment shown, and particularly with reference to FIGS. 10A-10D, the base post member 10' includes two posts 10*a*', 10*b*' which are parallel to one another and joined at intervals along their length at connections 12', some of which include an aperture 13'. As described in further detail, the connections 12' containing apertures 13' are referred to as "positional structures" because the location of the connections 12' with apertures 13' determines the position of the post member 10' in the connection portions 30', 50' and, therefore, the size of the extended platform (see FIGS. 9A-9D, 21-23). The base post member 10' slidingly engages the elongated member connection portion 50' (see FIGS. 13A and 13B) at a first end portion 11*a*' and the hub connection portion 30' between the first end portion 11*a*' and second end portion 11*b*'.

In an embodiment, the base post member 10' includes at least 3, preferably at least 4, and more preferably at least 5 positional structures (12/13). As described in further detail below, as a result, the brackets 100' described herein are capable of securing at least 2, preferably at least 3, and more preferably at least 4 flooring planks or sections.

Figure 10A:
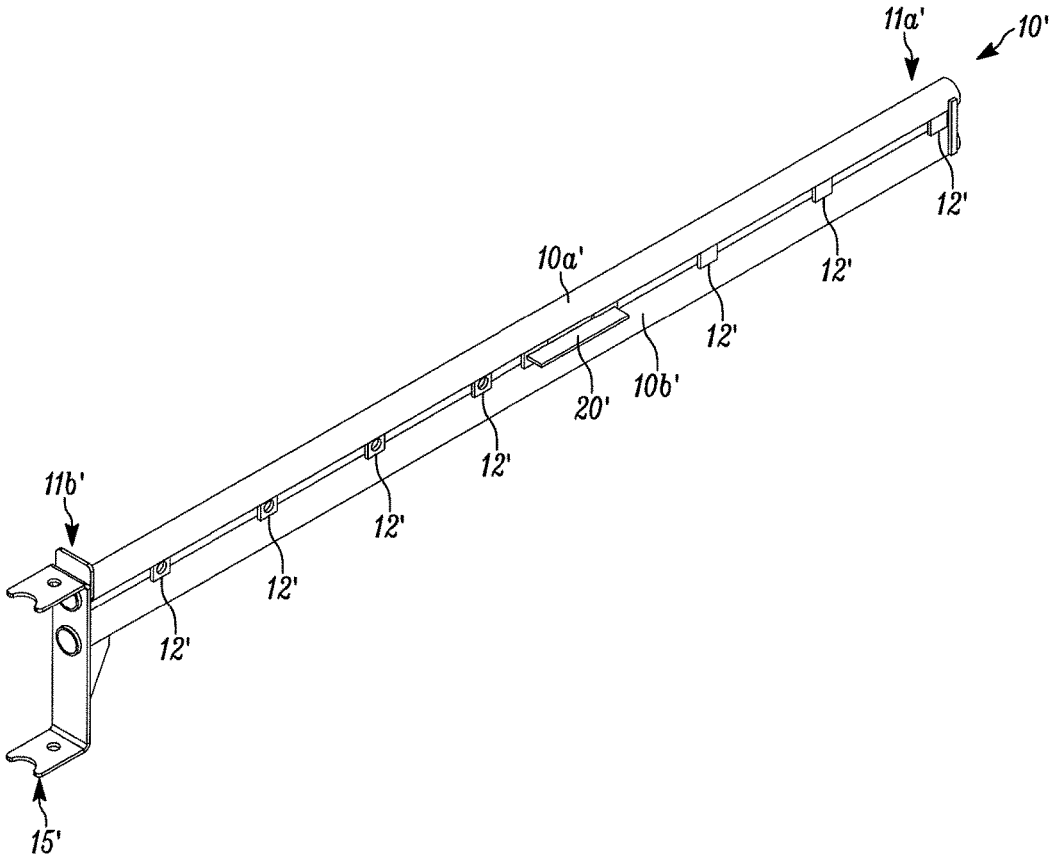
FIG. 10A shows a second embodiment of a base post member for an adjustable platform extension bracket.
Figure 10B:
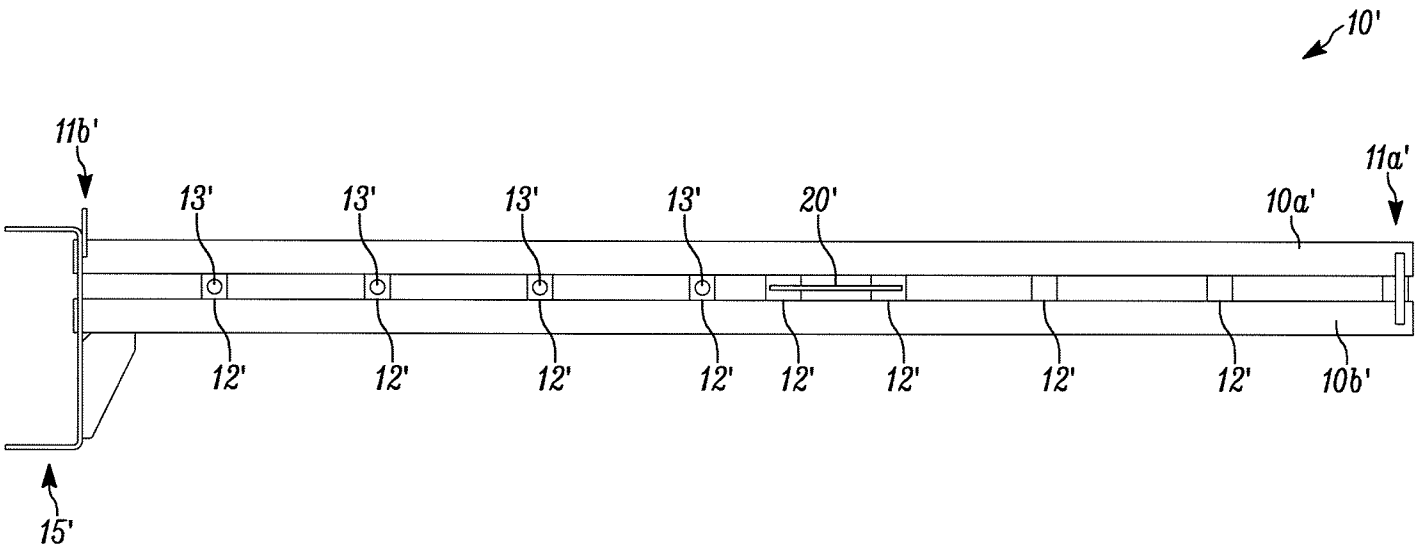
FIG. 10B is a side view of a second embodiment of a base post member for an adjustable platform extension bracket.
Figure 10C:
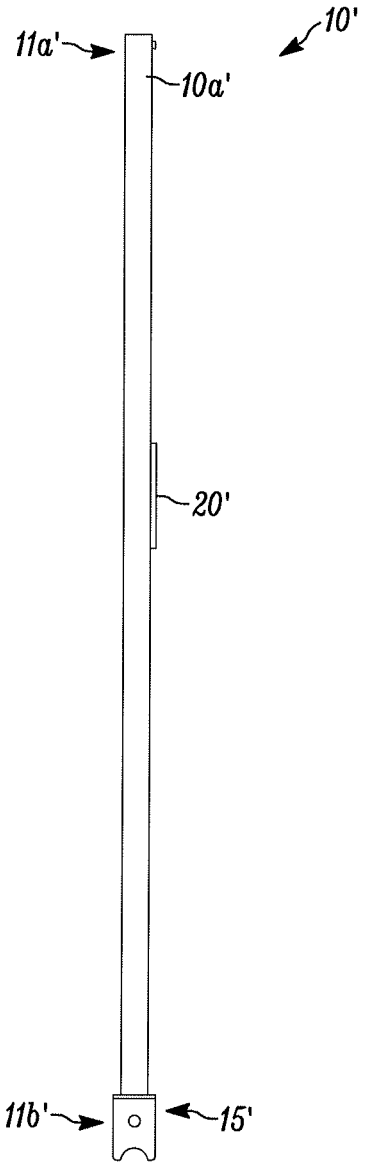
FIG. 10C is a top view of a second embodiment of a base post member for an adjustable platform extension bracket.
Figure 10D:
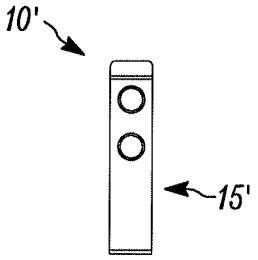
FIG. 10D is an end view of a second embodiment of a base post member for an adjustable platform extension bracket.

A stop plate 20' is secured to the base post member 10' at a position between where the base post member 10' slidingly engages the hub connection portion 30' and elongated member connection portion 50', as shown in FIG. 13B. Stop plate 20' prevents the base post member 10' from slidingly disengaging the hub connection portion 30' and elongated member connection portion 50'. As shown in FIG. 10B, specifically, the stop plate 20' is secured to at least one, and preferably at least two connections 12'. The stop plate 20' projects outward from the connections 12' past the width of the posts 10*a*', 10*b*'.

In an embodiment, the posts 10*a*', 10*b*' have an outer diameter approximately equal to that of a standard scaffold tube member and are configured to accept standard commercial scaffold components (e.g., hooks, planks, scaffold clamps, etc.). In particular, at least one of the posts 10*a*', 10*b*' is configured to receive at least a portion of a flooring section or plank for a work platform. As used herein, the term "flooring section or plank," as used herein and in the context of a work platform and/or work platform system, refers to any structure or combination of structures used as a flooring surface in a work platform system.

In a further embodiment, the posts 10*a*', 10*b*' are made using standard scaffold tube members.

In an embodiment, the second end portion 11*b*' of the base post member 10' includes a guard rail post connector 15' which is configured to secure a guard rail post (not shown).

With reference to FIGS. 11A-11D, the hub connection portion 30' is configured to secure to a hub 310' of a suspended work platform system 500' (see FIGS. 14A and 14B) while engaging the base post member 10' (not shown) in a sliding engagement. In the embodiment shown, the hub connection portion 30 includes a base portion or base plate 31' for connection to a hub 310' (not shown) and an additional channel-forming structure to form a channel 38' in which the base post member 10' is slidingly engaged.

In a further embodiment, as shown in FIGS. 11A-11D, the hub connection portion 30' includes the base plate 31' and the additional channel-forming structure is composed of two channel plates 32' approximately perpendicular to the base plate 31'. Together, the base plate 31' and two channel plates 32' form an open, three-sided channel 38' in which the base post member 10' (not shown) is slidable. The channel plates 32' are positioned on the base plate 31' to form a channel 38' have a width just greater than the external diameter of the posts 10*a*', 10*b*'. An aperture 33' is located on either side of the channel 38' outward from the channel plates 32'.

In the embodiments described, the channel plates 32' are positioned at a distance from each other to form the channel 38' which is approximately U-shaped.

Figure 11A:
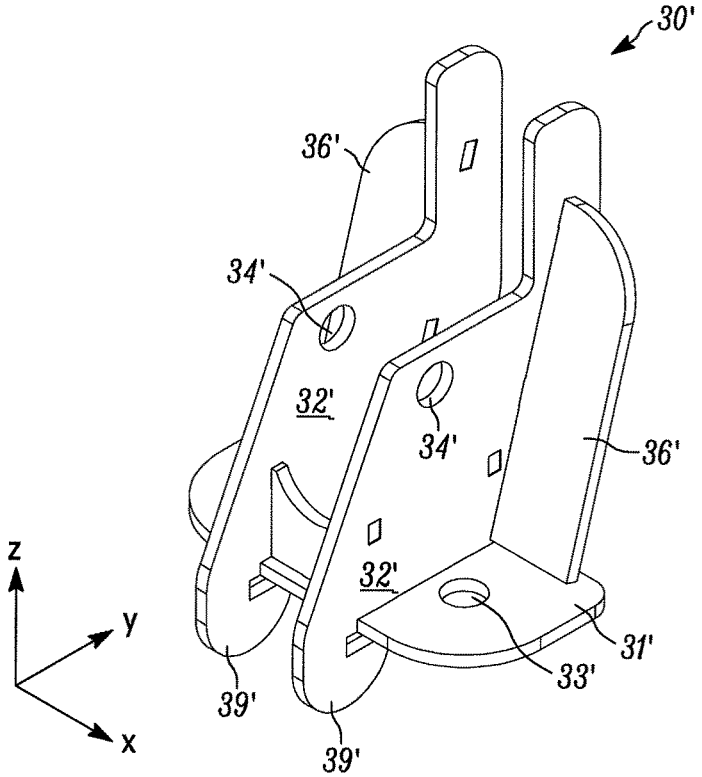
FIG. 11A shows an embodiment of a second embodiment of a hub connection portion for an adjustable platform extension bracket.
Figure 11B:
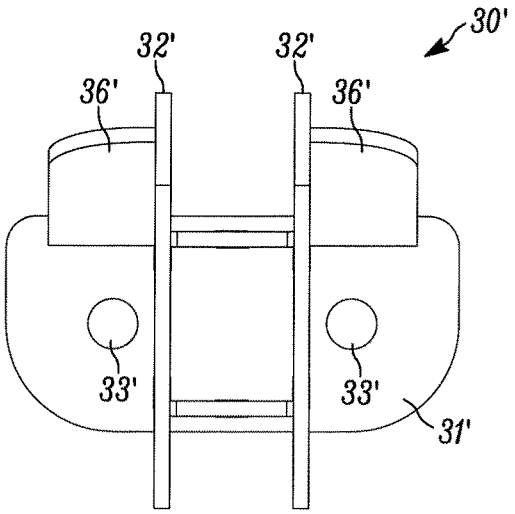
FIG. 11B is a top view of a second embodiment of a hub connection portion for an adjustable platform extension bracket.
Figure 11C:
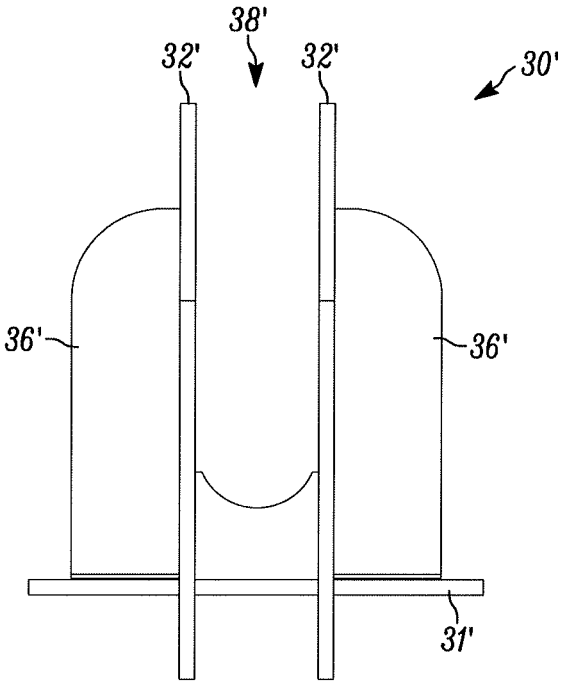
FIG. 11C is a front end view of a second embodiment of a hub connection portion for an adjustable platform extension bracket.
Figure 11D:
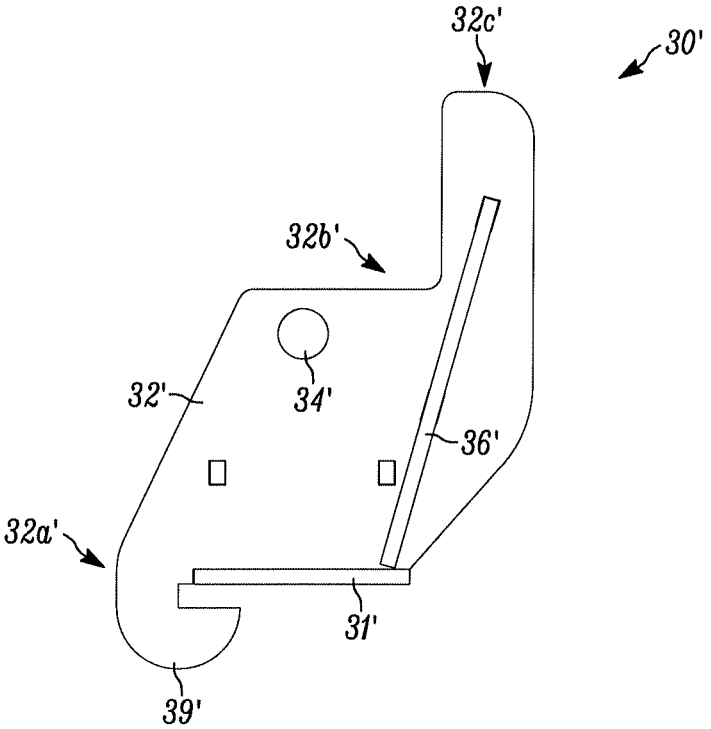
FIG. 11D is a side view of a second embodiment of a hub connection portion for an adjustable platform extension bracket.

As shown in FIG. 11D, the channel plates 32' have a generally Z-like shape with a first end 32*a*', middle portion 32*b*' and second end 32*c*' offset from the first end 32*a*'. The first end 32*a*' includes a hook 39' which, as shown in FIG. 14B, secures directly or indirectly around the top element 311' of the hub 310'. The middle portion 32*b*' extends a distance above the base plate 31', forming a channel in which the base post member 10' slides. In particularly, as shown in FIG. 14B, the post 10*a*' slides between the middle portions 32*b*' of the channel plates 32', while post 10*b*' slides between the second ends 32*c*' of the channel plates 32'.

In an embodiment, the channel plates 32' also include an aperture 34' creating a continuous passage through the plates 32'. As shown in FIGS. 13A and 13B, when the base post member 10' is positioned in the hub connection portion 30' such that an aperture 13' at a connection 12' is aligned with the apertures 34' of the channel plates 32', a pin 35' inserted through the channel plates 32' and connection 12' locks the base post member 10' in position. As will be discussed further with reference to FIGS. 9A-9D, the distance between connections 12' with apertures 13' corresponds to the width of scaffold plank sections.

In the embodiment shown, the channel plates 32' also include an angled plate 36' which is secured to the channel plates 32' extending from the middle portion 32*b*' to the second end 32*c*'.

While in the embodiment shown, the base plate 31', channel plates 32' and angled plates 36' are distinct plates secured to one another (e.g., welded), in other embodiments, two or more of the plates 31', 32' and 36' may be integrally formed with each other.

In an embodiment, the hub connection portion 30' is symmetrical along the y axis, as oriented in the exemplary embodiment shown in FIGS. 11A and 11C.

With reference to FIGS. 12A-12D, the elongated member connection portion 50' is configured to secure to an elongated member of a suspended work platform system 500' (not shown) while engaging the base post member 10' (not shown) in a sliding engagement. In the embodiment shown, the elongated member connection portion 50' includes a base portion or base plate 51' for connection to an elongated member 330' (see FIGS. 13A and 13B) and an additional channel-forming structure to form a channel 58' in which the base post member 10' is slidingly engaged.

In a further embodiment, the elongated member connection portion 50' includes a base portion 51' and the additional channel-forming structure is composed of two channel plates 52*a*',52*b*'. The channel plates 52*a*', 52*b*' form a channel 58' in which the base post member 10' (not shown) is slidable. In the embodiment shown, the channel plates 52*a*', 52*b*' include projections 53' on the inner (channel-side) side of the plates 52*a*', 52*b*'. Specifically, as shown in FIG. 12C, the channel plates 52*a*', 52*b*' each include two rectangular, block-like projections 53', one corresponding to each of the posts 10*a*', 10*b*' (not shown). The projections 53' serve to keep the base post member 10' in proper alignment.

In an embodiment, the channel plates 52*a*', 52*b*' are separated by a distance to form the channel 58' which is approximately U-shaped.

In the exemplary embodiment shown, channel plate 52*a*' is integrally formed with the base portion 51' (for example, by folding), while channel plate 52*b*' is a separate structural component secured (e.g., through welding) to the base portion 51'. Further, channel plate 52*a*' has an approximately triangular shape with an aperture 54' at its apex, whereas channel plate 52*b*' has a folded triangular shape with an aperture 54' at its apex. Channel plate 52*b*' is approximately triangular with the two legs of its approximately triangular shape which are not adjacent to and parallel with the base portion 51' are folded or bent outward (away from the channel 58') so as to not obstruct the apertures 56' in the base portion 51'. As shown in FIG. 14C, elongate member engaging structures 60' pass through the apertures 56' to engage the elongate structural member and secure the bracket 100' to the elongate structural member 330' (not shown) and, therefore, work platform system 500'.

In the embodiment shown, apertures 54' align to form a continuous passage through the plates 52*a*', 52*b*'. As shown in FIGS. 13A and 13B, a pin 55' engaging both apertures 54' prevents the first end portion 11*a*' of the base post member 10' from disengaging (e.g., by tilting) the elongated member connection portion 50', and therefore bracket 100'.

Figure 12A:
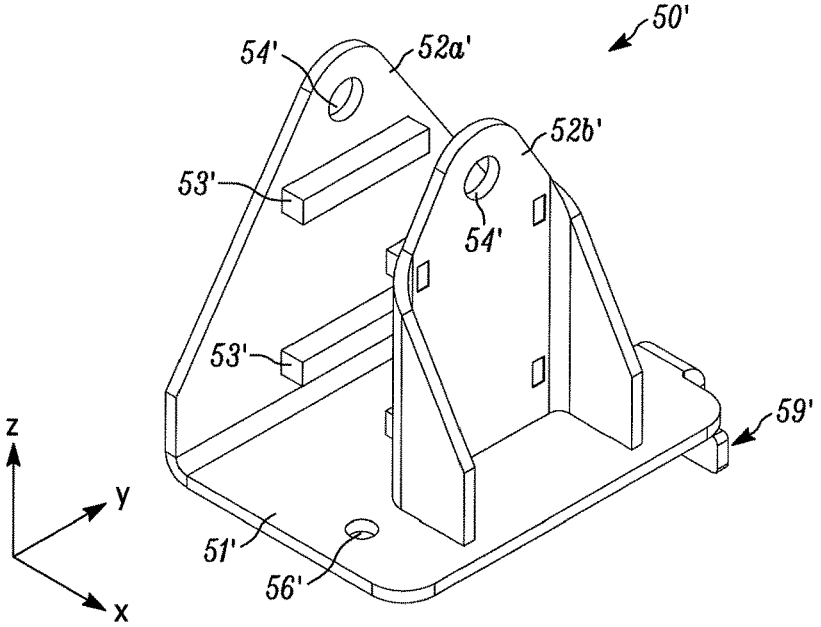
FIG. 12A shows a second embodiment of an elongated member connection portion for an adjustable platform extension bracket.
Figure 12B:
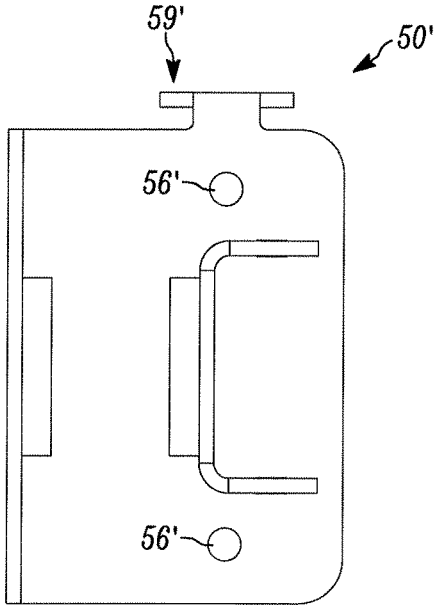
FIG. 12B is a top view of a second embodiment of an elongated connection portion for an adjustable platform extension bracket.
Figure 12C:
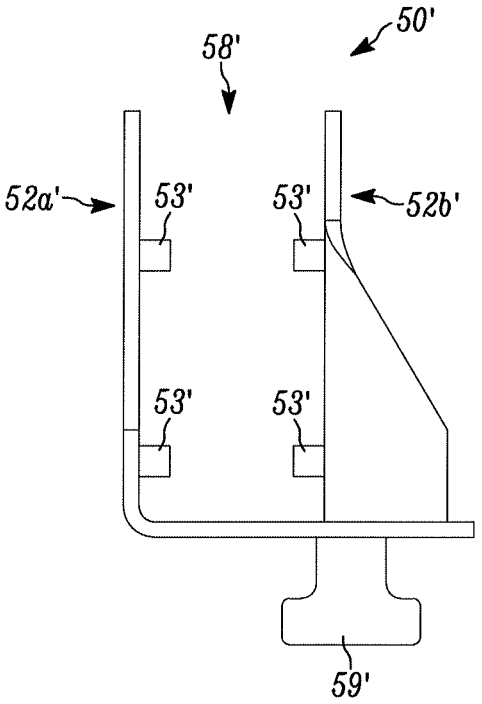
FIG. 12C is a front end view of a second embodiment of an elongated connection portion for an adjustable platform extension bracket.
Figure 12D:
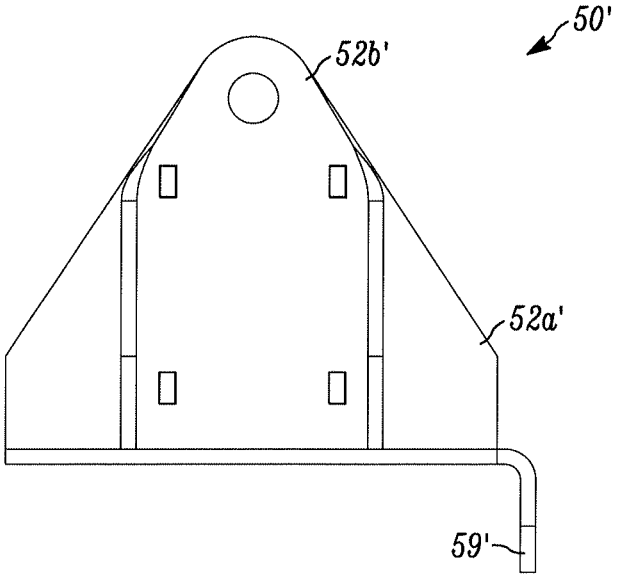
FIG. 12D is a side view of a second embodiment of an elongated connection portion for an adjustable platform extension bracket.

Because only one of the channel plates 52*b*' is folded, the elongated member connection portion 50' is not symmetric along the y axis, with reference to the orientation as shown in FIG. 12A. However, in further embodiments, both channel plates 52*a*', 52*b*' may be formed independently from and secured to the base portion 51' in a folded manner to permit the bracket 100' to secure to an elongated member 330' on either side of the elongated member connection portion 50'.

The elongated member connection portion 50' also includes aligning structure 59' which, when the bracket 100' is installed with respect to at least a portion of a work platform system 500' (not shown), projects between the portions of the upper element 332' of an elongated member 330' (not shown) to help align the elongated member connection portion 50' for connection to the elongated member 330' (not shown).

As shown in FIGS. 13A and 13B, wires 35*a*' and 55*a*' prevent pins 35' and 55', respectively, from disengaging their respective apertures 34' and 54', respectively.

FIG. 9A shows the bracket 100' in a first (retracted) position with the stop plate 20' in the channel 58' of the elongated member connection portion 50' and the second end 11*b*' of the base post member 10' as close to the hub connection portion 30' as permitted by the location of the stop plate 20'. In the embodiment shown, the distance between guardrail post connector 15' and the start of the hub connection portion 30' (identified as X1') corresponds to the width of a single flooring plank or panel. In an embodiment, the flooring plank or panel is a standard plank or panel as used in the industry; however, in an embodiment, any structure used to form a unit of flooring and which may be seared to the bracket 100' may be used.

Figure 9B:
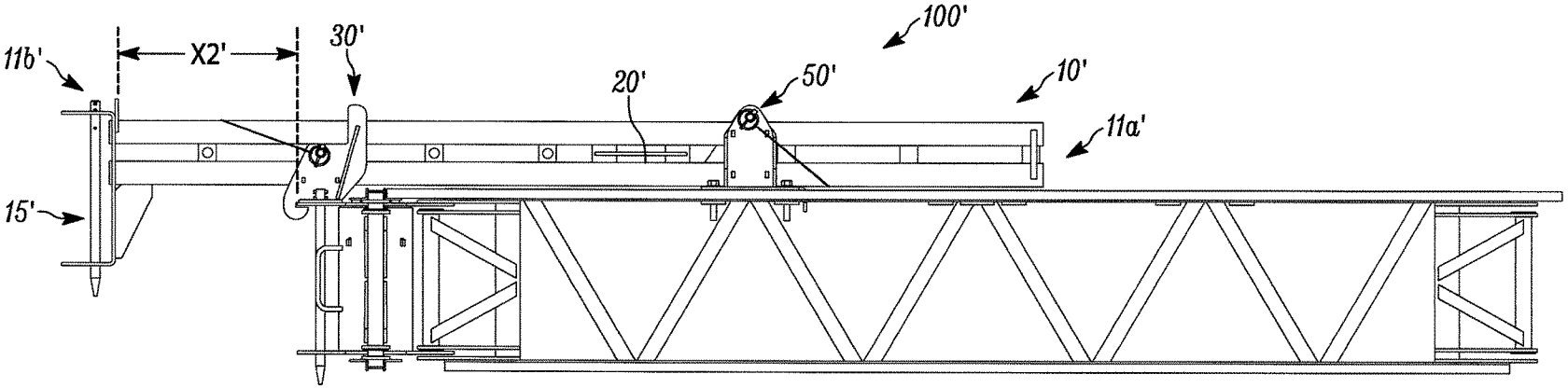
FIGS. 9B and 9C are side views of a second embodiment of an adjustable platform extension bracket in a partially extended position.
Figure 9C:
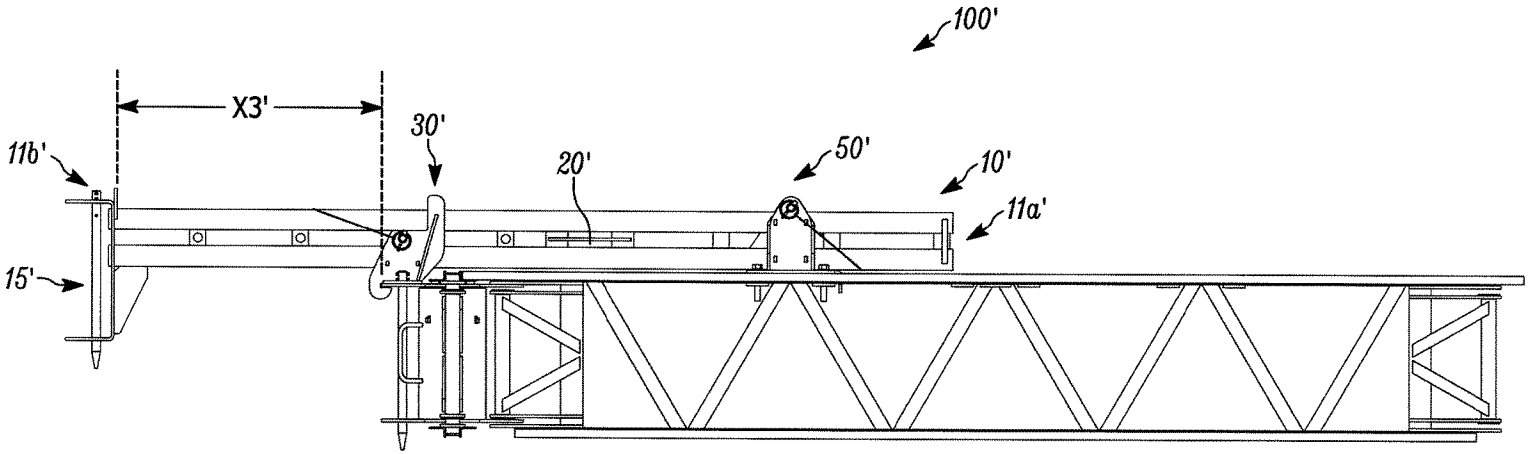

In the embodiment shown in FIGS. 9B and 9C, the bracket 100' is in second and third partially extended positions, respectively, with the stop plate 20' between the hub connection portion 30' and elongated member connection portion 50'. As the base post member 10' extends, it slidingly moves through the channels 38', 58' of the hub connection portion 30' and elongated member connection portion 50', respectively, such that the first end 11*a*' of the base post portion 10' moves further toward the elongated member connection portion 50' and the second end 11*b*' of the base post portion 10' moves away from (outward from) the hub connection portion 30'.

In an embodiment, such as shown with respect to FIG. 9B, a second position corresponds to that of the base post member 10' when the pin 35' engages a second connection 12' with aperture 13'. The distance between the guardrail post connector 15' and hub connection portion 30' when in such a second position (identified as X2') corresponds to the width of two flooring planks or panels. Likewise, as shown in FIG. 9C, a third position corresponds to that of the base post member 10' when the pin 35' engages a third connection 12' with aperture 13'. The distance between the guardrail post connector 15' and hub connection portion 30' when in such a third position (identified as X3') corresponds to the width of three flooring planks or panels.

Figure 9D:
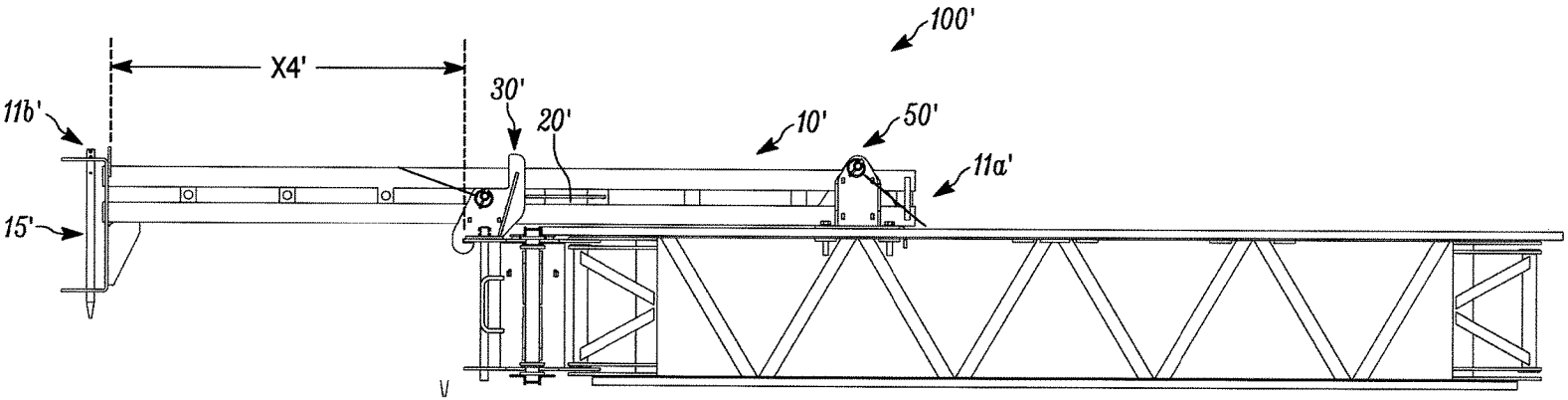
FIG. 9D is a side view of a second embodiment of an adjustable platform extension bracket in a fully extended position.

In the exemplary embodiment shown in FIG. 9D, the stop plate 20' is adjacent the node connection portion 30', such that the bracket 100' is in its fully extended position (e.g., the second end portion 11*b*' of the base post member 10' is as far from the elongated member connection portion 50' as possible), with the stop plate 20' preventing the base post member 10' from sliding any further in a direction which would increase the distance between the second end portion 11*b*' and the elongated member connection portion 50'.

As will be appreciated, in an embodiment such as shown with respect to FIG. 9D, a fourth or fully extended position corresponds to that of the base post member 10' when the pin 35' engages a fourth or final connection 12' with aperture 13'. The distance between the guardrail post connector 15' and the hub connection portion 30' when in such a fourth or final position (identified as X4') corresponds to the width of four flooring planks or panels.

In other words, the connections 12' with apertures 13' determine the position of the base post member 10' relative to the end of any work platform system to which the bracket 100' may be attached and thereby act, in essence, as positional structures to guide and determine the position of the base post member 10'.

As made clear by FIGS. 9A-9D, the position of the base post member 10' as shown in FIG. 9A corresponds to the position of a first connection 12' with aperture 13' in the hub connection portion 30' such that the pin 35' engages that first connection 12' with aperture 13', and it is understood that the positions of the base post member shown in FIGS. 9B, 9C, and 9D therefore each also corresponds to the position of a subsequent connection 12' with aperture 13' as the pin 35' engages those connections 12' with apertures 13'.

It is further understood that more or fewer connections 12' with aperture 13' may be provided on base post member 10' to allow for different numbers of flooring planks or panels to be secured to the bracket 100', to permit flooring planks or panels having identical alternate widths to be secured to the bracket 100', or to permit planks or panels of varying widths to be secured to the bracket.

In an alternative embodiment, the connections 12' with apertures 13' may be provided as a single elongated connection 12' with aperture 13' so as to provide continuous, or approximately continuous, adjustability of the base post member 10' within the bracket 100'.

Figure 14A:
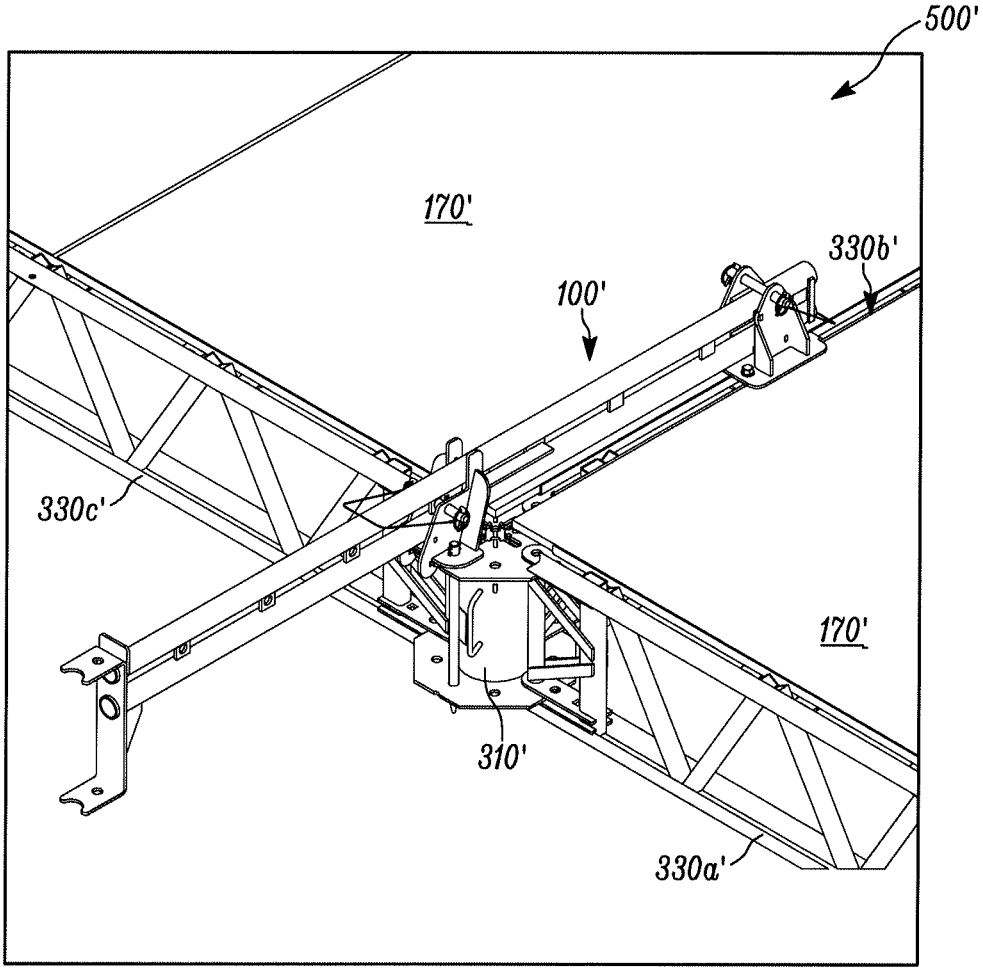
FIG. 14A shows a second embodiment of an adjustable platform extension bracket secured to a platform.
Figure 14B:
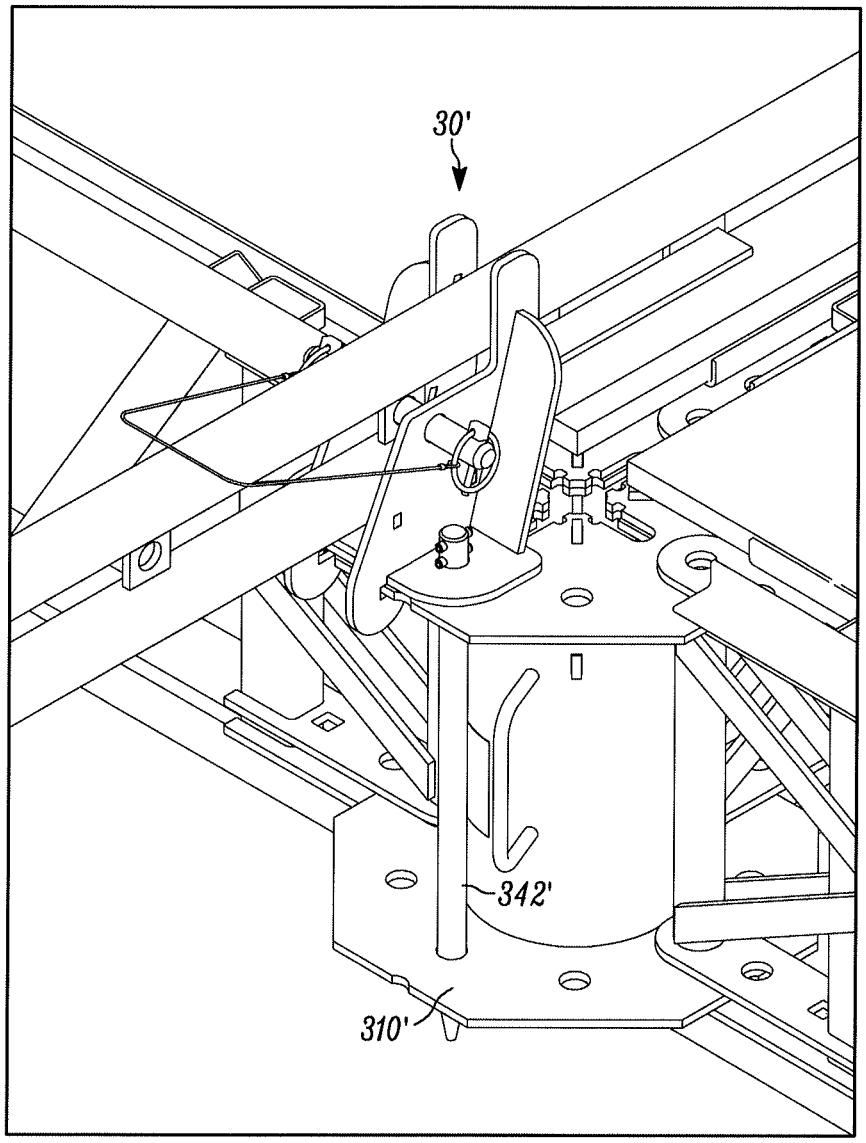
FIG. 14B shows the hub connection of a second embodiment an adjustable platform extension bracket.
Figure 14C:
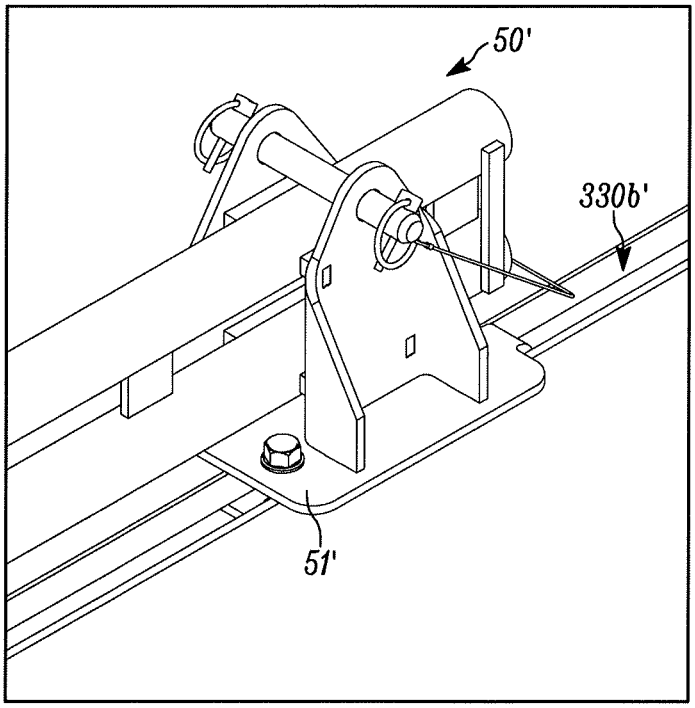
FIG. 14C shows the elongated member connection of a second embodiment of an adjustable platform extension bracket.
Figure 15:
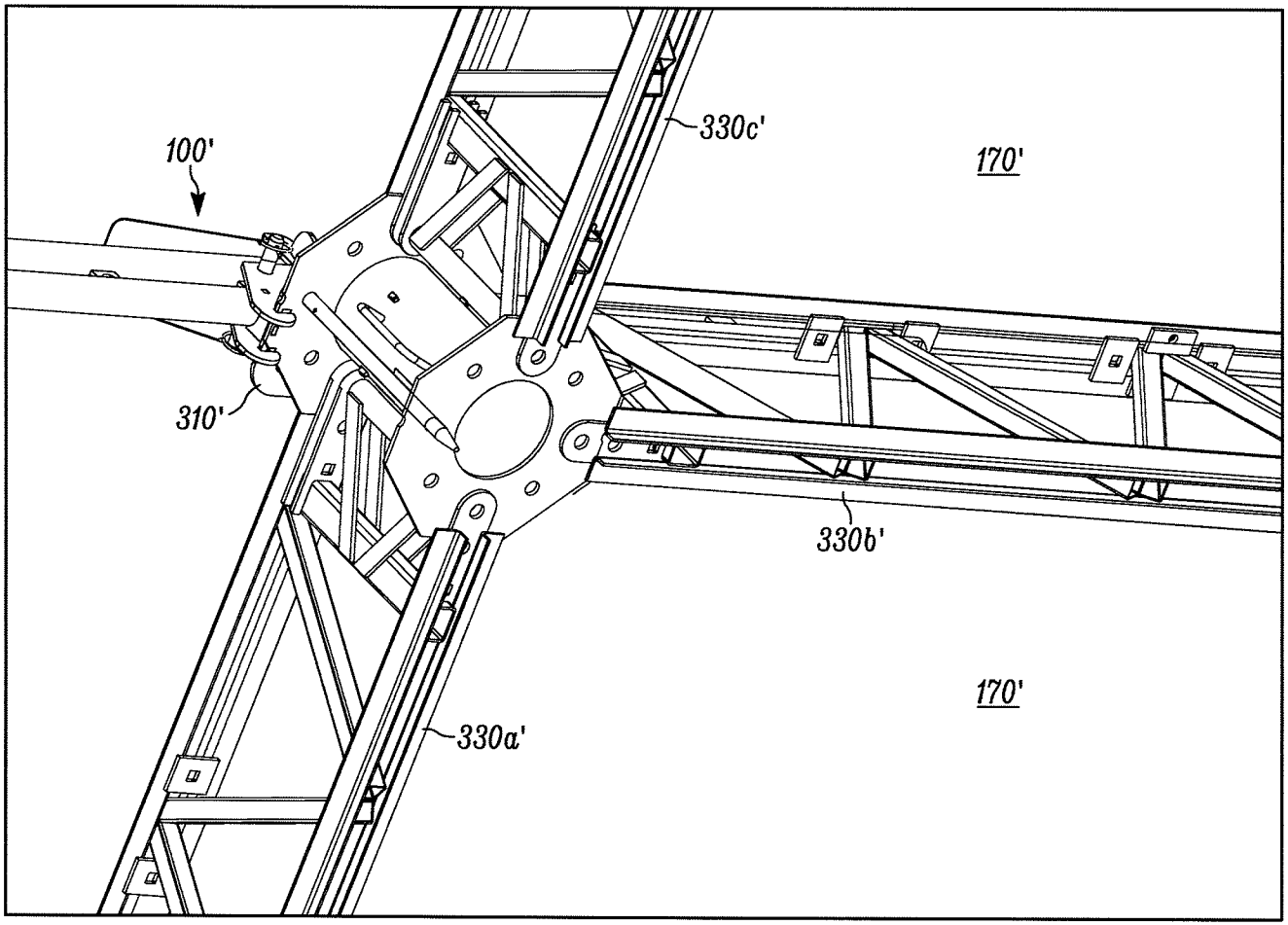
FIG. 15 is a bottom view of a second embodiment of an adjustable platform extension bracket secured to a portion of a work platform system.

FIGS. 14A through 14C shows the bracket 100' connected to a portion of a work platform system 500' including a hub 310' and an elongated member 330', with FIG. 15 showing the underside of the portion of a work platform system with the bracket 100' attached.

Specifically, FIG. 14A shows a portion of a work platform system including two flooring sections 170' secured on a frame composed of a hub 310' and three elongate structural members 330*a*', 330*b*', and 330*c*'. FIG. 14B shows the connection between a hub 310' and hub connection portion 30' in further detail. FIG. 14C shows the connection between elongate structural member 330*b*' and the elongate structural member connection portion 50' in further detail.

The structure of the hubs 310' and elongate structural members 330' suitable for use with the brackets 100' of the present disclosure and the work platform systems 500' made using the hubs 310' and elongate structural members 330' which the brackets 100' of the present disclosure serve to extend are described with reference to FIGS. 18A-29, as described above, with like reference numbers referring to like components.

Referring back to FIGS. 14A-14C and 15, the hub 310' is shown with three elongated members 330*a*', 330*b*', and 330*c*' attached to the hub 310' as described with reference to FIGS. 18A-21B. In the view shown and with reference to FIG. 18A, the elongated members 330' are attached to the hub 310' at openings 313*b*'/314*b*', 313'/314*f* and 313*h*'/314*h*'. The hub connection portion 30' is secured to the hub 310' at openings 313*d*'/314*d*'. In this arrangement, the base post member 10' is parallel with elongated member 330*b*' so that the elongated member connection portion 50' can be secured to the elongated member 330*b*'. Because the hub connection portion's 30' apertures 33' are positioned on the outside of the channel 38' (e.g., offset from the channel 38'), when either aperture 33' is aligned with openings 313*d*'/314*d*', the hub connection portion 30', and therefore base post member 10', is offset from the center opening 316'. The offset connection of the hub connection member 30' with the hub 310' allows the center opening 316' to still be able to receive a linkage or suspension connector by which the hub 310' can be suspended from another structure, such as from a deck of the suspension bridge.

In the embodiment shown, the hub connection portion 30' is connected to the hub 310' using pin 342' similar to, or preferably identical to, those used to secure the elongated members 330*a*', 330*b*', 330*c*' to the hub 310'.

Referring again to FIGS. 14A-14C and 15, and particularly FIG. 14C, the elongated member connection portion 50' is shown secured to the elongated member 330*b*'. Specifically, the elongated member connection portion 50' is aligned on the elongated member 330*b*', and particularly on the upper element 332' (not shown) of the elongated member 330*b*' such that the apertures 56' (not shown) in the base portion 51' of the elongated member connection portion align with reinforced securing structures (such as luge nuts 142') of the elongated member 330'. Securing structures (e.g., screw, bolt, pin or similar structure) are passed through the aligned apertures 56' to secure the elongated member connection portion 50' with the elongated member 330'.

With further reference to FIGS. 14A-14C and 15, the bracket 100' is secured to the work platform system 500' at both a hub 310' and an elongated member 330*b*', with at least a portion of the base post member 10' running parallel and adjacent to an elongated member 330*b*'. As a result, the downward force generated by weight placed on any extended platform built on the brackets 100' is transferred to the hub 310' and joist 330*b*' and therefore distributed among the further elongated members 330' which may be further attached to the hub 310'. The present bracket 100 is therefore generally disposed horizontally when in standard operating position. No diagonal support is required. In fact, in an embodiment, the bracket 100' is free from diagonal structural members when in the standard operating position.

Figure 16A:
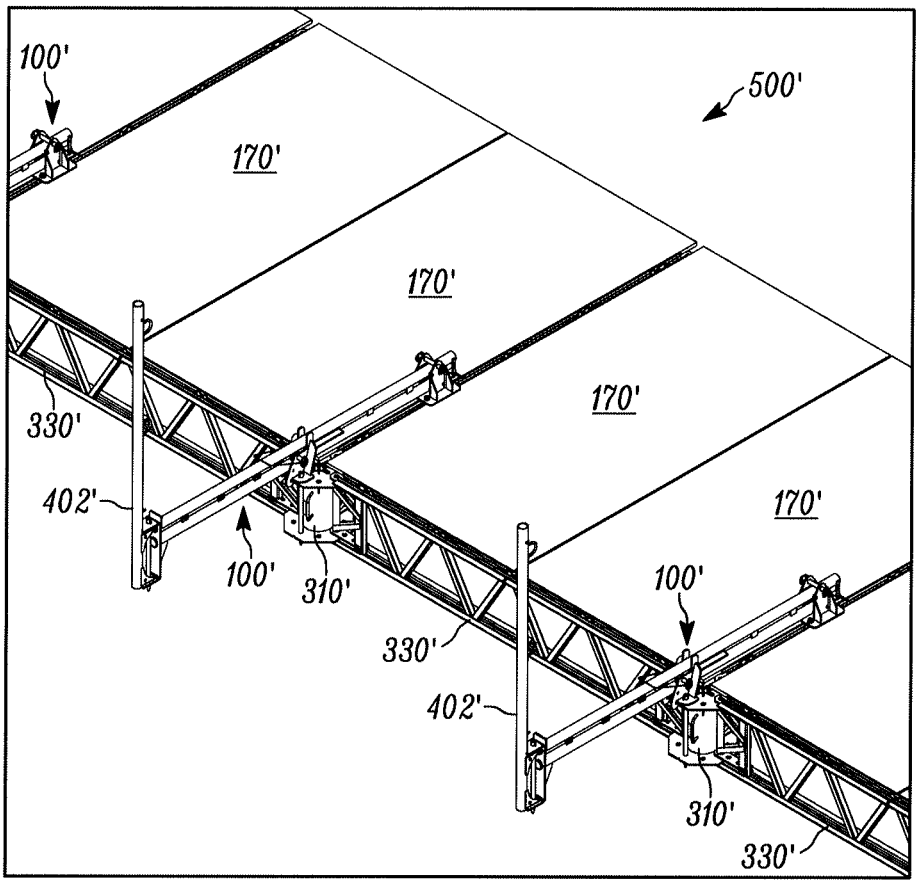
FIGS. 16A and 16B show a second embodiment of the adjustable platform extension bracket secured to a portion of a work platform system without a work platform secured to the base post member.
Figure 16B:
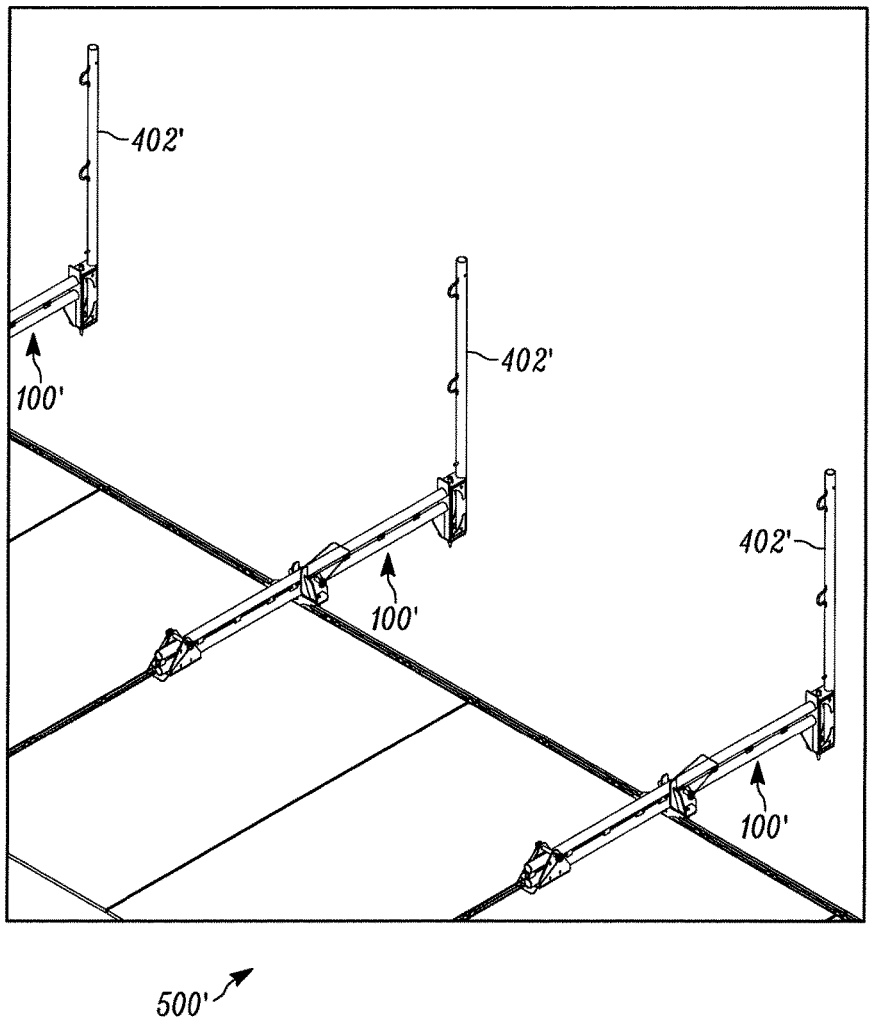

In accordance with an embodiment of the present disclosure, FIGS. 16A and 16B show a number of brackets 100' secured to a portion of a work platform 500'. While in the embodiment shown there are three brackets 100', with each bracket 100' positioned at an available hub 310' such that each hub 310' has a corresponding bracket 100'. However, it is understood that only hubs 310' along a perimeter of a work platform 500' will be available to secure a bracket 100'. Further, not every hub 310' along a work platform 500' perimeter need necessarily have a corresponding bracket 100' depending on the situation, use and desired extended platform size.

As shown in FIGS. 16A and 16B, the brackets 100' are each in the fully extended position and ready to receive flooring sections (e.g., flooring boards, deck panels, planks, wood or metal hook planks, etc.).

Figure 17A:
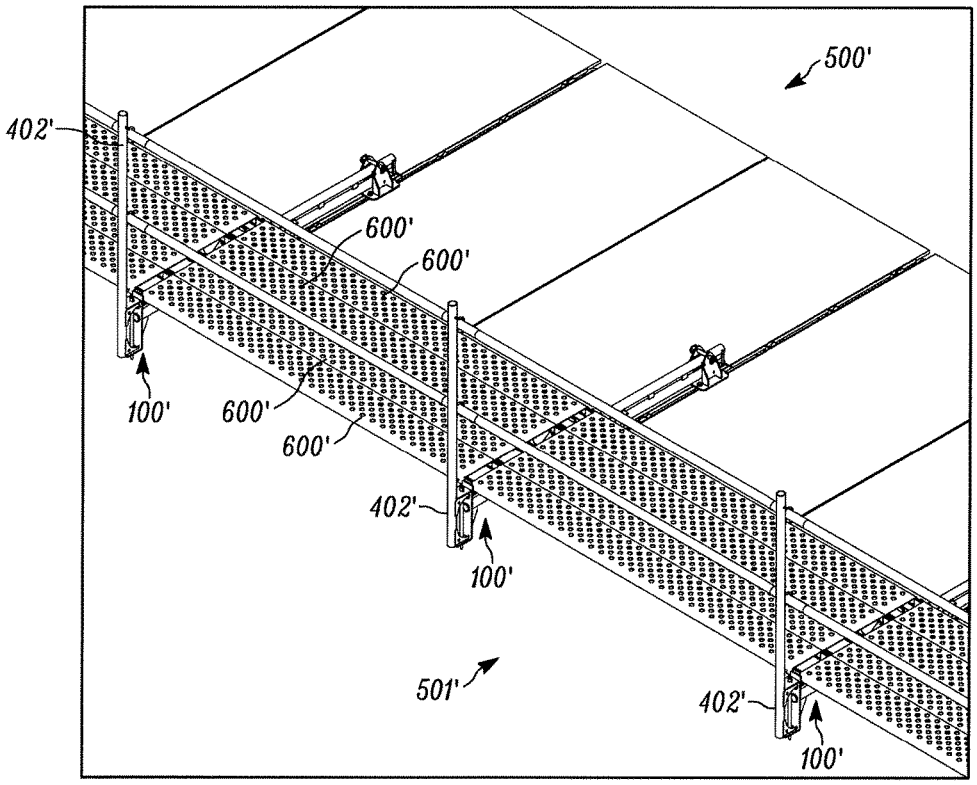
FIGS. 17A, 17B, and 17C show a second embodiment of the adjustable platform extension bracket secured to a portion of a work platform system with a work platform secured to the base post member.
Figure 17B:
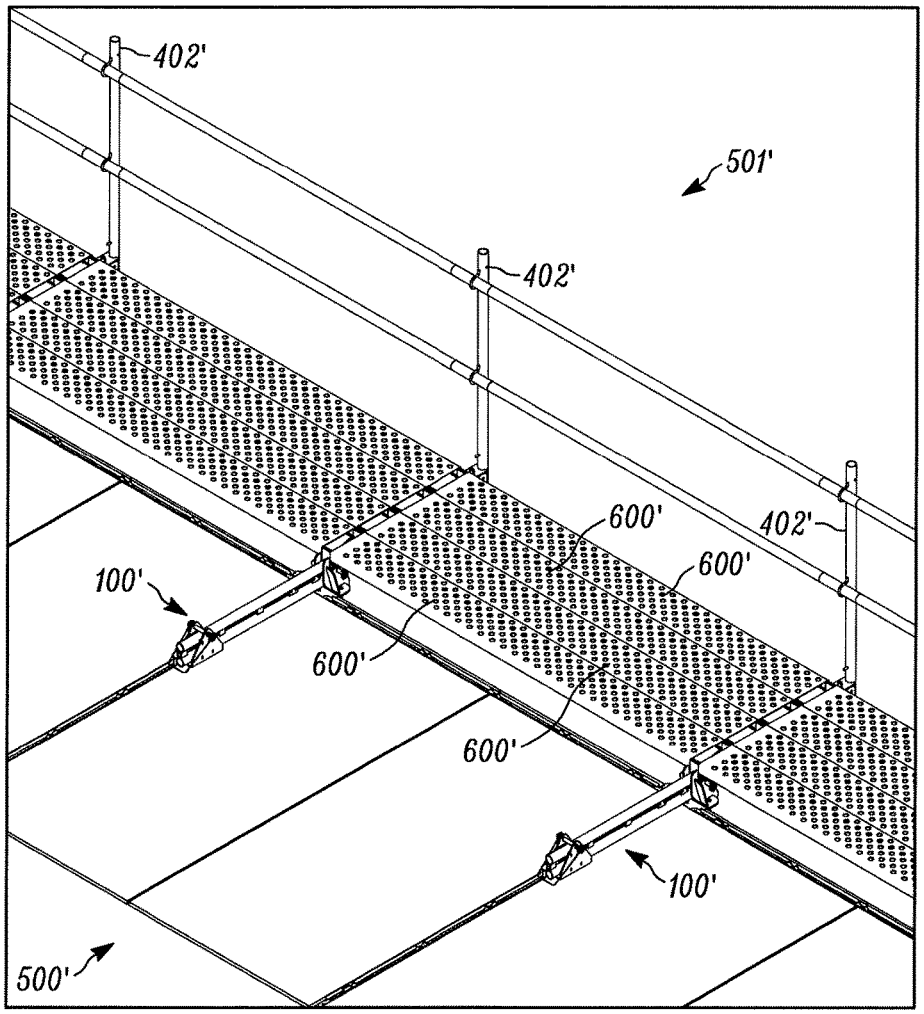
Figure 17C:
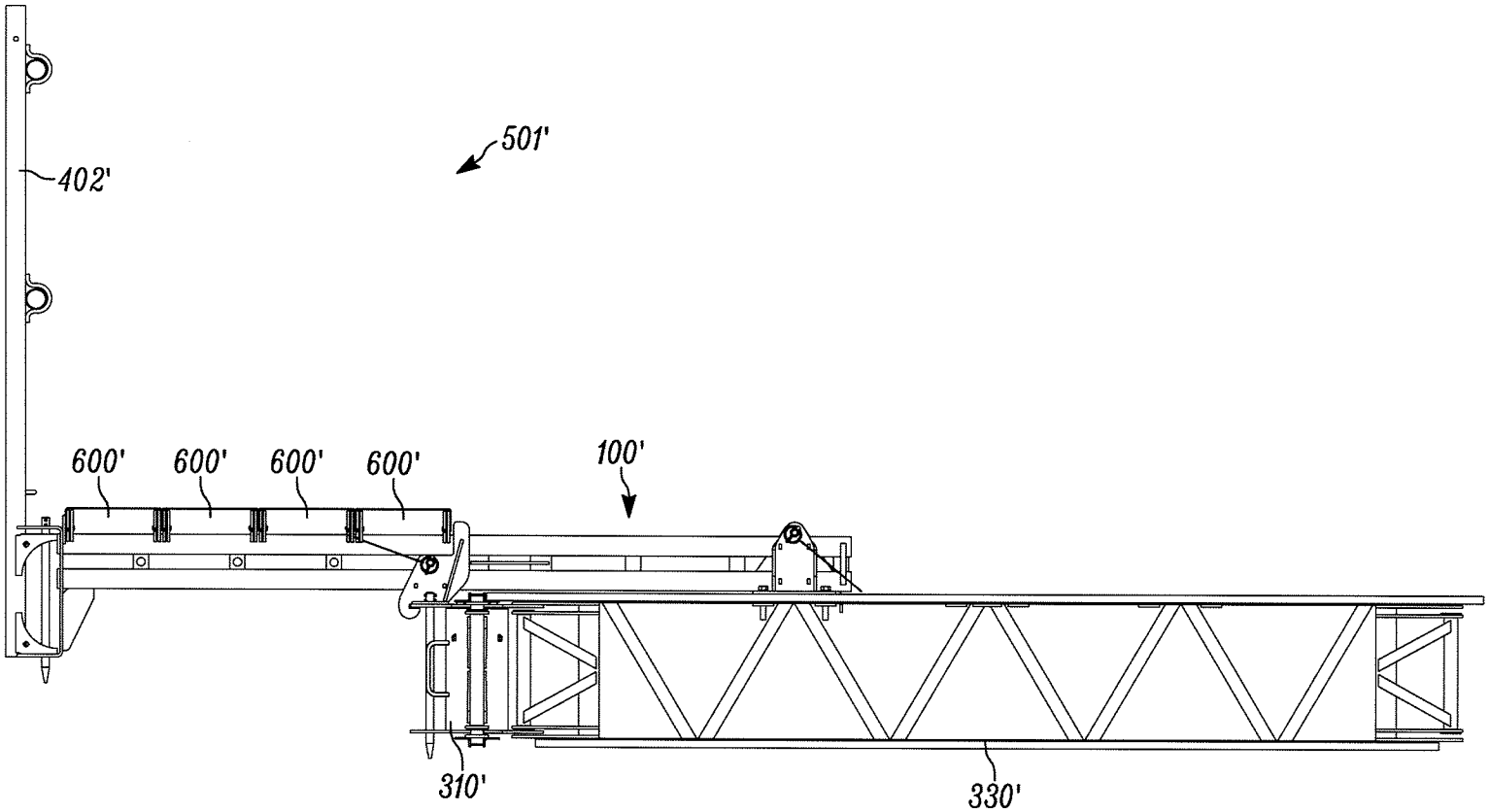

In the exemplary embodiment shown, and with further reference to FIGS. 17A-17C, when fully extended, the bracket 100' may be used to secure up to four scaffold planks and/or flooring sections 600' to form an extended work platform 501'. As shown in FIGS. 17B-17C, the extended work platform 501' is raised compared to the work platform system 500'. In some embodiments, a toe board or other system may be provided to cover the gap between the work platform system 500' and the extended work platform 501'.

As shown in FIGS. 16A-17C, the guard rail post connectors 15' of each bracket 100' secure a guard rail post 402' and, with particular reference to FIGS. 17A-17C, a guard rail system is installed.

In the exemplary embodiment shown, the base post member 10' of each bracket 100' includes four connections 12' with apertures 13', with each of such connections 12' corresponding to a position enabling the bracket 100' to secure one plank and/or flooring section 600'. For example, and with reference to FIG. 9A, the space between the guard rail post connector 15' and the end of the hub 310' corresponds to the width of a standard platform plank (e.g., wood or metal hook plank) or other work platform flooring section. In the exemplary embodiment shown, for example, the distance from the guard rail post connector 15' to the end of the hub 310' (XI') is from approximately 4 inches, or 5 inches, or 5.25 inches to 5.5 inches, or 6 inches, or 7 inches. In the exemplary embodiment shown, the distance from the guard rail post connector 15' and end of hub 310' is 5.25 inches.

As shown in FIGS. 9A-9D, as the position of the base post member 10' changes (e.g., is extended such that a further subsequent connection 12' with aperture 13' engages the hub connection portion 30'), the distance between the guard rail post connector 15' and the end of the hub 310' increases proportionally to allow a further platform plank and/or work platform flooring section to be secured to the bracket 100'.

For example, and in the embodiments shown in FIG. 9B, the distance between the space between the guard rail post connector 15' and the end of the hub 310' when the bracket is in its second position (e.g., the second connection 12' with aperture 13' as counted from the second end 11*b'* of the base post member 10' is within the hub connection portion 30') corresponds to the width of two standard platform planks (e.g., wood or metal hook plank) or other work platform flooring sections. In the exemplary embodiment shown, for example, the distance from the guard rail post connector 15' to the end of the hub 310' (X2') is from approximately 10 inches, or 12 inches, or 14 inches to 15 inches, or 16 inches, or 17 inches. In the exemplary embodiment shown, the distance from the guard rail post connector 15' and end of hub 310' is 14.63 inches.

For example, and in the embodiments shown in FIG. 9C, the distance between the space between the guard rail post connector 15' and the end of the hub 310' when the bracket is in its third position (e.g., the third connection 12' with aperture 13' as counted from the second end 11*b'* of the base post member 10' is within the hub connection portion 30') corresponds to the width of three standard platform planks (e.g., wood or metal hook plank) or other work platform flooring sections. In the exemplary embodiment shown, for example, the distance from the guard rail post connector 15' to the end of the hub 310' (X3') is from approximately 20 inches, or 22 inches, or 23 inches to 24 inches, or 25 inches, or 26 inches. In the exemplary embodiment shown, the distance from the guard rail post connector 15' and end of hub 310' is 23.88 inches.

For example, and in the embodiments shown in FIG. 9D, the distance between the space between the guard rail post connector 15' and the end of the hub 310' when the bracket is in its fourth position (e.g., the fourth connection 12' with aperture 13' as counted from the second end 11*b'* of the base post member 10' is within the hub connection portion 30') corresponds to the width of four standard platform planks (e.g., wood or metal hook plank) or other work platform flooring sections. In the exemplary embodiment shown, for example, the distance from the guard rail post connector 15' to the end of the hub 310' (X4') is from approximately 30 inches, or 32 inches, or 33 inches to 34 inches, or 35 inches, or 36 inches. In the exemplary embodiment shown, the distance from the guard rail post connector 15' and end of hub 310' is 33.13 inches.

In an embodiment, the number of positional structures may vary, at the total distance between the space between the guard rail post connector 15' and the end of a hub 310' may vary continuously, or incrementally, from 0 inches, or from 2 inches, or from 4 inches, or from 5 inches, or from 5.25 inches, or from 10 inches, or from 12 inches, or from 14 inches, or from 20 inches, or from 22 inches, or from 23 inches, or from 30 inches, or from 32 inches, or from 33 inches to 50 inches, or to 40 inches, or to 38 inches, or to 36 inches, or to 35 inches, or to 34 inches, or to 26 inches, or to 25 inches, or to 24 inches, or to 17 inches, or to 16 inches, or to 15 inches, or to 7 inches or to 6 inches, or to 5.5 inches.

In on embodiment, the base post member is incrementally positionable from approximately 0 inches to approximately 40 inches in units of approximately 0.5 inches, or 1 inch, or 1.1 inches, or 1.2 inches, or 1.25 inches, or 1.3 inches, or 1.4 inches, or 1.5 inches, or 1.6 inches, or 1.7 inches, or 1.75 inches, or 1.8 inches, or 1.9 inches, or 2 inches, or 2.1 inches, or 2.2 inches or 2.25 inches, or 2.3 inches, or 2.4 inches, or 2.5 inches, or 2.6 inches, or 2.7 inches, or 2.75 inches, or 2.8 inches, or 2.9 inches, or 3 inches.

In an embodiment, the present disclosure relates to a method of extending a work platform. In a first step, a hub connection portion is provided. In an embodiment, the hub connection portion is a hub connection portion as described, for example, with reference to FIGS. 3A-3D or FIGS. 11A-11D. The hub connection portion is then connected to a hub, such as, for example, described with reference to FIGS. 18A-18D.

In an embodiment, the hub connection portion is connected to the hub using at least one pin, for example, as shown and described with reference to FIGS. 5A-5B or FIGS. 14A-14C, for example. In further embodiments, more than one pin may be used to secure a hub connection portion to a hub. In an embodiment, at least two pins are used to secure a hub connection portion to a hub.

In a next step, a base post portion is provided. In an embodiment, the base post portion is a base post portion as described, for example, with reference to FIG. 2A-2D or 10A-10D. The base post portion is then secured to the hub connection portion to form the assembled bracket.

In an embodiment, the base post portion is slidingly secured to the hub connection portion. In an embodiment, the base post portion is slidingly secured to the hub connection portion by sliding the base post portion into the channel of the hub connection portion.

In an embodiment, the step of securing the base post portion to the hub connection portion includes sliding the base post portion into the channel of the hub connection portion.

In an embodiment, the method of extending a work platform further includes securing the base post member in position. For example, as shown and described with reference to FIGS. 5A-5B, to secure the base post portion in a position, at least one pin is used. The pin engages the base post portion and hub connection portion to prevent the base post portion from sliding further in the hub connection portion. Specifically, and with reference to the embodiments described with respect to FIGS. 4A-4B and 5A-5B, the at least one pin passes through the apertures of the channel plates of the hub connection portion and the aperture of one of the connections of the base post portion. In a further embodiment in which at least two pins are used to secure the base post member in position, the at least two pins pass through the apertures of a pair of connections. The specific position of the base post portion is determined by which connection/aperture is engaged by the pin.

In an embodiment, the step of securing the base post portion in position includes aligning a connection portion with an aperture on the base post portion between the apertures of the channel plates on the hub connection portion. As described with reference to FIGS. 1A-1D, the location of the connection/aperture on the base post portion determines the distance between the end of the base post portion (in an embodiment, for example, the end of the base post portion having a guard rail post connector) and the hub connection portion, and therefore the size of the extended platform.

In an embodiment, the pin or pins used to secure the base post portion in a position each include a wire connected at both ends to a respective end of the pin. In this way, and as described with reference to FIGS. 4A and 4B, the pin(s) is prevented from disengaging the respective connection portion.

In an embodiment, the method of extending a work platform includes installing at least one flooring section and/or plank on the bracket. In one embodiment, for example, the flooring section and/or plank is a work platform plank, such as a wood or metal hook plank. In such an embodiment, the step of installing at least one flooring section and/or plank includes placing at least one hook of the plank over the base post member. In a further embodiment, multiple flooring sections and/or planks are installed on the base post member.

In a further embodiment, such as, for example, when a hub connection portion as described with reference to FIGS. 11A-11D is provided, the method further includes providing an elongated member connection portion prior to providing a base post member. In an embodiment, the elongated member connection portion is an elongated member connection portion as described, for example, with reference to FIGS. 12A-12D. The elongated member connection portion is then connected to an elongated member, such as, for example, described with reference to FIGS. 12A-15.

In an embodiment, the elongated member connection portion is connected to the elongated member as described, for example, with reference to FIGS. 14A-14C and 15. In an embodiment, the elongated member connection portion is connected to the elongated member at reinforced securing structures on the elongated member. In a further embodiment, the reinforced securing structures are cage nuts, and the elongated member connection portion is secured to the elongated member by bolts which pass through the base of the elongated member connection portion and engage the cage nuts.

In an embodiment, the hub to which the hub connection portion is connected and the elongated member to which the elongated member connection portion is connected are secured to one another. For example, in an embodiment, the hub and elongated member are connected to each other as described with reference to FIGS. 9A-18.

In a further embodiment, the step of securing the base post portion in a position includes using at least two pins, a first pin to engage the base post portion and hub connection portion as described above and a second pin to engage the elongated member connection portion.

In a further embodiment, the step of securing the base post portion in a position includes using at least three pins, two of which engage the base post portion and that hub connection portion, as described above, and the third which engages the elongated member connection portion.

In a further embodiment, the method of extending a work platform includes providing at least two hub connection portions, and connecting each of the hub connection portions to a hub as described above. In an embodiment, each hub is connected to at least one elongated member.

In an embodiment in which elongated member connection portions are to be used, the method further includes providing at least two elongated member connection portions and connecting each of the elongated member connection portions to an elongated member as described above. In an embodiment, each elongated member is secured to one of the hubs, thereby forming two units, each composed of an elongated member connected to a hub, a hub connection portion secured to the hub and an elongated member connection portion secured to the elongated member. The corresponding hub connection portions and elongated member connection portions form hub connection portion/elongated member connection portion sets.

The method of extending the work platform system then also includes providing at least two base post members and securing each base post member to one of the hub connection portions or hub connection portion/elongated member connection portion sets. In an embodiment, the base post members are secured to the hub connection portion (or hub connection portion/elongated member connection portion sets) to form two assembled brackets as described above. The method then further includes securing the base post members in a position and installing one or more flooring sections and/or planks on the brackets as described above.

In an embodiment, both base post members are secured in a position such that the distance between the hub connection portion and the end of the base post member furthest from the elongated member connection portion is the same. In a further embodiment, each base post member is secured in a different position.

In an embodiment, the hub connection portions are connected to hubs such that the respective base post members are parallel, or approximately parallel, to one another when secured in the hub connection portions.

In an embodiment, the elongated members to which the elongated member connection portions are secured are parallel, or approximately parallel, one another. In that way, the base post portions are parallel, or approximately parallel, one another.

In an embodiment, the step of installing one or more flooring sections and/or planks on the brackets includes laying the flooring section and/or plank over the brackets such that it is supported by both base post members. In an embodiment, the flooring section and/or plank is a wood or metal hook plank and the step of installing one or more flooring sections and/or planks on the brackets includes placing at least one hook of a first end of the plank over a first base post member and placing at least one hook of a second end of the plank over the second base post member. In an embodiment, multiple flooring sections and/or planks are installed on the brackets.

In an embodiment, the present disclosure relates to a method of erecting an extended work platform system. In an embodiment, the method of erecting an extended work platform system comprises providing a plurality of elongated members and at least two hubs and pivotally connecting at least one elongated member to each of the hubs. In an embodiment, the at least one elongated member is connected to each of the hubs as described, for example, with reference to FIGS. 9-20.

In a further embodiment, the plurality of elongated members and at least two hubs may be provided as part of a suspended work platform system as described, for example, with reference to FIGS. 18A-29. In still a further embodiment, the method of erecting an extended work platform system may include first erecting at least a portion of such a suspended work platform system.

When erecting a portion of a suspended work platform system, first a plurality of hubs and a plurality of elongated members are provided. In an embodiment, the plurality of hubs comprises four hubs and the plurality of elongated members comprises four elongated members. Next, the plurality of hubs are pivotally attached to the plurality of elongated members such that (i) one of the elongated members and two of the hubs are stationary, (ii) two of the elongated members are rotatable, and (iii) two of the hubs and one of the elongated members are translatable. In a further step of erecting a portion of a suspended work platform system, the method includes articulating the two rotatable elongated members, the two translatable hubs and the one translatable elongated member from an initial position to a final position with respect to the stationary elongated member and the stationary hubs so as to receive a work platform. In an embodiment, the elongated members of the plurality are substantially co-planar with respect to each other in the initial and final positions. In an embodiment, the articulating does not require any hoisting equipment. In an embodiment, the articulating is completed in a cantilevered manner.

In the method of erected an extended work platform system, after the plurality of hubs and plurality of elongated members are provided, at least two hub connection portions are provided. In an embodiment, the hub connection portion are as described, for example, with reference to FIG. 3A-3D or 11A-11D. Each of the hub connection portions are then secured to one of the hubs. In an embodiment, the hubs to which the hub connection portions are secured are adjacent one another.

In the method of erecting an extended work platform system such as, for example, when hub connection portions as described with reference to FIGS. 11A-11D are provided, at least two elongated member connection portions are also provided. In such an embodiment, the elongated member connection portion are as described, for example, with reference to FIGS. 12A-12D. Each of the elongated member connection portions are then secured to one of the elongated members, specifically an elongated member which is connected to a hub to which a hub connection portion is secured. Even more specifically, a first elongated member connection portion is secured to a first elongated member which is attached to the first of the two hubs to which a hub connection portion is secured, and the second elongated member connection portion is secured to the elongated member which is parallel to, or approximately parallel to, the first elongated member and secured to the second of the two hubs to which a hub connection portion is secured.

In other words, when both hub connection portions and elongated member connection portions are used, two of the hubs have hub connection portions secured to them, and two elongated members have elongated member connection portions secured to them. Each elongated member containing an elongated member connection portion is attached to a hub containing a hub connection portion, and the hubs having the hub connection portions are attached to one another by a third elongated member which does not contain an elongated member connection portion. Each corresponding hub connection portion and elongated member connection portion forms a hub connection portion/elongated member connection portion set.

In an embodiment, the hub connection portions and, if used, elongated member connection portions, are secured to the hubs and elongated members, respectively, as described, for example, above and with reference to FIG. 4A-6 or 13A-15.

In a next step, at least two base post members are provided, and each base post member is secured to a hub connection portion (or hub connection portion/elongated member connection portion set) to form two completed brackets. In an embodiment, the base post member is slidingly secured to a hub connection portion (or hub connection portion/elongated member connection portion set) as described above and, for example, with reference to FIG. 1A-6 or 9A-15. The base post members are then secured in a position as discussed above and with reference, for example, to FIG. 1A-6 or 9A-15. In an embodiment, both base post members are secured in a position such that the distance between the hub connection portion and the end of the base post member (e.g., the end of the base post member containing a guard rail post connector) is the same. However, in further embodiments, each base post member may be secured in a different position.

At least one flooring section and/or plank is then installed on the completed brackets as described above.

The numerical ranges disclosed herein include all values from, and including, the lower value and the upper value. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

Among other things, it should be appreciated that the scope of the present disclosure is not limited to the number of constituting components, the materials thereof, the shapes thereof, the relative arrangement thereof, etc., as described above, but rather the above disclosures are simply provided as example embodiments. Further, any statements provided regarding clearance or other features which may provide improved safety are not intended to guarantee, warrant or represent the safety of the bracket disclosed herein Thus, it is specifically intended that the present invention not be limited to the embodiments and illustrations contained herein, but include modified forms of those embodiments including portions of the embodiments and combinations of elements of different embodiments as come within the scope of the following claims.

What is claimed is:

1. A bracket comprising:

a post member having a width and comprising a first post and a second post, the first and second posts being parallel and connected by a plurality of positional structures, each positional structure including an aperture, and a first connection portion comprising a base structure and two channel structures secured to the base structure at a distance from one another thereby forming a first approximately U-shaped channel, wherein the two channel structures each include at least one aperture, wherein the apertures are coaxial, wherein the base structure includes two apertures, each aperture positioned outside of the approximately U-shaped channel and adjacent a respective channel structure such that the first connection portion is symmetrical along an axis parallel with and passing through the center of the approximately U-shaped channel, wherein the width of the post member is less than the distance between the channel structures of the first connection portion, wherein the post member is slidingly engaged in the first channel such that at least one of the plurality of positional structures is positionable between the channel structures of the first connection portion with the aperture of the at least one positional structure coaxial with the apertures of the channel structures of the first connection portion, and wherein the bracket itself does not comprise any diagonal support member.

2. The bracket of claim 1, wherein the base structure comprises a top element and a bottom element separated and connected by a mid-portion.

3. The bracket of claim 2, wherein the top and bottom elements are planar and parallel to each other.

4. The bracket of claim 3, wherein the top and bottom elements of the base structure both include at least two openings extending through both the top and bottom elements, wherein respective openings are coaxial and together form the at least two apertures of the base structure.

5. The bracket of claim 4, comprising at least 4 positional structures.

6. The bracket of claim 1, further comprising a second connection portion comprising a base and two channel structures secured to the base at a distance from one another thereby forming a second U-shaped channel.

7. The bracket of claim 6, wherein the post member is slidingly engaged in the first and second channels such that each of the plurality of positional structure is positionable between the channel structures of the first connection portion such that the aperture of each of the positional structure is coaxial with the apertures of the channel structures.

8. The bracket of claim 7, wherein the post member includes stop plate projecting outwardly from the post member such that the width of the post plus the stop plate is greater than the distance between the channel plates of the first connection portion.

9. The bracket of claim 1, wherein the first connection portion is configured to secure to a portion of a suspended work platform.

10. The bracket of claim 9, wherein the portion of a suspended work platform is a hub.

11. The bracket of claim 10, wherein the hub comprises an element, an additional element and a section situated therebetween connecting the element and the additional element, the element having a centralized element opening disposed generally at or about a center of the element, and a slot extending from the centralized element opening to a distal end, the slot configured to receive and retain a suspension connector therein, at or near the distal end of the slot, and the section connecting the element and the additional element having a substantially uniform cross-section along a length thereof.

12. The bracket of claim 6, wherein the second connection portion is asymmetrical along the second channel.

13. The bracket of claim 8 wherein the post member has a first end and a second end including a guard rail post connector, wherein the stop plate is positioned between the first end and the second end, the positional points are positioned between the second end and the stop plate, and wherein the base post member further comprises a plurality of connections which connect the first post and the second post between the stop plate and the first end of the base post member.

14. An extended work platform comprising:

a work platform comprising at least two hubs, and at least two platform extension brackets, each comprising a base post member having a width and comprising a first post and a second post, the first and second posts being parallel and connected by a plurality of positional structures, each positional structure including an aperture, and a hub connection portion comprising a base portion and two channel plates that are connected to the base portion at a distance to form a first U-shaped channel and each of the two channel plates includes at least one aperture, wherein the at least one aperture of each of the two channel plates is coaxial, wherein the base portion includes at least two apertures, each aperture positioned outside of the first U-shaped channel and adjacent a respective channel plate such that the first connection portion is symmetrical along an axis parallel with and passing through the center of the channel, wherein the width of the base post member is less than the distance between the channel plates so that the base post member is slidingly engaged in the first U-shaped channel such that at least one of the positional structures is positionable between the channel plates with the aperture of the at least one of the positional structures is coaxial with the apertures of the channel plates, wherein each of the two platform extension brackets is free from any diagonal support member when in standard operating position, wherein each hub connection portion is secured to a respective one of the at least two hubs, and at least one flooring plank secured to the base post members so as to extend between the base post members.

15. The extended work platform of claim 14, wherein the hub connection portions are secured to the hubs using at least one pin.

16. The extended work platform of claim 15, further comprising at least two elongated members, wherein each of the at least two hubs are each secured to one of the at least two elongated members using at least one pin.

17. The extended work platform of claim 16 further comprising at least two elongated member connection portions connected to respective elongated members and each comprising a base plate containing at least one aperture and two channel plates connected to the base plate and separated at a distance to form a second U-shaped channel, wherein the base post members are each slidingly engaged in the respective second U-shaped channel so as to be parallel with the respective elongated member.

18. The extended work platform of claim 17, wherein the elongated member connection portions are asymmetrical along an axis parallel with and passing through the center of the channel.

19. The extended work platform of claim 14 wherein each base post member of each of the at least two platform extension brackets is slidingly engaged in a respective one of the first channels such that each of the plurality of positional structures of a base post member is positionable between the channel structures of the respective first connection portions such that the aperture of each of the positional structures may be coaxial with the apertures of the channel structures.

20. The extended work platform of claim 14, wherein the base post members have a first end and a second end, and the first end extends a distance of 4 to 40 inches outward from the hub connection portion.

21. The extended work platform of claim 20, further including at least two flooring sections or planks installed on the first ends of the base post members so as to extend between the base post portion of each of the at least two hub connection portions.

22. The extended work platform of claim 14, wherein the base of the hub connection portions each comprise a top element and a bottom element separated and connected by a mid-portion.

23. The extended work platform of claim 22 wherein the top and bottom elements are planar and parallel to each other, wherein the top element comprises at least two openings and the bottom element comprises an additional at least two openings, each of the additional at least two openings is coaxial with a respective one of the at least two openings of the top element and the respective pairs of coaxial openings form the at least two apertures of the base structure.

24. The extended work platform of claim 23, wherein the hubs each comprise an element, and additional element and a section situated therebetween connecting the element and the additional element, wherein the element includes a first plurality of openings and the additional element includes a second plurality of openings, wherein each one of the openings in the first plurality of openings is coaxial with a respective one of the openings in the second plurality of openings.

25. The extended work platform of claim 24, wherein the top element of the hub connection portions interface with the elements of the hubs and the bottom elements of the hub connection portions interface with the additional elements of the hubs such that at least one pair of coaxial apertures of the top and bottom element of each of the hub connection portions is coaxial with one pair of coaxial openings of each of the hubs.

26. The extended work platform of claim 16, wherein the at least two elongated members are approximately parallel one another.

27. The extended work platform of claim 26, further including at least two flooring sections or planks installed on and extending between the first ends of the base post members.

28. The extended work platform of claim 27, wherein the at least two flooring sections or planks are metal or wood hook planks.

* * * * *